US012650063B2

(12) United States Patent
Zakharia et al.

(10) Patent No.: US 12,650,063 B2
(45) Date of Patent: Jun. 9, 2026

(54) SWITCH MODULE FOR WELLBORE PERFORATING GUN

(71) Applicant: G&H Diversified Manufacturing LP, Houston, TX (US)

(72) Inventors: Steven Zakharia, Houston, TX (US); Brian Auer, Houston, TX (US); Benjamin Knight, Katy, TX (US); Timmothy Lee, Tomball, TX (US); Ryan Ward, Tomball, TX (US); James Kash, Houston, TX (US); Adam Green, Houston, TX (US); David W. Westphal, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 42 days.

(21) Appl. No.: 18/769,386

(22) Filed: Jul. 11, 2024

(65) Prior Publication Data

US 2025/0020046 A1 Jan. 16, 2025

Related U.S. Application Data

(60) Provisional application No. 63/643,228, filed on May 6, 2024, provisional application No. 63/634,406, filed on Apr. 15, 2024, provisional application No. 63/525,948, filed on Jul. 10, 2023.

(51) Int. Cl.

| | |
|---|---|
| ***E21B 43/117*** | (2006.01) |
| ***E21B 43/1185*** | (2006.01) |
| ***E21B 43/119*** | (2006.01) |

(52) U.S. Cl.
CPC ..... *E21B 43/117* (2013.01); *E21B 43/1185* (2013.01); *E21B 43/119* (2013.01)

(58) Field of Classification Search
CPC ... E21B 43/117; E21B 43/1185; E21B 43/119
USPC ..... 89/1.15
See application file for complete search history.

(56) References Cited

U.S. PATENT DOCUMENTS

| | | | | |
|---|---|---|---|---|
| 9,593,548 | B2 * | 3/2017 | Hill | E21B 43/1185 |
| 2015/0330192 | A1 * | 11/2015 | Rogman | E21B 43/1185 166/297 |
| 2019/0323810 | A1 * | 10/2019 | Saltarelli | F42D 1/05 |

* cited by examiner

*Primary Examiner* — John Cooper
(74) *Attorney, Agent, or Firm* — Conley Rose, P.C.

(57) ABSTRACT

An embodiment of a perforating gun system deployable in a wellbore extending through a subterranean earthen formation includes a tandem sub including a sub housing and a signal pod receivable in the sub housing, wherein the signal pod includes a detonator and a receptacle; and a perforating gun including a charge carrier configured to receive one or more shaped charges, the charge carrier including a detonator cord housing configured to receive a terminal end of a detonator cord, and wherein the detonator cord housing is receivable in the receptacle of the signal pod to ballistically couple the detonator cord with the detonator.

14 Claims, 47 Drawing Sheets

Fig. 24
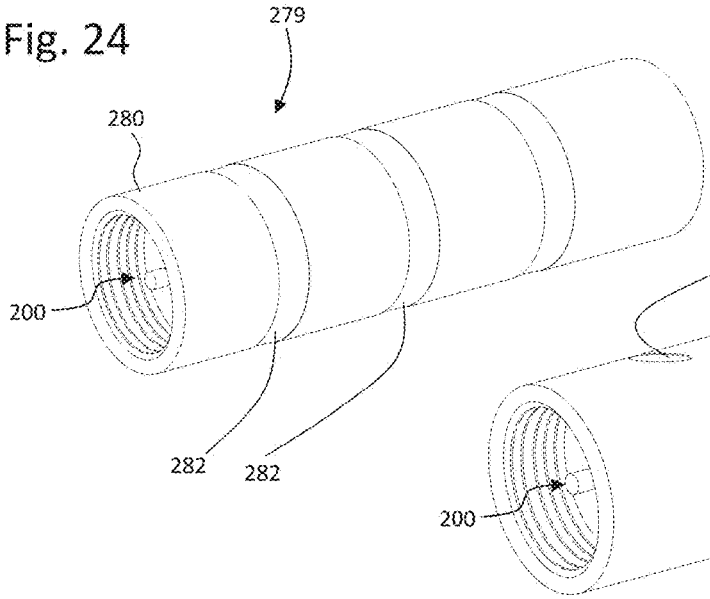
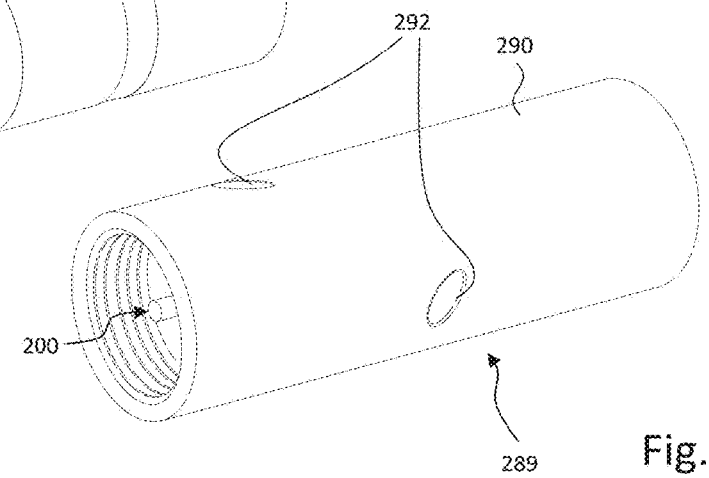
Fig. 25

SWITCH MODULE FOR WELLBORE PERFORATING GUN

CROSS-REFERENCE TO RELATED APPLICATIONS

This application claims benefit of U.S. provisional patent application No. 63/525,948 filed Jul. 10, 2024, U.S. provisional patent application No. 63/634,406 filed Apr. 15, 2024 and U.S. provisional patent application No. 63/643,228 filed May 6, 2024, all entitled "Switch Module for Wellbore Perforating Gun", and all of which are incorporated herein in their entirety for all purposes.

STATEMENT REGARDING FEDERALLY SPONSORED RESEARCH OR DEVELOPMENT

Not applicable.

BACKGROUND

In a project for drilling a hydrocarbon-producing well and bringing the well online and into production, the process of perforating the wellbore and fracking those perforations is a multi-day effort requiring a lot of equipment and personnel. As such, an efficient but effective perfing and fracking operation is a considerable concern for the investors and operators of such new wells. The total number of perforations needed to be created and fracked is an important and financially weighty decision recognizing that too few perforations may limit the productivity of the well while too many perforations adds significant costs. In long horizontal wells, it is impractical to puncture all of the perforations in one quick process and then frack all of the perforations in a single following step. Perfing and fracking is done in bite size segments limited mostly by the number of guns that will fit in a single toolstring. Toolstrings are generally limited by the length of the wireline lubricator brought to the site and that tends to be between 40 and 60 feet.

The casing is perforated very far down hole such that getting a toolstring from the surface to the operative position within the casing commonly takes a couple of hours. A round trip is typically at least three hours and, if all goes smoothly, takes up to about five or six hours. Considering the costs at the wellsite on a per hour basis, it is very important that the guns fire when signaled. Unfortunately, while most current gun designs provide better than 99% reliability, anything less than 100% is disappointing and expensive.

Failures to detonate seem to most commonly occur in the electric system. The same electric system through the wireline serves as both the electronic signaling and the electric power to drive the detonator to detonate, so it needs to be designed to avoid multiple types of failure. On the electronic side, the communications must be perfectly continuous. Any momentary loss of continuous electric signal causes a reset on digital switches and requires a reprogramming process where all of the switches are provided their individual mission protocol. The overall mission protocol is for each switch to individually open an electric path to its individual and respective detonator to activate in sequence from bottom to top and as signaled. When a reset occurs, the switches need to be reprogrammed to know where each is in the firing order so that only the designated detonator is detonated and that designated detonator is actually detonated when signaled. Essentially, a brief loss of signal continuity causes the switches to forget where they are in the order. As long as the brief loss of continuity is not associated with a larger problem and is discovered at a time when the guns are not intended to be fired such as near the top of the hole when being pumped down, reprogramming is not a significant cause for concern. But it is certainly disconcerting and preferably avoided. Such brief discontinuities can be caused or associated with the banging of the toolstring progressing down hole at casing joints or the impulse forces when the plug is set or other guns are fired where a spring connector is compressed and slackened quickly and briefly lifts off its terminal. Wire connections tend to be slightly more fragile at their junctions then is desirable.

Turning to failures for the electric conduction system, there is a risk of failing when higher voltage power is delivered for detonation of a gun if any kind of conductive dust or debris gets loosened after the guns string is assembled at the surface. This debris seems to work its way into gaps between the positive and negative sides of the circuit when the two sides are in some proximity to one another. With conductive dust not necessarily connecting the two sides, but reducing the effective spacing between the positive and negative, a shortened arc path is created for an electric short to occur. This short deprives the detonator of the power needed to detonate.

Again, the root cause seems to be shots from other guns, blasts from plug setting tools and the rattling, bumping, vibration endured while being conducted miles down the casing. And, it is unlikely that harsh impulses and G-forces can be much mitigated. What is apparently needed are more robust electric systems that improve reliability of guns in a perforating string.

SUMMARY OF THE DISCLOSURE

An embodiment of a perforating gun system deployable in a wellbore extending through a subterranean earthen formation comprises a tandem sub comprising a sub housing and a signal pod receivable in the sub housing, wherein the signal pod comprises a detonator and a receptacle; and a perforating gun comprising a charge carrier configured to receive one or more shaped charges, the charge carrier comprising a detonator cord housing configured to receive a terminal end of a detonator cord, and wherein the detonator cord housing is receivable in the receptacle of the signal pod to ballistically couple the detonator cord with the detonator. In some embodiments, having a longitudinal axis extending lengthwise along the cross sectional centers of the tandem sub and the perforating gun where the longitudinal axis is generally linear but may curve when the perforating gun system is subjected to bending force such as within a tortuous borehole, and further wherein the terminal end of the detonator cord, the detonator cord housing, and the receptacle are each aligned with their cross sectional center along longitudinal axis and extending coaxially therewith. In some embodiments, the detonator cord housing is tubular defining an internal passage in which the terminal end of the detonator cord is receivable. In some embodiments, the receptacle permits relative rotation between the receptacle and the detonator cord housing when the detonator cord housing is received in the receptacle. In some embodiments, the perforating gun comprises a cord endcap connectable to the terminal end of the detonator cord when the terminal end is received in the detonator cord housing whereby interference between an outer diameter of the cord endcap and an inner diameter of the detonator cord housing, the outer diameter being equal to or greater than the inner diameter, restricts the terminal end of the detonator cord from releasing from the detonator cord housing. In some embodiments, a ratio of an inner diameter to a wall thickness of the detonator cord housing is between 4:1 and 25:1.

An embodiment of a perforating gun deployable in a wellbore extending through a subterranean earthen formation comprises an outer gun housing extending between opposing longitudinal ends and defining an internal passage extending between the longitudinal ends of the gun housing; a charge carrier receivable in the internal passage of the gun housing, the charge carrier comprising a carrier chassis configured to at least partially receive one or more shaped charges, and a detonator cord housing configured to receive a terminal end of a detonator cord, and wherein the detonator cord housing is coupled to the carrier chassis and at least partially projects externally from the carrier chassis of the charge carrier. In some embodiments, the perforating gun comprises an assembled state in which the charge carrier is received in the internal passage of the gun housing such that the detonator cord housing does not project beyond either of the longitudinal ends of the gun housing. In some embodiments, a longitudinal length of the gun housing is greater than a longitudinal length of the charge carrier including the detonator cord housing at least partially projecting from the carrier chassis of the charge carrier. In some embodiments, the carrier chassis extends between a pair of opposing longitudinal ends and wherein the detonator cord housing projects outwardly from one of the longitudinal ends of the carrier chassis. In some embodiments, the detonator cord housing projects longitudinally from one of the longitudinal ends of the carrier chassis to define a longitudinal end of the charge carrier. In some embodiments, the detonator cord housing is pivotably coupled to the carrier chassis. In some embodiments, the detonator cord housing is permitted to rotate relative to the carrier chassis. In some embodiments, the detonator cord housing is flexibly coupled to the carrier chassis to pivot and to displace radially relative to the longitudinal axis.

An embodiment of a tandem sub deployable in a wellbore extending through a subterranean earthen formation comprises an outer sub housing defining an internal passage; a signal pod receivable in the internal passage of the sub housing, the signal pod comprising a pod chassis configured to receive a detonator, and receive an electroballistic connector into the pod chassis so as to electrically connect the signal pod with a corresponding perforating gun and to also place the detonator cord into ballistic communication with the detonator when electroballistic connector is received into the pod chassis.

An embodiment of a perforating gun system deployable in a wellbore extending through a subterranean earthen formation comprises a tandem sub comprising a sub housing and a signal pod receivable in the sub housing, wherein the signal pod comprises a chassis defining an internal ballistic cavity wherein the internal ballistic cavity includes a detonator receptacle and a detonator cord receptacle, where the detonator receptacle is arranged to receive a detonator in a predefined detonator position, and the detonator cord receptacle is arranged to receive a terminal end of a detonator cord and position the terminal end in a predefined cord position within the chassis in ballistic communication with the detonator; a perforating gun comprising a charge carrier configured to receive one or more shaped charges, the charge carrier comprising a detonator cord housing configured to receive the terminal end of the detonator cord where the detonator cord housing adds rigidity to the terminal end of the detonator cord for insertion into the detonator cord receptacle. In some embodiments, the detonator cord comprises a disassembled state in which the terminal end of the detonator cord is not received in the detonator cord housing and in which the terminal end of the detonator cord has a first mechanical strength; and the detonator cord comprises an assembled state in which the terminal end of the detonator cord is received in the detonator cord housing to provide the terminal end of the detonator cord with a second mechanical strength that is greater than the first mechanical strength. In some embodiments, the first mechanical strength of the detonator cord is less than a mechanical strength of the detonator cord housing. In some embodiments, the detonator cord housing comprises one or more ports spaced along the detonator cord housing to increase a flow area of the detonator cord housing for the passage of ballistic energy from the detonator upon detonation.

An embodiment of a method for deploying a plurality of perforating gun systems from a remote location into a wellbore located at a wellsite comprises (a) transporting each of the plurality of perforating gun system from the remote location to the wellsite in a transport state in which one or more shaped charges of the perforating gun system are ballistically coupled to a detonator cord of the perforating gun system but ballistically decoupled from a detonator of each of the plurality of perforating gun systems; and (b) transitioning, after the plurality of perforating gun systems arrives at the wellsite, a first perforating gun system of the plurality of perforating gun systems from the transport state to a deployment state for deployment into the wellbore by ballistically coupling the detonator cord of the first perforating gun system with the detonator of a second perforating gun system of the plurality of perforating gun systems. In some embodiments, (b) comprises transitioning the first perforating gun system from the transport state to the deployment state in response to mechanically rotatably coupling the first perforating gun system with the second perforating gun system. In some embodiments, (b) comprises transitioning the first perforating gun system from the transport state to the deployment state automatically in response to inserting the detonator cord housing into a corresponding receptacle of the second perforating gun system.

An embodiment of a perforating gun system deployable in a wellbore extending through a subterranean earthen formation comprises one or more shaped charges; a detonator cord ballistically coupled to the one or more shaped charges when the perforating gun system in both a transport state and a deployment state; and a detonator ballistically coupled to the detonator cord when the perforating gun system is in the deployment state but ballistically decoupled when the perforating gun system is in the transport state; wherein the perforating gun system is transitionable at a wellsite from the transport state to the deployment state.

An embodiment of a signal pod for a perforating gun system deployable in a wellbore extending through a subterranean earthen formation comprise a chassis having a longitudinal axis; a printed circuit board attached to the chassis; a receptacle at a longitudinal first end of the chassis; a first electrical connector positioned within the receptacle and electrically connected to the printed circuit board; a second electrical connector positioned at a longitudinal second end of the signal pod opposite the first end and wherein the second electrical connector is electrically connected to the printed circuit board; a ground electrical contact extending from the printed circuit board and electrically connected thereto; and a detonator electrically connected to the printed circuit board and positioned between a longitudinal midline of the chassis and the first end of the chassis. In some embodiments, the chassis defines an external opening and the signal pod further comprises a cover connectable to the chassis to enclose the external opening while permitting fluid communication across an interface formed between the cover and the external opening. In some embodiments, the first electrical connector comprises an electrical spring contact oriented to flex radially into and away from a longitudinal axis of the receptacle. In some embodiments, the second electrical connector comprises an electrical spring contact oriented to flex radially into and away from the through axis in a generally radial direction relative to the through axis. In some embodiments, the ground electrical connector includes a spring contact oriented to flex into and away from the longitudinal axis of the chassis. In some embodiments, the receptacle has a receptacle axis and the signal in electrical connector includes a spring contact oriented to flex into and away from the receptacle axis in a generally radial direction relative to the receptacle axis and the through electrical connector has a through axis and the through electrical connector includes a spring contact oriented to flex into and away from the through axis in a generally radial direction relative to the through axis and the ground electrical connector includes a spring contact oriented to flex into and away from the longitudinal axis of the chassis. In some embodiments, the receptacle axis and the through axis are generally aligned with the longitudinal axis of the chassis. Where the detonator is arranged parallel to the axis of the chassis. Where the signal pod includes a reflector over the detonator to reflect explosive energy back toward the longitudinal axis. Where the detonator has a top end and a bottom end such that explosive energy from the detonator is higher at the bottom end as compared to the top end and the detonator is arranged at an angle to the axis such that the bottom end is turned toward the longitudinal axis. Where the angle is less than 45, 30, 25, 20, 15 degrees and more than 2, 3, 4, 5 degrees. Where the signal pod includes a reflector over the angled detonator to reflect explosive energy back toward the longitudinal axis of the chassis. In some embodiments, each of the first electrical connector, second electrical connector, and the ground electrical contact comprise electrical spring contacts oriented to flex transverse to a longitudinal axis of the signal pod.

An embodiment of a tandem sub system for perforating guns comprises a tandem sub including a signal pod cavity, a throughbore and a cavity for a pressure bulkhead; a signal pod comprising a chassis having a longitudinal axis; a printed circuit board attached to the chassis; a receptacle at a longitudinal first end of the chassis; a first electrical connector positioned within the receptacle and electrically connected to the printed circuit board; a second electrical connector positioned at a longitudinal second end of the signal pod opposite the first end and wherein the second electrical connector is electrically connected to the printed circuit board; a ground electrical contact extending from the printed circuit board and electrically connected thereto; and a detonator electrically connected to the printed circuit board and positioned between a longitudinal midline of the chassis and the first end of the chassis; and a pressure bulkhead connected to the second electrical connector where the pressure bulkhead includes conductive core and an insulating body where the conductive core is connectable to a next tool in the system. In some embodiments, the second electrical connector is arranged to connect to the pressure bulkhead such that at least one of the second electrical connector and the pressure bulkhead includes a spring contact portion that move into and away from the longitudinal axis as engagement of the second electrical connector is made with the pressure bulkhead. In some embodiments, the second electrical connector engages with the pressure bulkhead within the throughbore between the signal pod cavity and the cavity for the bulkhead. In some embodiments, the pressure bulkhead includes a conductive axial post for connecting to a further perforating gun wherein the contact portion of the axial post is on the outer periphery such that engagement with the further perforating gun is radially oriented relative to the longitudinal axis. In some embodiments, the pressure bulkhead includes an insulating skirt spaced from but overlying the conductive axial post to restrict conductive particles inside the gun from gathering near the axial post to reduce the potential of the formation of a short circuit from the axial post to an electrical ground such as the tandem sub. In some embodiments, each of the first electrical connector, second electrical connector, and the ground electrical contact comprise electrical spring contacts oriented to flex transverse to the longitudinal axis of the chassis. In some embodiments, the chassis defines an external opening and the signal pod further comprises a cover connectable to the chassis to enclose the external opening while permitting fluid communication across an interface formed between the cover and the external opening. In some embodiments, the first electrical connector comprises an electrical spring contact oriented to flex radially into and away from a longitudinal axis of the receptacle. In some embodiments, the second electrical connector comprises an electrical spring contact oriented to flex radially into and away from the through axis in a generally radial direction relative to the through axis. In some embodiments, the receptacle has a receptacle axis and the signal in electrical connector includes a spring contact oriented to flex into and away from the receptacle axis in a generally radial direction relative to the receptacle axis and the through electrical connector has a through axis and the through electrical connector includes a spring contact oriented to flex into and away from the through axis in a generally radial direction relative to the through axis and the ground electrical connector includes a spring contact oriented to flex into and away from the longitudinal axis of the chassis. In some embodiments, the receptacle axis and the through axis are generally aligned with the longitudinal axis of the chassis. In some embodiments, the detonator is arranged parallel to the axis of the chassis. In some embodiments, the signal pod includes a reflector over the detonator to reflect explosive energy back toward the longitudinal axis.

An embodiment of a perforating gun system deployable in a wellbore extending through a subterranean earthen formation, the perforating gun system having a longitudinal axis and comprises a first perforating gun comprising a charge carrier configured to receive one or more shaped charges, the charge carrier comprising a detonator cord housing configured to receive a terminal end of a detonator cord and support the detonator cord along the longitudinal axis; a tandem sub comprising a sub housing and a signal pod cavity, a throughbore and a cavity for a pressure bulkhead; a signal pod comprising: a chassis having a longitudinal axis; a printed circuit board attached to the chassis; a receptacle at a longitudinal first end of the chassis; a first electrical connector positioned within the receptacle and electrically connected to the printed circuit board; a second electrical connector positioned at a longitudinal second end of the signal pod opposite the first end and wherein the second electrical connector is electrically connected to the printed circuit board; a ground electrical contact extending from the printed circuit board and electrically connected thereto; and a detonator electrically connected to the printed circuit board and positioned between a longitudinal midline of the chassis and the first end of the chassis; a pressure bulkhead connected to the second electrical connector where the pressure bulkhead includes conductive core and an insulating body where the conductive core with a conductive axial post; and a second perforating gun also configured to receive one or more shaped charges, and including a top plate connector oriented toward the conductive axial post of the pressure bulkhead to enable electric signals received by the signal pod to pass along to the second perforating gun.

An embodiment of a signal pod for a perforating gun system deployable in a wellbore extending through a subterranean earthen formation comprises a chassis having a longitudinal axis; a printed circuit board attached to the chassis wherein circuits on the printed circuit board are designed to selectively provide power through two connectors; a receptacle at a longitudinal first end of the chassis; a first electrical connector positioned within the receptacle and electrically connected to the printed circuit board; a second electrical connector positioned at a longitudinal second end of the signal pod opposite the first end and wherein the second electrical connector is electrically connected to the printed circuit board and connectable to an ignitor for a plug setting tool; a ground electrical contact extending from the printed circuit board and electrically connected thereto; and a detonator electrically connected to the printed circuit board and positioned between a longitudinal midline of the chassis and the first end of the chassis; wherein, the circuits on the printed circuit board selectively provides power to the ignitor for a plug setting tool and separately the circuits on the printed circuit board selectively provides power to a detonator for a perforating gun. In some embodiments, a perforating gun system according to claim J1, further including a special tandem sub arranged to connect to a perforating gun at one end and a plug setting tool at the other with a signal pod cavity in which the signal pod is positionable for operation. In some embodiments, the special tandem sub further includes isolation of the signal pod from any flame from ignitor to thereby preserve electrical communication of the signal pod for for later firing of a perforating gun.

An embodiment of a signal pod for a perforating gun system deployable in a wellbore extending through a subterranean earthen formation comprises a chassis having a longitudinal axis; a switch attached to the chassis; a receptacle at a longitudinal first end of the chassis; a first electrical connector positioned within the receptacle and electrically connected to the switch; a second electrical connector positioned at a longitudinal second end of the signal pod opposite the first end and wherein the second electrical connector is electrically connected to the switch; a ground electrical contact extending from the switch and electrically connected thereto; and a detonator electrically connected to the switch; wherein each of the first electrical connector, second electrical connector, and the ground electrical contact comprise electrical spring contacts oriented to flex transverse to the longitudinal axis of the chassis. In some embodiments, the first and second electrical connectors and the ground electrical contact are directly connected to the switch without wire connections.

BRIEF DESCRIPTION OF THE DRAWINGS

A more complete understanding of the present invention may be obtained from the following detailed description with reference to the attached drawing figures as summarized below, in which:

FIG. 21 is a perspective exploded perspective view of the charge carrier in FIG. 20 illustrating some of the key components where endplate B is sandwiched between endplate A and the charge carrier such that;

FIG. 24 is a perspective view of a gun carrier showing individual scalloped ring cuts on the periphery to reduce the thickness both axially aligned and rotationally aligned over the shaped charges and where the key on the endplate B needs to be secured to endplate A for proper alignment with a keyway inside the gun carrier;

FIG. 25 is an exploded elevational cross section view of the perf gun, showing how the signal pod aligns with the detonator cord housing and with the tandem sub;

DETAILED DESCRIPTION

Figure 1:
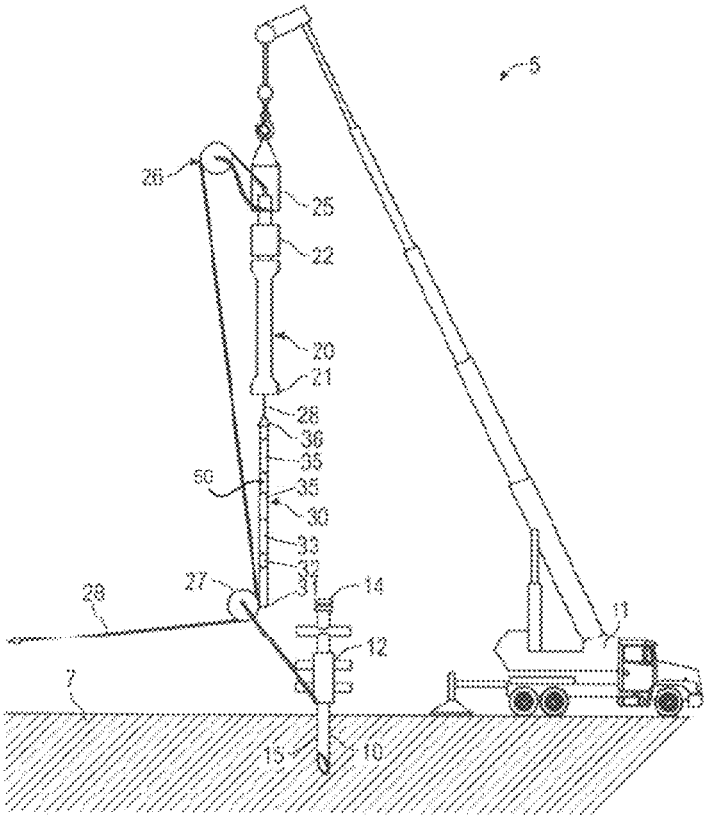
FIG. 1 is an elevation view of a wellsite with a crane lifting a wireline lubricator with a toolstring suspended below about to be pulled into the wireline lubricator so that that after the lubricator is re-attached to the wellhead, the toolstring may be inserted into a wellbore.

The following discussion is directed to various exemplary embodiments of the present disclosure. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a wireline system 5 is shown for deploying a "plug and perf" toolstring 30 into a wellbore 10 in which casing 15 (commonly called a casing string) is installed. The view shown in FIG. 1 is near the surface 7 with the wellbore 10 extending far into the earth and into an extended generally horizontal run within a prospective hydrocarbon bearing formation 3 (see FIG. 3) deep in the ground. A crane 11 is positioned adjacent the cased wellbore 10 for lifting a wireline lubricator 20 off the top of the valve tree 12 in preparation for lifting a toolstring 30 up inside the wireline lubricator 20. Wireline 28 of the wireline system 5 is fed through a wireline sealing element 22 and down through the wireline lubricator 20 to pull the toolstring 30 up into the wireline lubricator 20 whereupon the wireline lubricator 20 is then attached onto the top of a valve tree 12. A bottom coupling 21 sealingly connects the lubricator 20 to a coupling 14 at the top of the valve tree 12.

In the configuration shown in FIG. 1, the wellbore 10 is sealed by one or more valves of the valve tree 12. As is well known, pressure within cased wellbore 10 must be maintained in a pressure-controlled state at all times so that before any valve is opened, others are closed in a manner that maintains well pressure control. The position of wireline lubricator 20 is controlled by an operator of the crane 11 using a bridle 25 attached to an upper end of the wireline lubricator 20, while the position of toolstring 30 is controlled by an operator of a wireline truck (not shown) via the wireline 28. In FIG. 1, the wireline operator has reeled in the wireline 28 to lift the toolstring 30 off of the surface 7 into a vertical orientation such that an upper end of the toolstring 30 is proximal to the bottom of the wireline sealing element 22 at the bottom end of the wireline lubricator 20. The entire length of toolstring 30 must fit fully into the wireline lubricator 20 to allow the bottom coupling 21 of wireline lubricator 20 to sealingly connect to the coupling 14 of valve tree 12 to maintain well pressure control prior to insertion of the toolstring 30 into the cased wellbore 10 through the valve tree 12.

The toolstring 30 includes a number of tools that are selected by an operator of the cased wellbore 10 and which, in this example, includes a plug 31 at the bottom thereof, an adapter kit 32 and a setting tool 33 where the adapter kit 32 is connected between the plug 31 and setting tool 33. Above the setting tool 33 are a number of perforating or "perf" perforating guns 35 along with other tools that include electronic communication with the setting tool 33 and the perforation perforating guns 35 and other tools of toolstring 30 that provide the wellbore location of the toolstring 30 as well as other known functions. A tandem sub 50 may be coupled between the perforating guns 35 to provide pressure isolation therebetween. At the top of the toolstring 30 is a wireline coupling device 36 that attaches to the wireline 28. The wireline 28 extends from the wireline truck, over a pair of sheaves 26 and 27, and is typically quite long to permit the toolstring 30 to run potentially miles down into the cased wellbore 10. It may be generally understood that wellbores, including cased wellbore 10, extend vertically downwards from the surface 7 and then turns along a broad curve to a more horizontal path or portion that is typically a great length (e.g., a mile or more) horizontally through a probable hydrocarbon bearing zone.

Figure 2:
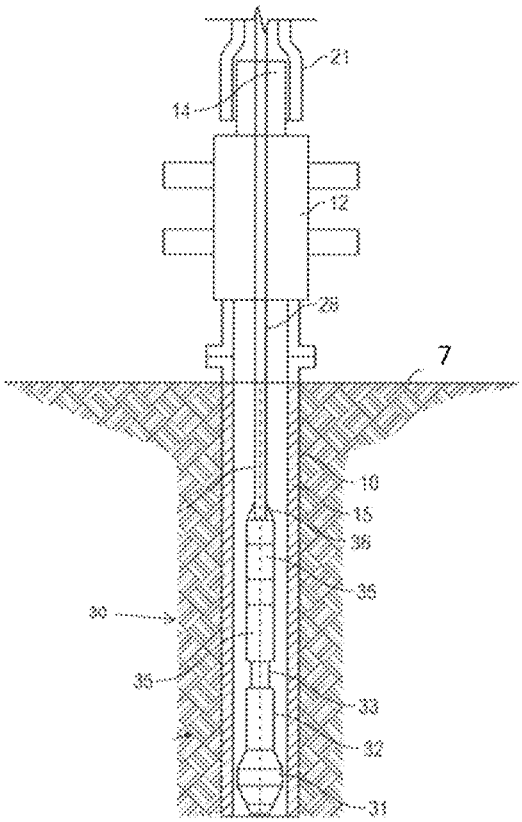
FIG. 2 is a schematic view of an exemplary system for perforating a hydrocarbon-producing wellbore including a toolstring deployed by a wireline system.

Turning to FIG. 2, the toolstring 30 is shown within the well 10 below and past the valves in the valve tree 12 such that the toolstring 30 is on its decent within a first vertical section where the well is sealed from outside environment by the wireline sealing element 22 at the top of the wireline lubricator 20 (both shown only in FIG. 2). The toolstring 30 is lowered into the vertical section and typically pumped down to a generally horizontal section shown in FIG. 3 where the wellbore 10 extends a significant distance along and within a prospective hydrocarbon bearing formation 3.

Figure 3:
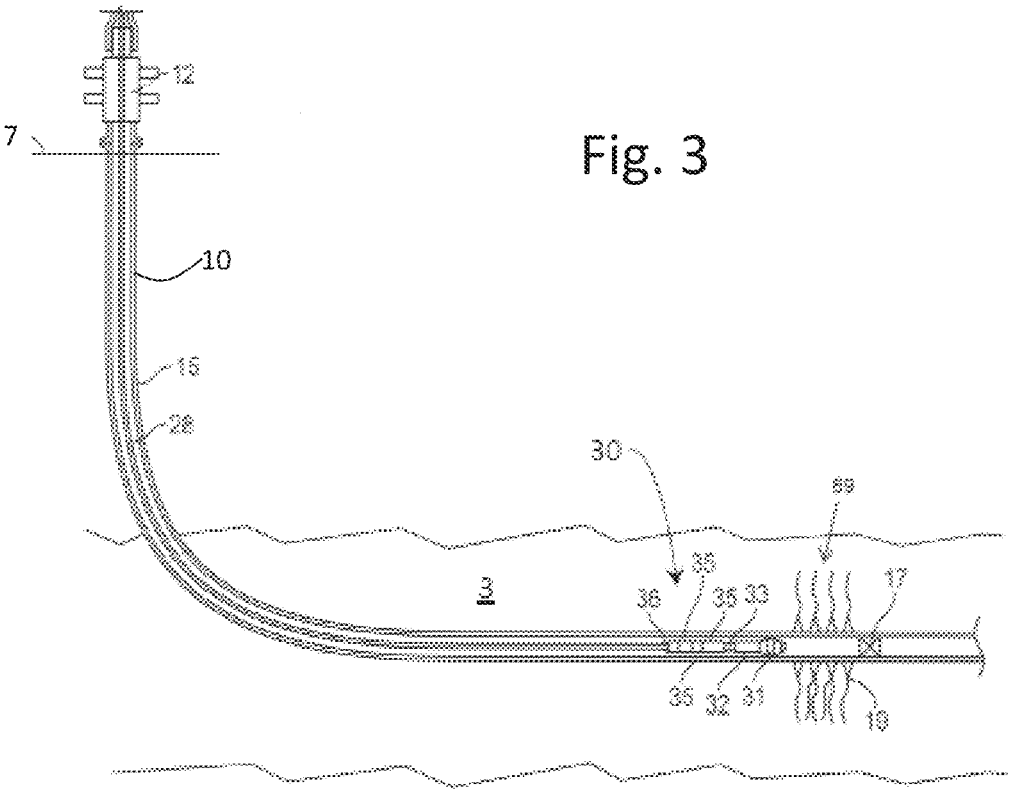
FIG. 3 is a schematic elevation view of the well with the plug and perf toolstring in the extended horizontal segment.

In FIG. 3, a prior perfing and fracking operation has been conducted including the setting of a prior plug 17 and puncturing of prior perforations 69 that have been fracked by high pressure hydraulic fluid to enlarge the perforations. So, just above the existing perforations 69, the plug 31 at the end of the plug and perf toolstring is set or deployed to seal against the inside of the casing to isolate the upper portion of the wellbore 10 from a lower portion below the plug 31. The plug 31, once set, prevents fluid that will be pumped down from the surface 7 and is intended to frack newly created perforations from escaping into the existing perforations 69 and preventing the needed build in fluid pressure. It takes significant hydraulic pressure to enlarge and extend new perforations so any plug and perf operation begins with plugging off the lower existing perforations such as those shown at 69, separating the set plug from the remainder of the plug and perf toolstring so that new perforations may be created in the casing 15 above the set plug 31. Once the plug 31 is disengaged from the toolstring 30, the plug and perf toolstring lays on the bottom of the horizontal run of the casing 15 and is pulled upwardly toward the surface while each of a number of perforating guns 35 are detonated at predetermined positions to shoot or discharge shaped explosive charges 125 (see FIGS. 6 and 7) which puncture the casing 15 thereby creating a perforation.

Figure 4:
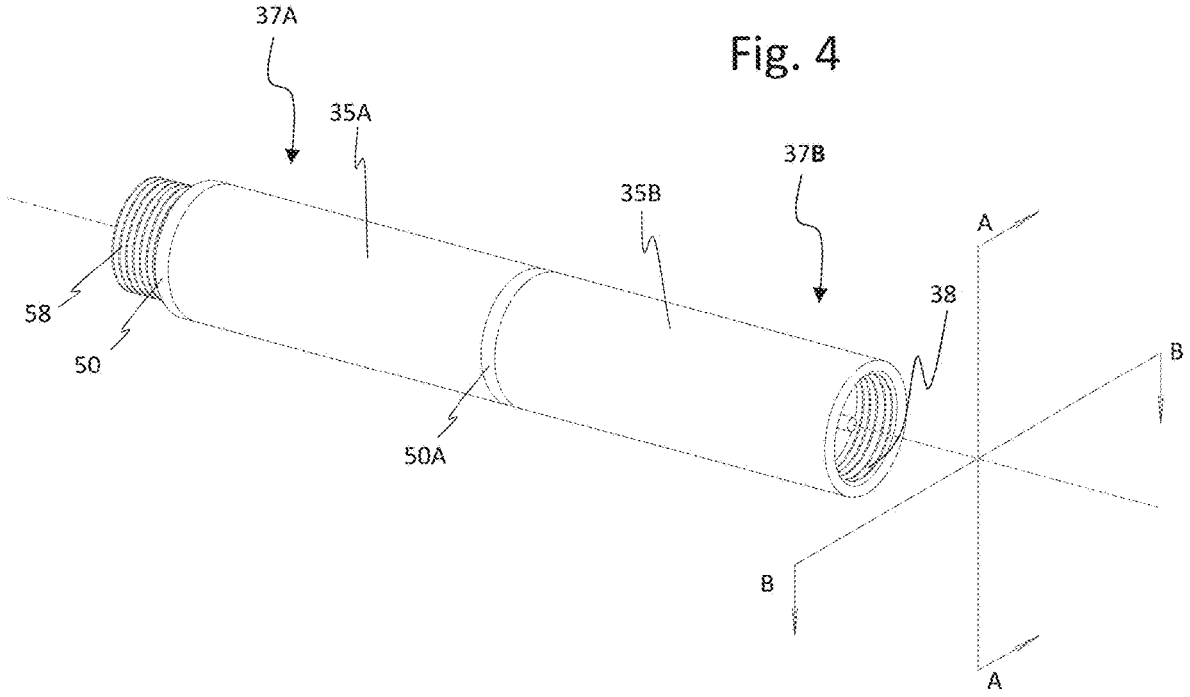
FIG. 4 is perspective view of two perforating guns connected end to end.

The focus of the present disclosure relates to systems for physically and electrically connecting perforating guns together in a toolstring or gunstring although it may be used in other toolstring connections. Turning to FIG. 4, two perforating guns 35A and 35B are shown as connected both physically and electrically. Specifically, an uphole perforating gun 35A is connected to a downhole perforating gun 35B where the two guns are essentially identical but for their order in a toolstring 30. It should be understood that adjacent guns need not be identical in that some adjacent guns may have more or less shots than other guns in the toolstring 30 or those shots may be directed into the casing 15 at differing directions, as desired. For the purposes of this embodiment and disclosure, uphole and downhole guns have a common design and construction and the components of the guns will be described with the same referenced numerals.

The perforating guns 35A and 35B are part of a toolstring 30 and each correspond to a different perforating gun system 37A and 37B of the toolstring 30. The term "perforating gun system" as used herein is defined as a system including a charge carrier comprising one or more shaped charges and a detonating cord configured to ballistically couple each of the shaped charges together, and a signal pod comprising a detonator to be ballistically coupled to the detonating cord and an electrical switch for detonating or otherwise activating the detonator to thereby detonate or otherwise activate the shaped charges of the perforating gun system. The charge carrier and signal pod of a given perforating gun system may be packaged in various ways. For example, the charge carrier may be packaged in an outer gun housing as part of a perforating gun while the signal pod may be packaged or received in a sub housing of a separate tandem sub. In other embodiments, the signal pod may instead be directly incorporated with the charge carrier such as, for example, by forming a common perforating gun with the signal pod located internal or external the charge carrier.

Additionally, embodiments of perforating gun systems described herein include a transport state and a separate deployment state where the perforating gun system is transitionable from the transport state to the deployment state. The transport state of the perforating gun system is configured to permit the perforating gun system to be conveniently and safely transported from a remote site to a wellsite containing a wellbore penetrating a subterranean earthen formation. Conversely, the deployment state of the perforating gun system is configured to place the perforating gun system in condition for deployment into the wellbore whereby the one or more shaped charges of the perforating gun system may be detonated by providing the electrical switch of the perforating gun system with an appropriate firing or detonation signal.

In this exemplary embodiment, uphole perforating gun 35A of uphole perforating gun system 37A is shown coupled to a separate tandem sub 50 (e.g., corresponding to an additional perforating gun system separate from systems 37A and 37B) and a tandem sub 50A also corresponding to the first perforating gun system 37A. Additionally, tandem sub 50A is shown coupled to perforating gun 35B which corresponds to a separate perforating gun system 37B comprising a separate tandem sub 50B not shown in FIG. 4.

In this exemplary embodiment, the uphole perforating gun 35A is connected at its top end by tandem sub 50 revealing a free pin thread end extending to the left in the uphole direction. A second tandem sub 50A connects the two perforating guns 35A and 35B together by screw threads. In this embodiment, the tandem subs 50 and 50A have double ended pin threads 58 that secure to box threads 38 at the ends of each perforating gun 35.

Figure 5:
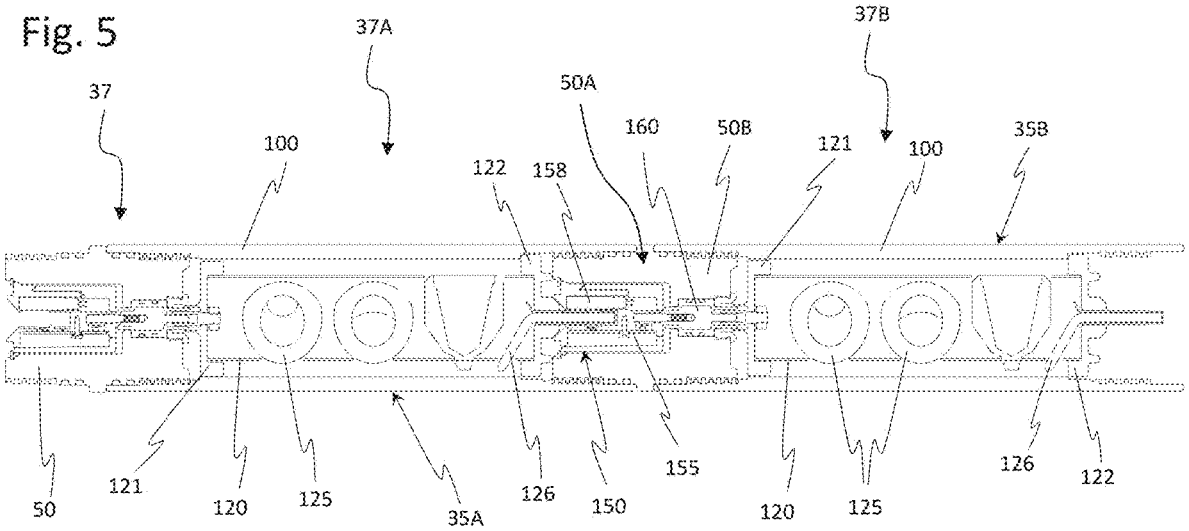
FIG. 5 is a cross sectional side view of two perforating guns connected end to end as seen at the cut line indicated by the letters A-A in FIG. 4 presenting a preferred embodiment of the present invention revealing a pressure bulkhead and a signal pod within a tandem sub.
Figure 6:
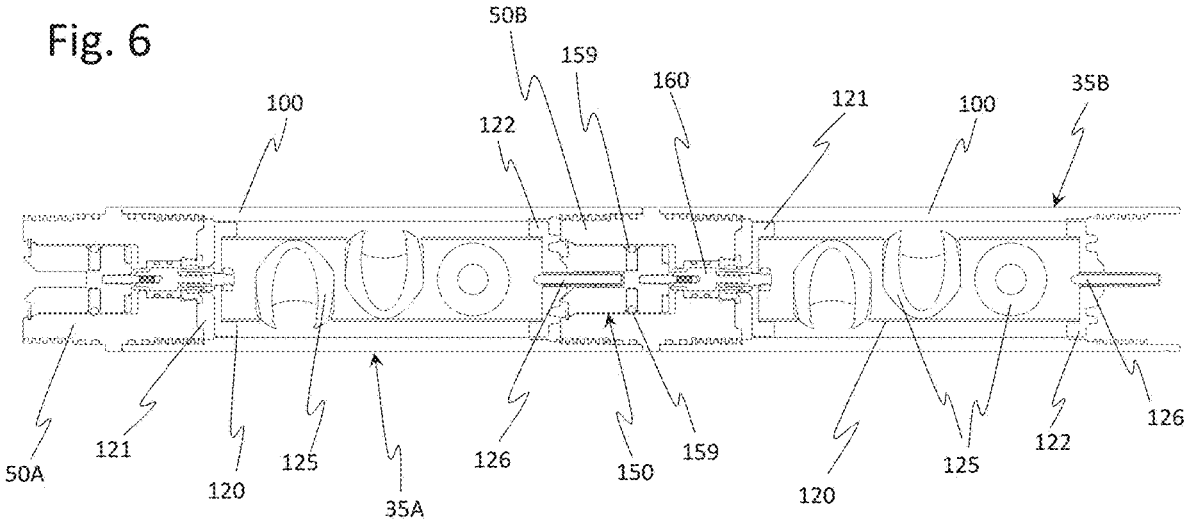
FIG. 6 is a cross sectional top view of the two perforating guns connected end to end as seen at the cut line indicated by the letters B-B in FIG. 4 presenting a preferred embodiment of the present invention revealing a pressure bulkhead and a signal pod within a tandem sub.
Figure 7:
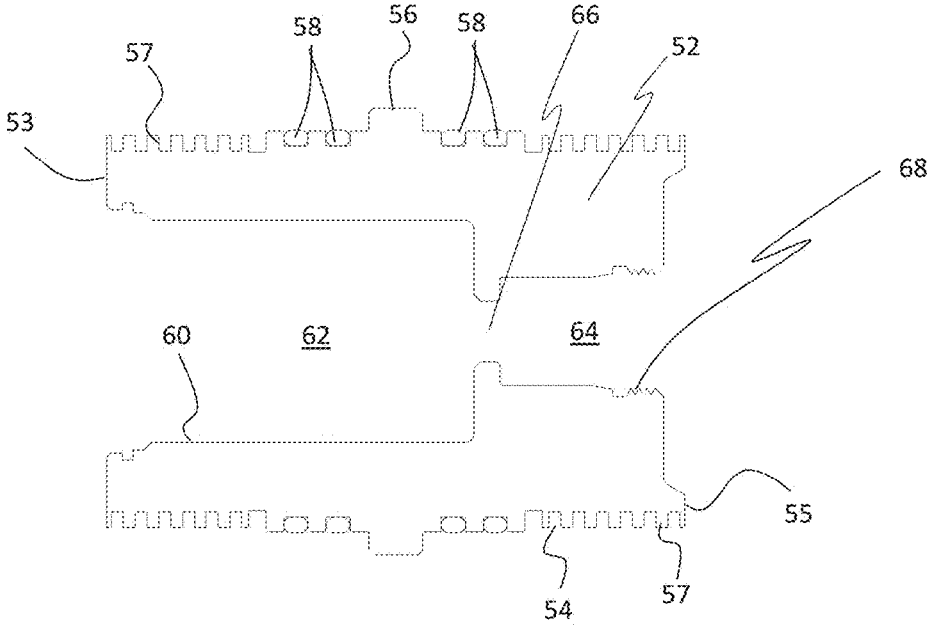
FIG. 7 is a cross section view of a bare tandem sub.

Turning to FIGS. 5-7, the perforating guns 35A and 35B each comprise an outer sleeve or gun housing 100 which can be seen as a strong, electrically conductive tube typically made of steel. Each such gun housing includes a large bore extending end to end with internal machining on the inside surface to provide box threads 38 and a machined sealing surface for O-rings to seal against when the gun string 30 is fully assembled enclosing an internal air space within the gun housing 100. In some embodiments, machining is done on the outside surface to prepare a discharged gun to be more easily pulled back to the surface.

Within the bore of the gun housing 100 is a charge carrier 110 comprising a carrier chassis 120, an uphole endplate 121 coupled to an uphole end of carrier chassis 120, and a downhole endplate 122 on opposite ends thereof and coupled to a downhole end of carrier chassis 120. In this exemplary embodiment, carrier chassis 120 is also a metal tube like the gun housing 100 but with a much thinner wall thickness and will cuts, openings and windows to accommodate various subcomponents as will described or as is currently known. Additionally, charge carrier 120 includes one or more shaped charges 125 and detonator cord 126 ballistically coupled to shaped charges 125. As shown, perforating guns 35A and 35B have three shaped charges 125 and while the detonator cord 126 is only shown at the downhole endplate 122 and extending part way into the carrier chassis 120, it is typically laced around the outside to transfer a ballistic impulse into the base of and detonating the shaped charges 125. Additionally, in this exemplary embodiment, detonator cord 126 is flexible whereby the detonator cord 126 may be elastically deformed as part of "wiring" or otherwise manually ballistically coupling detonator cord 126 with shaped charges 125.

As noted above, the gun housings 100 are connected by screw threads to tandem subs 50 at each end where each tandem sub 50 comprises an outer sub housing 52, a signal pod 150, and a pressure bulkhead 160 both receivable in or otherwise physically supported by the sub housing 52. In this exemplary embodiment, signal pod 150 comprises an electrically conductive pin or passthrough 153 that electrically connects signal pod 150 with pressure bulkhead 160. The signal pod 150 of tandem sub 50 controls the operation (e.g., firing or activation) of a corresponding perforating gun 35A/35B. Particularly, in this exemplary embodiment, signal pod 150 comprises an electrical switch 155 in signal communication with an operator of wireline system 5 at the surface 7 enabling both communication with tools of toolstring 30 located downhole from signal pod 150 and control over the operation of the perforating gun 35A/35B located uphole of signal pod 150. The pressure bulkhead 160 of tandem sub 50 is configured to seal against the sub housing 52 of tandem sub 50 to internally seal the sub housing 52 to thereby seal the pair of perforating guns 35A/35B from the other. As noted above, in this exemplary embodiment, each perforating gun 35A/35B has an air space when fully assembled into the toolstring 30 and this airspace includes the signal pod 150 at the downhole end thereof such that each perforating gun 35A/35B is a bottom fired gun. The signal pod 150, in this exemplary embodiment, particularly includes a detonator 158 adjacent the detonator cord 126 to be in ballistic communication when the "fire" is given by the operator at the surface. Further, FIG. 6 is similar to FIG. 5 but image is turned such that the detonator 158 and the switch 155 are not seen, but ground contacts 159 are seen extending from each side the signal pod 150 into contact with the metal tandem sub 50.

As shown particularly in FIG. 7 (where sub housing 52 is shown without the signal pod 150 and pressure bulkhead 160 received therein to more clearly reveal the configuration of housing 52), the sub housing 52 of each tandem sub 50 is configured to provide a sealed, mechanical connection between adjoining perforating guns (e.g., perforating guns 35A and 35B) and has a first or uphole end 53 and a second or downhole end 55 longitudinally opposed to uphole end 53. In some embodiments, sub housing 52 is constructed of a substantial and relatively heavy steel body. In this exemplary embodiment, sub housing 52 has a circular cross section along most, if not all, of its length with at least two interior chambers connected as will be described below. In addition, sub housing 52 comprises a radially outer surface 54 defining an outer periphery of sub housing 52 and extending longitudinally between ends 53 and 55. A rotary (e.g., a threaded) connector 57 is positioned or formed along the outer surface 54 at ends 53 and 55 for rotatably (e.g., threadably) coupling with corresponding rotary connectors of the gun housings 100 of perforating guns 35A and 35B. In this exemplary embodiment, rotary connectors 57 each comprise pin connectors. Alternatively, one or both of rotary connectors 57 may comprise box connectors in other embodiments.

In this exemplary embodiment, an annular tool collar 56 is formed or positioned along the outer surface 54 to provide an interface which a tool may be mechanically coupled to apply a rotational torque to the sub housing 52. In this manner, a tool may be coupled to sub housing 52 via tool collar 56 to tighten screw threads into either perforating gun 35A or 35B. Additionally, in this exemplary embodiment, an annular seal assembly 58 is positioned along the outer surface 54 with one of the seal assemblies 58 positioned longitudinally between tool collar 56 and each end 53 and 55 of sub housing 52. Seal assemblies 58 are configured to seal the mechanical connection or interface formed between sub housing 52 and the gun housings 100 of perforating guns 35A and 35B. In this exemplary embodiment, each seal assembly 58 comprises a pair of annular elastomeric seals (e.g., O-ring seals); however, the configuration of seal assemblies 58 may vary in other embodiment.

Sub housing 52 also comprises a central bore or passage defined by an inner surface (e.g., a generally cylindrical inner surface) 60 extending longitudinally between ends 53 and 55. In this exemplary embodiment, the central passage of sub housing 52 defines both a signal pod cavity or receptacle 62 and a pressure bulkhead cavity or receptacle 64 that is separate from the signal pod cavity 62. In this exemplary embodiment, signal pod cavity 62 comprises a relatively large void space at the left end of the sub housing 52 for receiving the signal pod 150. As shown, it may comprise more than 50 percent of the length of the tandem sub but it should be understood that in other embodiments, it may comprise 50 percent of the length or even less. On the right is a pressure bulkhead cavity 64 which is smaller than the signal pod cavity both in terms of length and diameter. Keeping this diameter small is generally preferred to reduce the cross section over which the pressure bulkhead 160 has to carry pressure and an impulse. Between the signal cavity 62 and the pressure bulkhead cavity 64 is an internal passage or throughbore 66 connecting the same. Part of the bulkhead cavity 64 near the downhole end 55 of the sub housing 52 is a set of retainer nut threads 68 for securing a retainer nut 170 (see FIGS. 8 and 9) and thereby hold the pressure bulkhead 160 into the bulkhead cavity 64.

Figure 8:
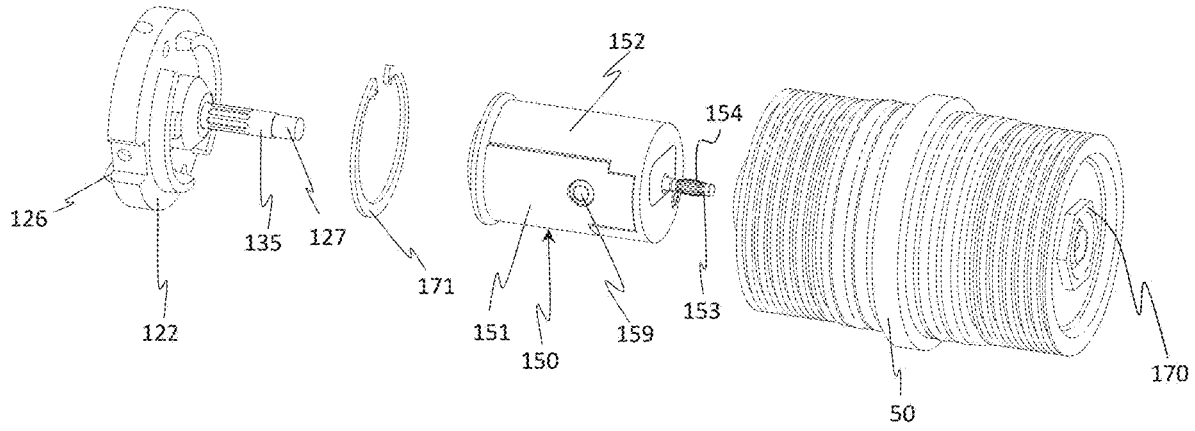
FIG. 8 is an enlarged fragmentary elevation side view as shown in FIG. 5 focused on the tandem sub, the signal pod and the pressure bulkhead for better understanding of the components and how they are connected together.

Turning back to the signal pod 150 and pressure bulkhead 160 in the sub housing 52, focus should now be turned to the exploded image shown in FIG. 8 with the downhole endplate 122 with the detonator cord 126 shown being fed in to the back side thereof. On the side of the downhole endplate 122 in plain view is the downhole gun contact 135. It should be noted that the downhole gun contact 135 in the preferred embodiment is a tube with apertures or windows cut into the peripheral wall exposing detonator cord 126 that has been fed through the inside of the downhole gun contact 135. A cord cap 127 is secured to the end of the detonator cord by adhesive or friction or other securing system to resist movement of the detonator cord slipping backward into the gun and to prevent any content of the detonator cord 126 from spilling out. The downhole gun contact is preferably arranged to be coaxial with the signal pod 150 and the sub housing 52 such that both the detonator cord and the electrical connection are arranged generally along the axis of perforating guns 35 and tandem subs 50. The apertures or windows cut into the peripheral wall of the downhole gun contact permit an inspector to verify that the detonator cord 126 is properly installed and to better insure that when fully assembled into a gun string that the ballistic signal from the detonator 158 is not impeded.

Continuing with the description of FIG. 8, the signal pod 150 is inserted into the pod cavity 50 and held in position by a snap ring 171. With the downhole gun contact 135 with the cord cap 127 leading the way, is inserted into an axial gun contact port 181 (see FIG. 13). In this exemplary embodiment, signal pod 150 comprises a pod chassis 151 having a pod cover 152 closing a switch well 185 (see FIG. 12). Additionally, in this exemplary embodiment, signal pod 150 comprises one or more electrically conductive and radially outwards biased (e.g., mechanically or spring biased) ground springs 159 configured to electrically ground the signal pod to the sub housing 52 of tandem sub 50. One of the ground springs 159 is shown projecting from the periphery of the pod chassis 151 along with the passthrough 153 having the shape of a banana plug for a secure electric connection. Particularly, in this exemplary embodiment, passthrough 153 comprises one or more (e.g., circumferentially spaced) electrical contacts 154 that are biased (e.g., mechanically or spring biased) radially outwards. FIG. 8 also shows the retainer nut installed in the tandem sub holding the pressure bulkhead 160 in place.

Figure 9:
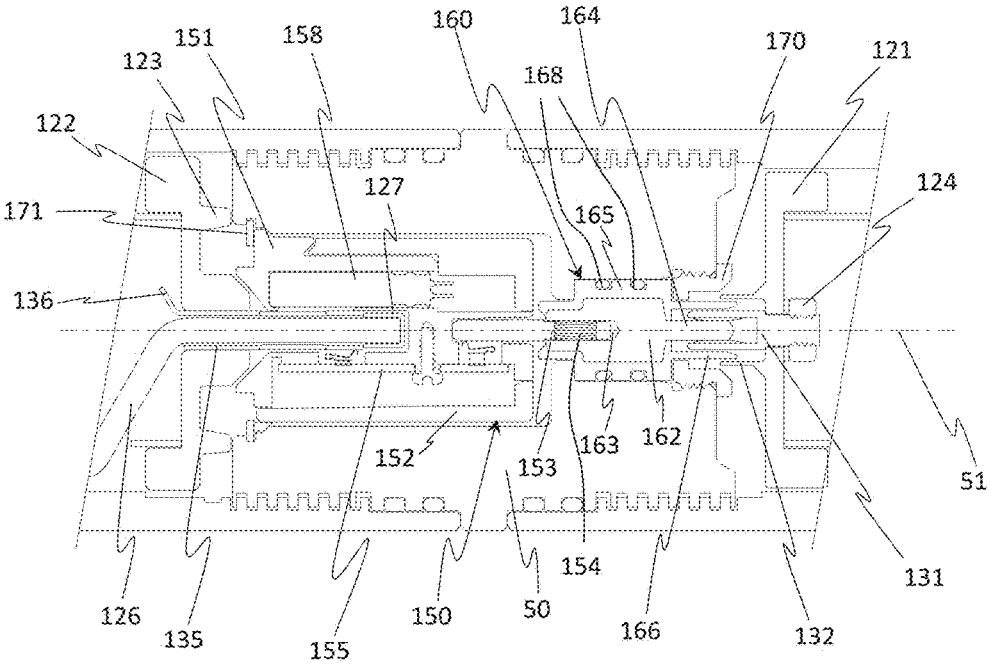
FIG. 9 is an enlarged fragmentary top view as shown in FIG. 6 focused on the tandem sub, the signal pod and the pressure bulkhead for better understanding of the components and how they are connected together.

FIG. 9 is a cross section elevation view enlarged from FIG. 5 where further details of this exemplary embodiment may be seen and explained. In this exemplary embodiment, pressure bulkhead 160 generally includes an electrically conductive bulkhead conductor 162 and an electrically insulating bulkhead insulator 165 covering or surrounding at least a portion (if not the entirety) of the longitudinal length of bulkhead conductor 162. Additionally, in this exemplary embodiment, bulkhead conductor 162 defines a female receptacle or opening 163 at a first longitudinal end of bulkhead conductor 162 and a male pin 164 at an opposing second longitudinal end of the bulkhead conductor 162. Further, in this exemplary embodiment, one or more annular seal assemblies (e.g., elastomeric seals such as O-ring seals) 168 are positioned along a radially outer surface or periphery of the bulkhead insulator 165 to seal the interface formed between pressure bulkhead 160 and sub housing 52.

One aspect of the design of this exemplary embodiment is limiting access of dust and debris within the air spaces of the perforating guns 35 to work their way into contact with the electronics near the tandem sub 50. Looking at the uphole end of the tandem sub 50, the sub housing 52 of tandem sub 50 is grounded along with the gun housing 100 while the positive side of the electric path comes into the signal pod at downhole contact terminal 136 where a through wire (not shown) may be attached by welding, soldering or other secure system of electrical contact. Downhole contact terminal 136 is located remote from any grounding surface to minimize the possibility of dust (such as from rust) forming an arc path between a grounded element and a positively energized element. In some applications, such proximity is of greater concern at the downhole end of the signal pod 150 where the internal radius of the sub housing 52, in this exemplary embodiment, is smallest at the throughbore 66 and relatively close to the passthrough 153.

In addition, this exemplary embodiment includes a large diameter downhole endplate 122 that extends radially out toward the inside surface of the gun housing 100 and further includes a dust collar 123 (see FIGS. 8, 9 and 10) extending (e.g., tightly) against an end face defined by ty the uphole end 53 of the sub housing 52. In this manner, any dust entering from the inside surface of the gun housing (which has not been machined and is vulnerable to rust and scale) may be first blocked or obstructed by the large diameter downhole endplate 122, and subsequently by dust collar 123 positioned against the end face of the tandem sub 50. In some embodiments, dust collar 123 extends at least mostly if not entirely around the circumference of the end face of the tandem sub 50. Further, in this exemplary embodiment, a snap ring 171 is provided for holding the signal pod 150 in the pod cavity 62 forming a small annulus between the outside of the signal pod 150 and inside of the pod cavity 62 to further prevent the intrusion of dust and debris. And finally, the conductive portion of the female receptacle 163 at the uphole end of bulkhead conductor 162 is wrapped by the insulating material of the bulkhead insulator 165 adding extra millimeters of arc resistant distance.

In this exemplary embodiment, at the other end of the pressure bulkhead 160 is a series of insulating shrouds creating a tortuous path for any dust or debris to create an arc path from the bulkhead pin connector 164 to the retainer nut 170. Specifically, the positively energized electric circuit passes from passthrough 153 to the female receptacle 163, through the bulkhead conductor 162 to the bulkhead pin connector 164 and then to an electrically conductive uphole electrical connector 131 of the charge carrier 120 of an adjoining perforating gun 35. Uphole electrical connector 131 of charge carrier 120 comprises a banana socket in this exemplary embodiment including one or more (e.g., circumferentially spaced) electrical contacts 133 that are biased (e.g., mechanically or spring biased) radially inwards into contact with 166 of conductor rod 162. Alternatively, the shape or configuration of uphole electrical connector 131 may vary in other embodiments.

In this exemplary embodiment, uphole electrical connector 131 is secured with a connector nut 124 on the opposite side of the uphole endplate 121 and is connected to a through wire (not shown) by a ring terminal or other known arrangement. A flat ring terminal may be seen pinched between the connector nut 124 and the uphole endplate 121. Back to the subject of the tortuous path, the pressure bulkhead 160 includes a bulkhead shroud 166 that forms an annular space around the bulkhead pin connector 164 in which the banana socket shaped uphole gun connector 131 is inserted. But further, the uphole endplate 121 includes a plate shroud 132 that extends around the bulkhead shroud so that if dust gets past the large diameter uphole endplate 121, it must navigate the tortuous path created by the shrouds. And it must be understood that the effort for resisting any dust intrusion is a time limited effort from the time the toolstring 30 is assembled until the perforating guns 35 are fired which may simply be a matter of hours and one trip down into the wellbore 10, although it is foreseen that guns may be shipped with an uphole tandem sub 50 attached and the potential for such dust could extend back to shipping and transporting such as by forklift and truck. When the tandem subs 50 are attached gun housings 100, the tandem subs 50 are only attached at one end that is at the uphole end of the gun housing 100 such that the detonator 158 is well away from the detonator cord. This is a much safer arrangement for transporting and handling as compared to when the downhole gun contact 135 is inserted into the signal pod putting the detonator 158 in close ballistic communication with the detonator cord 126.

Figure 10:
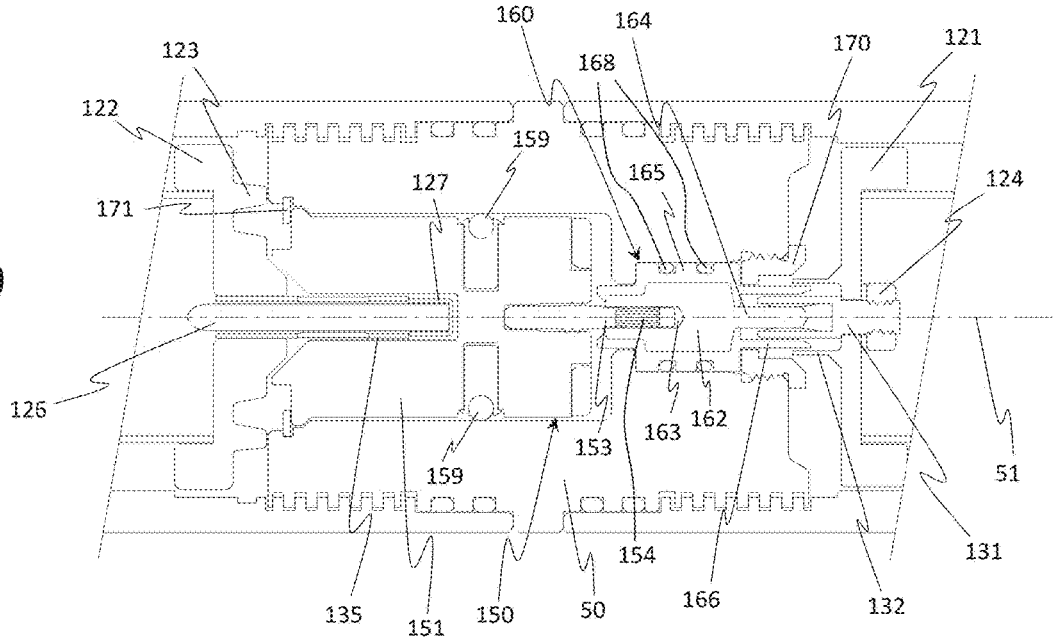
FIG. 10 is an exploded view showing the downhole endplate of the uphole perforating gun, a snap ring, the signal pod and the tandem sub.

Turning to FIG. 10, another cross section is shown that is taken from FIG. 6 and enlarged showing the components of the gunstring 30 around the tandem sub 50. Like FIG. 6, the switch 155 and detonator 158 are not part of this view but the ground contacts 159 are clearly shown. This particular type of ground contact includes a spring-loaded ball that presses against the inside wall or face of the pod cavity 62 (see FIG. 7) to provide some centralizing, some shock absorbing but most importantly: a continuous electrical ground path during all of the roughest and most brutal circumstances anticipated for the perforating guns 35 from assembly to being fired. These spring-loaded ground contacts 159 provide some centralization of the signal pod to be tighter to a longitudinal axis 51 of the tandem sub 50. This provides better alignment when assembling the gun string and specifically for inserting the downhole gun contact into the axial gun contact port 181. It should be noted that the pod cavity 62 includes a slightly enlarged radius near the uphole end thereof where an enlarged radius shoulder of the pod chassis 151 reaches out to be captured by the snap ring in a snap ring groove. This larger diameter permits the signal pod 150 to be inserted into the pod cavity 62 without the spring-loaded ground contacts having to be pushed over and past the snap ring groove but slip over the ramped shaped larger diameter portion of the pod cavity 62. Moreover, this arrangement provides assurance that the signal pod 150 cannot be installed backwards into the pod cavity 62

Figure 11:
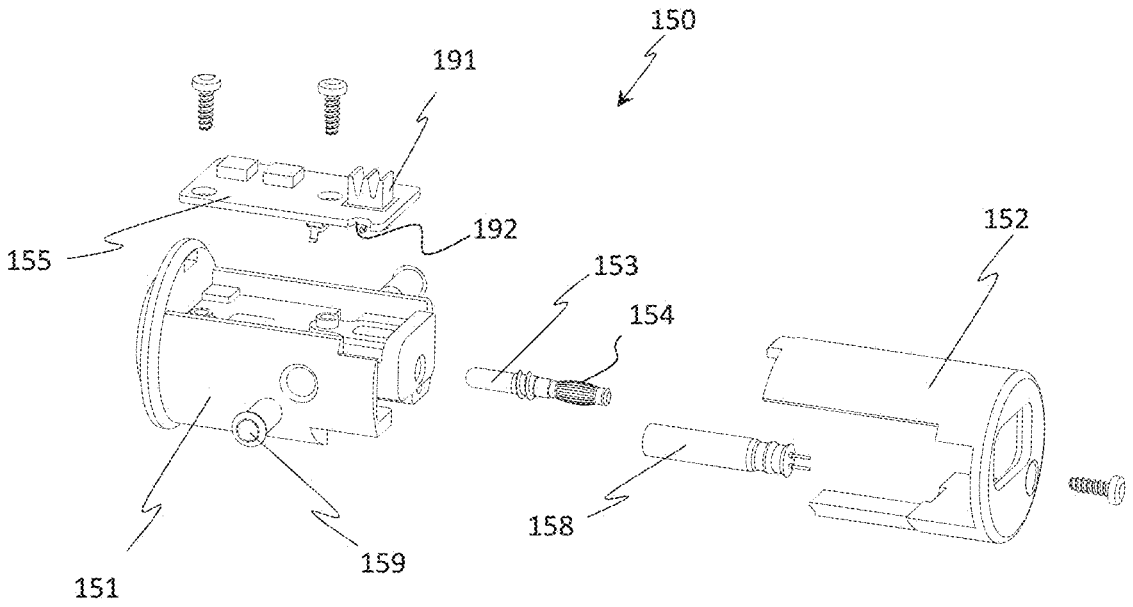
FIG. 11 is an exploded view of the pod showing a digital switch on a printed circuit board, a pod chassis, ground springs, a banana pin connector, a detonator and a cover.
Figure 14:
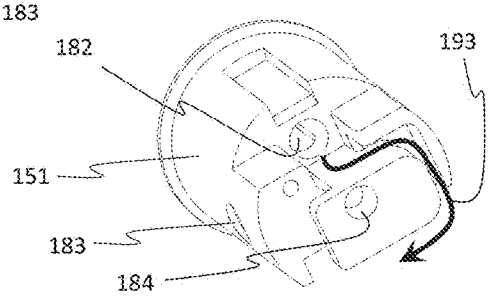
FIG. 14 is top and downhole end perspective view of the pod chassis that has been inverted to show the bottom.

Turning now to FIG. 11, the signal pod 150 has been opened in this exploded view showing the pod chassis 151 receiving the switch 155 in the form of a printed circuit board along with the ground contacts 159, the pod pass-through contact 153, the detonator 158 and the pod cover 152 that is secured with a single screw. The switch 155 includes various electronic chips and microprocessors and similar circuit board components. But in the present embodiment, the detonator 158 is electrically connected to the switch 155 by detonator fasteners or wire clips 191 after the detonator 158 is inserted to the bottom of the parallel detonator port 182 (see FIG. 14). The free wires are wrapped around a wire racetrack formed at the downhole end of the pod chassis 151 as will be further explained below and routed up past notch 192 and laid across the detonator wire clips 191 for a secure electric connection. There are numerous commercially available examples for simple and secure wire connections made in a guillotine fashion without peeling back wire insulation and most would be suitable for this use. Any excess wire may be trimmed for easier attaching of the pod cover 152 and securing by the screw. It should be noted that the switch 155 is also secured to the pod chassis by screws to help ensure accurate and positive location of the PCB so that its spring contacts are properly aligned with their components in the switch pod 150 and to minimize rattling and any possible damage prior to firing its associated perf perforating gun 35.

Figure 12:
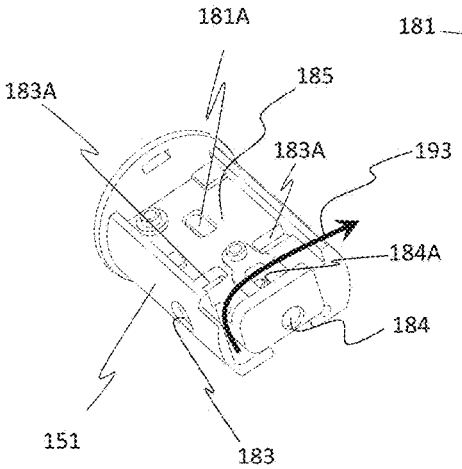
FIG. 12 is a top perspective view including the downhole end of the bare pod chassis.
Figure 13:
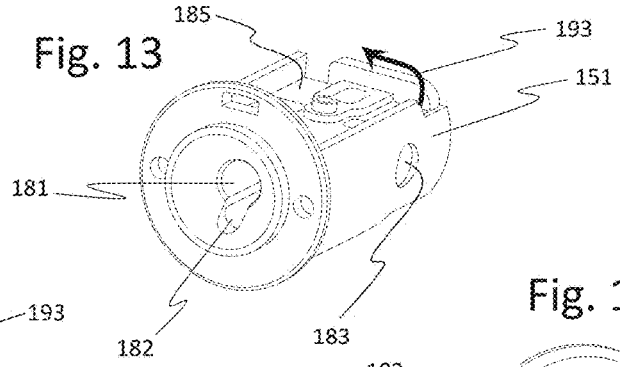
FIG. 13 is a perspective view of the uphole end of the bare pod chassis.

Turning now to FIGS. 12-18, additional views of the pod chassis 151 are shown. In FIGS. 12 and 13, the switch well 185 is shown at the top where the printed circuit board of the switch is mounted at a slight elevation so that chips and components may be installed on the bottom side of the circuit board as well as the top. In FIG. 13, the axial gun contact port 181 is shown front and center where the downhole gun contact 135 will be inserted with the detonator cord 126. Just below and in close proximity is the parallel detonator port 182. With the detonator 158 pre-installed into the signal pod and the downhole gun contact 135 being inserted into the axially oriented axial gun contact port 181, the detonator 158 will be in close proximity regardless of what rotational orientation the signal pod ends up when the connection is made up in the field. The parallel detonator port 182 is relatively closed around most of its periphery, in this exemplary embodiment, except toward the axial gun contact port 181 such that, the ballistic energy released by detonator 158 upon activation is focused towards the detonator cord 126. A detonator-detonator cord window 195 (see FIG. 20) is provided for conveying and channeling the ballistic energy from the detonator 158. The wires of the detonator are routed along a wire pathway shown by the arrows 193 in FIGS. 12-14. Focusing on FIG. 14 first, the detonator 158 is inserted into the parallel detonator port 182 and then the wires are gently pulled around the generously curved race track 193 up into the switch well. Once the switch is installed and secured with the wires passing around the notch 192, the wires are connected to the detonator wire clips 191 and trimmed as needed. In some embodiments, the wire pathway 193 extends at least halfway around the circumference of the pod chassis 151 of signal pod 150 to accommodate the circumferential spacing between detonator 158 and switch 155 of signal pod 150. The circumferential spacing between detonator 158 and switch 155 allows detonator 158 to axially overlap (e.g., along axis) switch 155 to thereby minimize the longitudinal length of signal pod 150.

The ground contact ports 183 are provided to receive the gun contacts 159 and similarly a passthrough contact port 184 is provided at the downhole end of the pod chassis 151. The switch well 185 is provided with windows to each of these ports so that the switch will be in continuous electrical contact with the electric circuit coming down the uphole perforating gun 35A along with the ground side of the electric circuit and provide a pass-through electrical path on to additional perforating guns 35 or other tools as described above. Specifically, a gun contact window 181A is provided for a spring contact on the bottom of the printed circuit board of the switch 155 to contact downhole gun contact 135. Two ground contact windows 183A are provided for spring contacts on the bottom of the printed circuit board of the switch 155 to contact the ground contacts 159.

With the other contacts installed, the pod cover 152 is attached and secured containing the most vulnerable components of the perforating guns 35 in a neat and tidy package that is easily transported, handled and assembled. The switch cover also helps to retain the det wires and the cover for the detonator wire clips 191 so that the wires do not come loose during shock and firing events.

Figure 15:
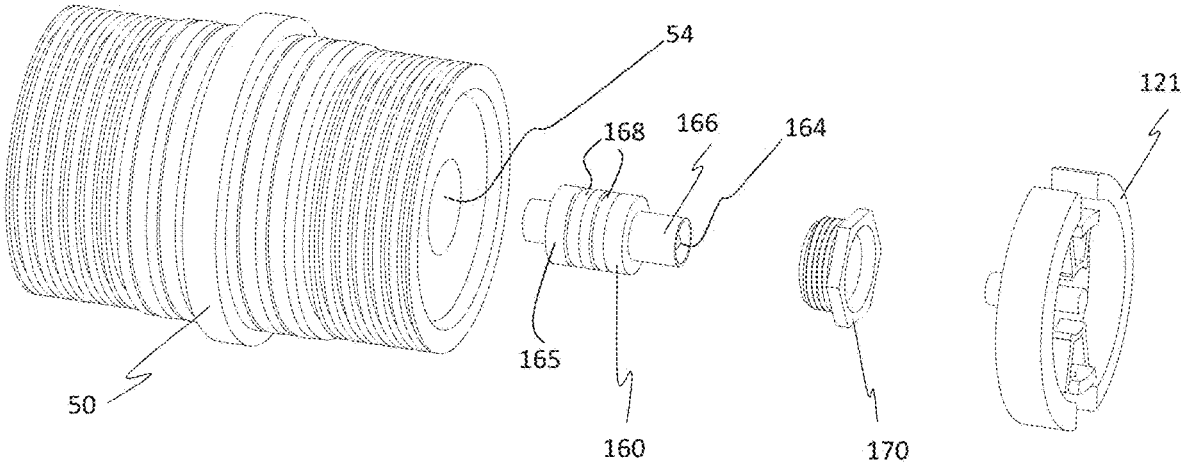
FIG. 15 is an exploded view showing the tandem sub, pressure bulkhead, a retainer nut and the uphole endplate of the downhole perforating gun.

FIG. 15 is included to show the assembly of the pressure bulkhead 160 into bulkhead cavity 64 of the tandem sub 50 and secured therein by the retainer nut 170. The uphole endplate 121 is shown as it would attach to the bulkhead pin connector 164 inside the bulkhead shroud 166.

Figure 16:
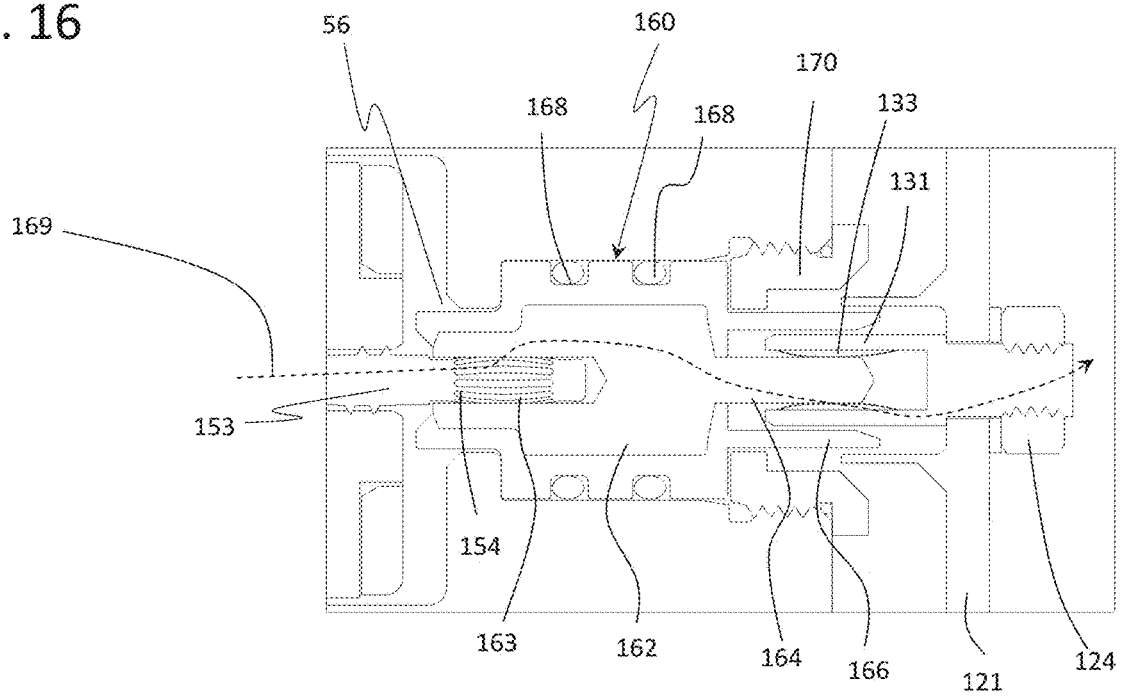
FIG. 16 is a further enlarged cross section view of the connections of the signal pod through the pressure bulkhead and further to the uphole endplate of the downhole perforating gun.

FIG. 16 is provided to show a further enlargement of the electrical path (indicated by arrow 169) through the pressure bulkhead 160 for the positive side of the electric circuit as power and communication signals are provided from the surface to direct the switches to respond individually and allow higher voltage power to be delivered directly and only to the intended detonator to fire a desired perforating gun 35. Also, the arrangement for capturing the pressure bulkhead 160 into the tandem sub 50 between the narrowest diameter section at the throughbore 66 at the uphole end and by the retainer nut 170 at the downhole end.

Figure 17:
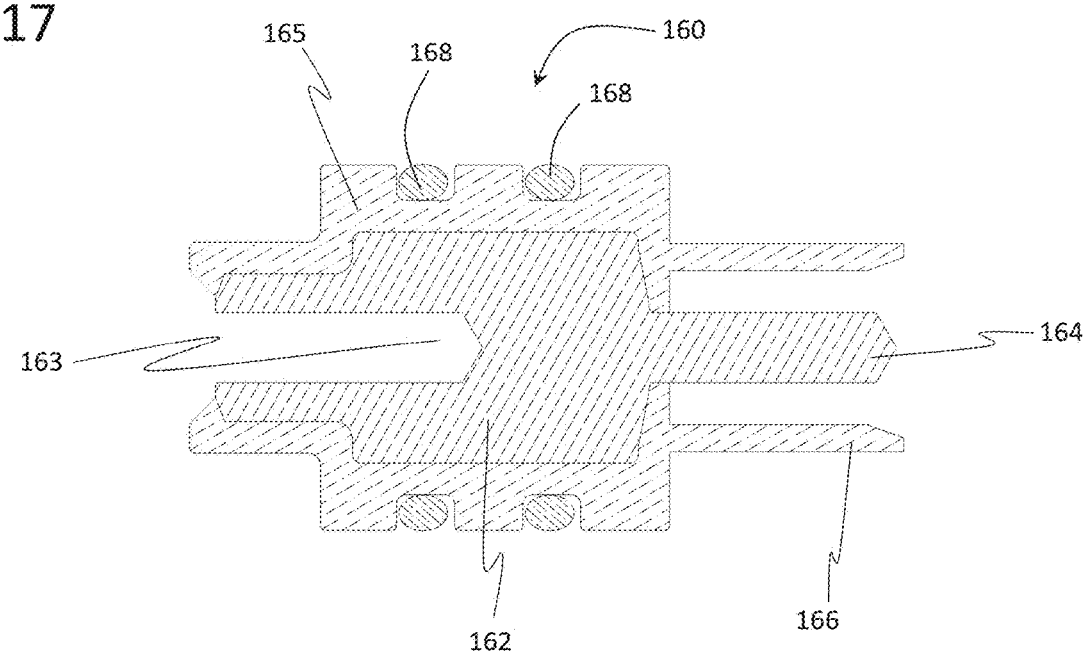
FIG. 17 is an exploded view of the lower side of the tandem sub, switch module and uphole endplate of a perforating gun.

FIG. 17 is provided to show the relative shapes of the conductive portions of the pressure bulkhead 160 with the insulating materials overlying the conductive portions while O-rings are provided for sealing within the tandem sub 50.

Figure 18:
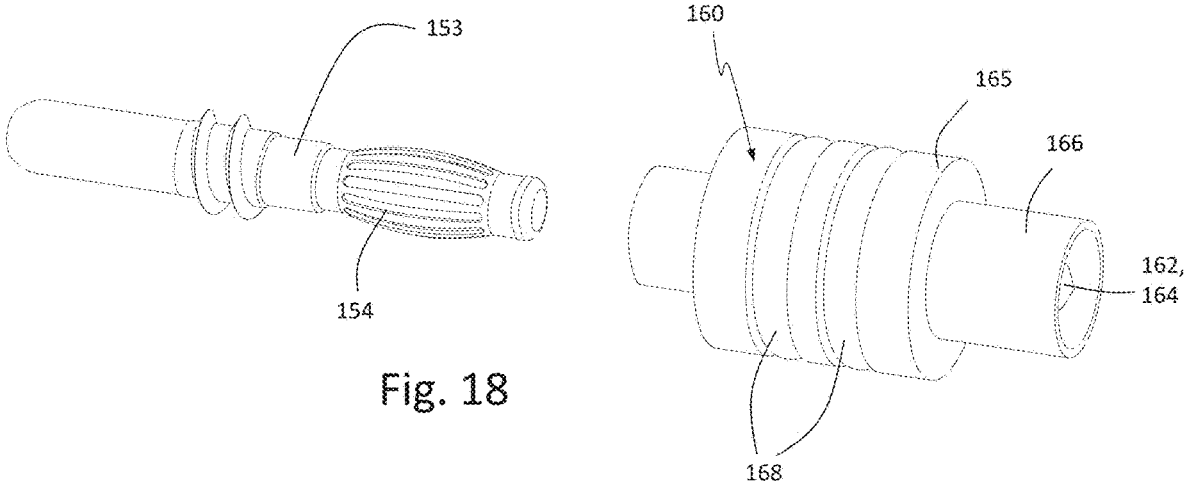
FIG. 18 is an exploded perspective view of the banana pin connector and the pressure bulkhead.

FIG. 18 is an exploded view that has been enlarged to show, in this exemplary embodiment, the banana plug configuration of the uphole gun connector 131 that is inserted into the female receptacle 163 defined by 162.

Figure 19:
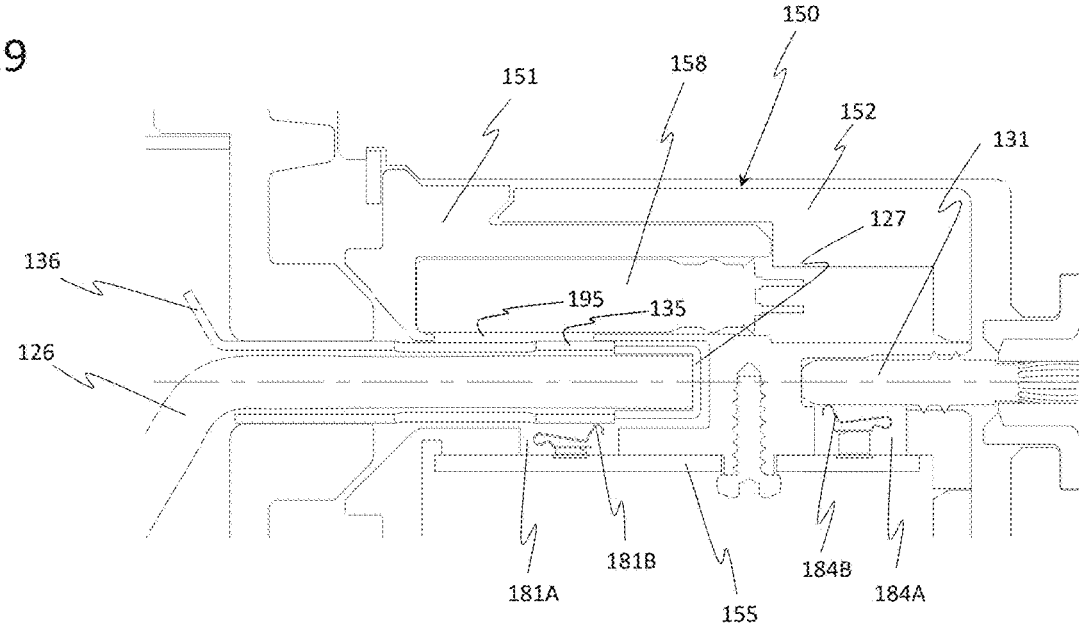
FIG. 19 is a further enlarged cross section view showing the switch and its electrical connections within the signal pod.

FIG. 19 is presented to show some of the finer details of the signal pod 150 and its arrangement for making electrical connection with power in, power out and ballistic energy being delivered from the detonator 158 to detonator cord 126. Specifically, there is a detonator-detonator cord window 195 between the captive detonator 158. And the apertures in the downhole gun contact 135 are further intended to reduce any ballistic interference while the switch 155 contacts the downhole gun contact 135 via a PCB gun contact spring 181B through gun contact window 181A on the unapertured portion on the downhole gun contact 135 extending deeper into the axial gun contact port 181. This unapertured portion has a continuous tubular outer wall and the apertures do not reach down into the axial gun contact port to get hung up on the PCB gun contact spring or be vulnerable for losing continuous electrical conductivity. This arrangement of contact springs positioned to reach through windows is one option for making these types of connections and that other suitable options for connecting printed circuit boards to electrical connections included soldering, bolting, snap-in plugs or other connectors beyond plungers and banana plugs and banana sockets may be suitable for use within the signal pod 150.

It should be further noted that any electric connection made through contact is arranged to allow axial movement of the opposite sides of the contact. For example, downhole contact 135 contacts PCB gun contact spring such that disconnecting these two components occurs in a radial direction relative to the axis but easily permits axial movement of the downhole gun contact 135 relative to the switch 155. This is the same for the banana plugs and sockets.

Turning to FIGS. 20-23, an embodiment of a charge carrier 200 for a perforating gun is shown. Charge carrier 200 receives one or more shaped charges 125 and may be received in a protective surrounding gun housing (e.g., gun housing 100 shown in FIG. 5) to form a perforating gun (e.g., perforating guns 35A and 35B shown in FIGS. 4-6). In this exemplary embodiment, charge carrier 200 has a longitudinal or central axis 205 and generally includes a carrier chassis 202, a first endplate 220, and an opposing second endplate 250. The carrier chassis 202 comprises a pair of longitudinally opposed ends 204 and includes one or more receptacles for receiving one or more corresponding shaped charges 125 at desired axial and angular positions along and about the carrier chassis 202. In addition, the detonator cord 126 couples to the carrier chassis 202 where at least a portion of the detonator cord 126 is received in an interior 203 of the carrier chassis 202.

While carrier chassis 202 is tubular (e.g., generally cylindrical) in this exemplary embodiment defining interior 203 that extends between the pair of endplates 220 and 250, the shape or configuration of carrier chassis 202, first endplate 220, and/or second endplate 250 may vary in other embodiments. For example, in an alternative embodiment, carrier chassis 202 is not tubular and instead may define one or more discrete receptacles for receiving one or more corresponding shaped charges 125. In this alternative embodiment, endplates 220 and/or 250 may remain as components separate from the carrier chassis 202 or, alternatively, may be incorporated with the carrier chassis 202 whereby, for example, the carrier chassis 202 may form a single integral, or monolithic member with endplates 220 and/or 250.

Endplates 220 and 250 couple to the opposing ends 204 of carrier chassis 202 of charge carrier 200 partially enclosing the interior 203 of carrier chassis 202. In some embodiments, first endplate 220 may comprise an uphole endplate of charge carrier 200 while second endplate 250 may comprise a downhole endplate of charge carrier 200. In other embodiments, first endplate 220 may comprise a downhole endplate of charge carrier 200 while second endplate 250 may comprise an uphole endplate of charge carrier 200. In this exemplary embodiment, first endplate 220 comprises a first or locked member 222, a second or rotatable member 230, and an electroballistic connector 240 that also receives a portion of the detonator cord 126 (e.g., a terminal end thereof) and thus may also be referred to herein as detonator cord housing 240. As used herein, the term "electroballistic connector" refers to a connector configured to concurrently facilitate both an electrical connection with a corresponding electrical connector and a ballistic connection with a corresponding ballistic component (e.g., a component configured to carry or direct a ballistic signal such as a detonator cord, a detonator, an initiator).

As will be discussed further herein, first endplate 220 comprises both a locked member 222 and a rotatable member 230 in order to permit charge carrier 200 to selectably: (i) permit rotation about central axis 205 of charge carrier 200 relative to a surrounding gun housing, and (ii) restrict rotation about central axis 205 of charge carrier 200 relative to the gun housing. Particularly, first endplate 220 additionally includes one or more locking members or elements 225 that may connect (when desired) the locked member 222 with the rotatable member 230 to restrict relative rotation about central axis 205 between members 222 and 230 and thereby restrict relative rotation about central axis 205 between members 222 and 230.

Particularly, the one or more locking elements or members 225 and the first endplate 220 have an unlocked state in which relative rotation about central axis 205 is permitted between members 222 and 230 facilitating relative rotation between charge carrier 200 (with the exception of rotatable member 230) and the surrounding gun housing, and a locked state in which relative rotation about central axis 205 is restricted facilitating the restriction of relative rotation between charge carrier 200 and the surrounding gun housing. The one or more locking elements 225 (or collectively the locking element) of first endplate 220 may be transitioned between the unlocked state and the locked state conveniently at the wellsite during the assembly of the toolstring containing the charge carrier 200 (e.g., a perforating gun such as perforating gun 35A or 35B containing charge carrier 200). In this manner, a single charge carrier 200 may be used with a variety of different types of gun housings, eliminating the need for producing (e.g., eliminating unnecessary tooling, fixtures) and storing (as well as tracking, transporting, etc.) several slightly different versions of the charge carrier 200 for use with these different types of gun housings.

For example, and referring briefly now to FIGS. 24 and 25, charge carrier 200 is shown installed in a first or grooved gun housing 280 in FIG. 24 forming a first perforating gun 279 while charge carrier 200 is shown installed in a separate second or scalloped gun housing 290 in FIG. 25 forming a separate second perforating gun 289. Grooved gun housing 280 has a radially outer surface along which one or more circumferential grooves or ring cuts 282 are formed which extend entirely around a central axis of the first perforating gun 279. Grooves 282 are formed in the outer surface of grooved gun housing 280 such that they reduce a radial wall thickness of the grooved gun housing 280 at the axial locations of the shaped charges 125 of charge carrier 200. The reduced wall thickness facilitated by grooves 282 reduces the amount of shrapnel or frayed material of grooved gun housing 280 (e.g., torn edges of grooves 282 projecting radially outwards from first perforating gun 279) formed from the detonation of the shaped charges 125, leading to fewer complications in retrieving the first perforating gun 279 from the wellbore (e.g., making it less likely frayed material of grooved gun housing 280 catches on a surface in the wellbore such as a casing joint).

Scalloped gun housing 290 comprises one or more scallops 292 formed in a radially outer surface of housing 290 for similarly reducing the wall thickness of scalloped gun housing 290 whereby second perforating gun 289 may be more conveniently retrieved from the wellbore with fewer complications. However, unlike grooves 282 of the grooved gun housing 280, the scallops 292 of scalloped gun housing 290 do not extend entirely around the central axis of the second perforating gun 289. Instead, scallops 292 extend only partially around the central axis and in FIG. 25 are shown as circular in shape and oriented generally orthogonal the central axis of second perforating gun 289. Thus, the shaped charges 125 of charge carrier 200 must remain rotationally locked to the scalloped gun housing 290 during deployment into the wellbore to ensure that shaped charges 125 remain angularly aligned with scallops 292 whereby shaped charges 125 may successfully "shoot through" the scallops 292. Conversely, charge carrier 200 need not remain rotationally locked to grooved gun housing 280 during deployment into the wellbore as it is impossible for shaped charges to exit out of angular alignment with the continuously extending grooves 282 of grooved gun housing 280. Thus, if desired, charge carrier 200 may rotate relative to first gun housing 280 while deployed downhole without interfering with the operation or functionality of first perforating gun 279.

In some applications (e.g., some wellbore completion operations) it may be desirable to employ perforating guns having gun housings that include grooves similar to grooves 282 shown in FIG. 24, while in other applications it may be preferable to employ perforating guns having gun housings including scallops similar to scallops 292 shown in FIG. 25. For example, grooves like grooves 282 typically require the elimination of more material from the gun housing than scallops like scallops 292, potentially resulting in a gun housing that is relatively weaker in accommodating stresses encountered from both pressure (external and/or internal pressure) and tensile/compressive sources.

Conventionally, charge carriers are typically designed and configured specifically for scalloped gun housings (e.g., gun housings including scallops similar to scallops 292 and not grooves like grooves 282) given that that the charge carrier must be capable of rotationally locking to the gun housing unlike grooved gun housings and thus are typically only used with scalloped gun housings. Similarly, conventionally charge carriers used with grooved gun housings (e.g., gun housings including grooves similar to grooves 282 and not scallops similar to scallops 292) are not used also with scalloped gun housings given they are not equipped for rotationally locking to the scalloped gun housing as needed to maintain angular alignment between the scallops of the gun housing and the shaped charges of the chare carrier.

Unlike conventional charge carriers, charge carrier 200 may be used with grooved gun housings (e.g., grooved gun housing 280) and scalloped gun housings (e.g., scalloped gun housing 290), simplifying (minimizing the number of required steps or equipment, time, cost) the process of producing, storing, tracking, and deploying perforating guns comprising charge carriers 200 (e.g., perforating guns 279 and 289). For instance, instead of needing to deploy a first quantity of "grooved" charge carriers (e.g., charge carriers configured specifically for use with grooved gun housings) to one or more wellsites and a second quantity of "scalloped" charge carriers (e.g., charge carriers configured specifically for use with grooved gun housings) to one or more wellsites, the required quantities of charge carriers 200 may be delivered to the selected well sites and conveniently configured as either "grooved" or "scalloped" charge carriers on-site (or alternatively off-site prior to delivery to the wellsite when desired).

Referring again to FIGS. 20-23, the locked member 222 of first endplate 220 includes a first or axially outer endface 223 and a longitudinally opposed second or axially inner endface 224. In this exemplary embodiment, locked member 222 comprises a pair of member connectors 226A and 226B spaced circumferentially about central axis 205 and projecting from the axially inner endface 224 thereof. Each member connector 226A and 226B includes a corresponding opening or hole 238A and 238B therein, respectively, that are radially oriented with respect to axis 205 in or through each corresponding connector 226A and 226B. Member connectors 226A and 226B are configured to couple to carrier chassis 202 at the respective openings 238A and 238B formed therein. In addition, carrier chassis 202 comprises one or more carrier connectors located at or near the ends 204 thereof, where at least one of the connectors 206 of carrier chassis 202 comprises one or more circumferentially spaced openings or holes 208A and 208B formed therein that are radially oriented with respect to axis 205 in or through the carrier chassis 202. Carrier chassis 202 is configured to couple to one or more endplates (e.g., endplates 220 and 250) at holes 208A and 208B.

Connectors 226A and 226B have cooperating radially outer peripheral surfaces in engagement with the inner surface of the carrier connector 206 of carrier chassis 202. In this exemplary embodiment, the radially outer surfaces of connectors 226A and 226B are radiused or arcuate in shape to sit substantially flush against the generally cylindrical inner surface of carrier chassis 202. In addition, in certain embodiments, an opposing radially inner surface of each connector 226A and 226B may not be radiused or curved and instead may be flat or planar in shape to minimize the complexity of producing endplate 220 while also maximizing the strength of the connection or joint. For example, the planar inner surface of connectors 226A and 226B presents a planar contact face against which a corresponding annular contact shoulder of the fastener 227 may press against to minimize stress concentrations within connectors 226A/226B and/or fastener 227.

Figure 23:
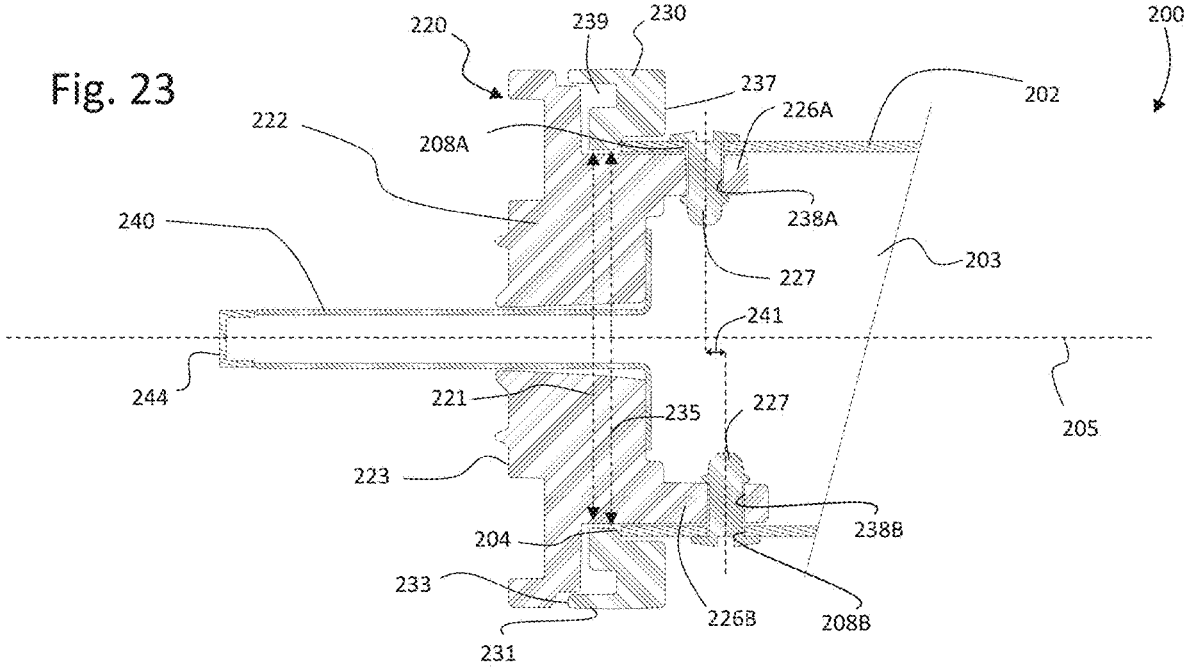
FIG. 23 is a perspective view of a gun carrier showing ring cuts on the periphery to reduce the thickness axially aligned over the shaped charges but where rotational alignment is not necessary.

As best seen in FIG. 23, connector 226A is slightly longer longitudinally than connector 226B such that the opening 238A of connector 226A is longitudinally misaligned with opening 238B of connector 226B resulting in the formation of an axially extending gap 241 therebetween. Openings 208A and 208B of the connector 206 of carrier chassis 202 are similarly axially spaced apart by axial gap 241. In this configuration, the opening 208B of member connector 226B is prevented from axially aligning with the opening 238A of carrier connector 206 while the opening 208A of member connector 226A is prevented from axially aligning with the opening 238B of carrier connector 206. In this manner, locked member 222 can only couple with carrier chassis 202 in a single predefined angular orientation and cannot be mistakenly and undesirably coupled with carrier chassis 202 in an angular orientation 180 degrees out of phase with the predefined angular orientation as in such a mistaken orientation the opening 238A of connector 226A, for example, is axially misaligned from the opening 208B (circumferentially aligned with opening 238A in this mistaken orientation) of the connector 206 of carrier chassis 202

Also shown in FIG. 23, member connector 226 has an outer periphery defined by an outer diameter (OD) 221 to take a curve or radius corresponding to the inside of the inside of the carrier chassis 202 and the arrow 221. In addition, a similar radiused inner surface of the rotatable member 230 of first endplate 220 is defined by an inner diameter (ID) 235. The ID 235 of rotatable member 230 may vary in magnitude moving between the axially outer end 233 of rotatable member 230 and an axially or longitudinally opposed axially inner endface 237 of rotatable member 230. Thus, ID 235 may have a minimum ID 235' at one axial location and a maximum ID 235" at a separate axial location that is greater than the minimum ID 235'.

In some embodiments, the minimum ID 235' of rotatable member 230 is greater than the OD 221 of connector 226, including a maximum OD 221 of connector 226. This permits the rotatable member 230 to be slid axially over the connector 226 of locked member 222 (e.g., without needing to thread rotatable member 230 onto locked member 222) whereby rotatable member 230 axially overlaps locked member 222 about an annular interface formed therebetween along the OD 221 of connector 226 and the ID 235 of rotatable member 230. Axially overlapping locked member 222, the locked member 222 may be coupled to an end 204 of carrier chassis 202 with rotatable member 230 positioned axially between locked member 222 and carrier chassis 202 along the OD 221 of locked member 222. In some embodiments, rotatable member 230 contacts or engages the end 204 of carrier chassis 202 while in other embodiments rotatable member 230 may be slightly more spaced from the carrier chassis 202. In addition, in certain embodiments, the maximum ID 235" of rotatable member 230 is greater than an OD of carrier chassis 202 permitting the axially inner endface 237 of rotatable member 230 to fit annularly around and axially overlap carrier chassis 202; however, in other embodiments, maximum ID 235" may be less than the OD of carrier chassis 202 and rotatable member 230 may not fit around or otherwise axially overlap carrier chassis 202.

Figure 20:
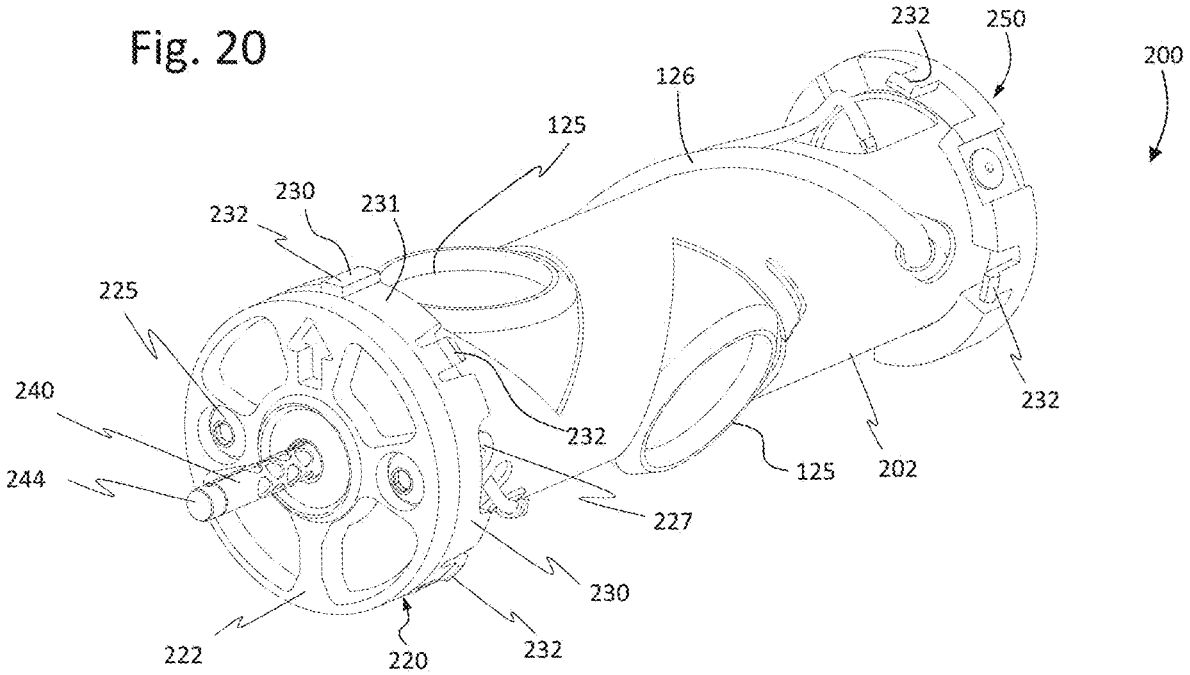
FIG. 20 is a perspective view of another embodiment of the disclosure showing an assembled charge carrier ready to be installed into a gun carrier.
Figure 21:
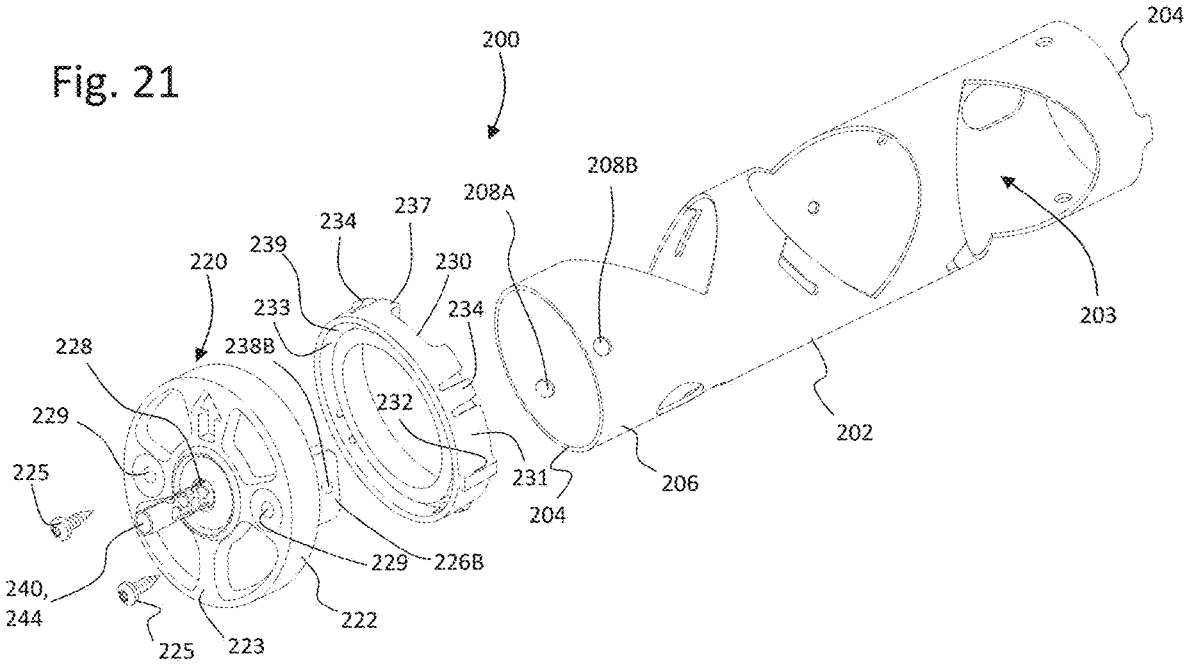
Figure 22:
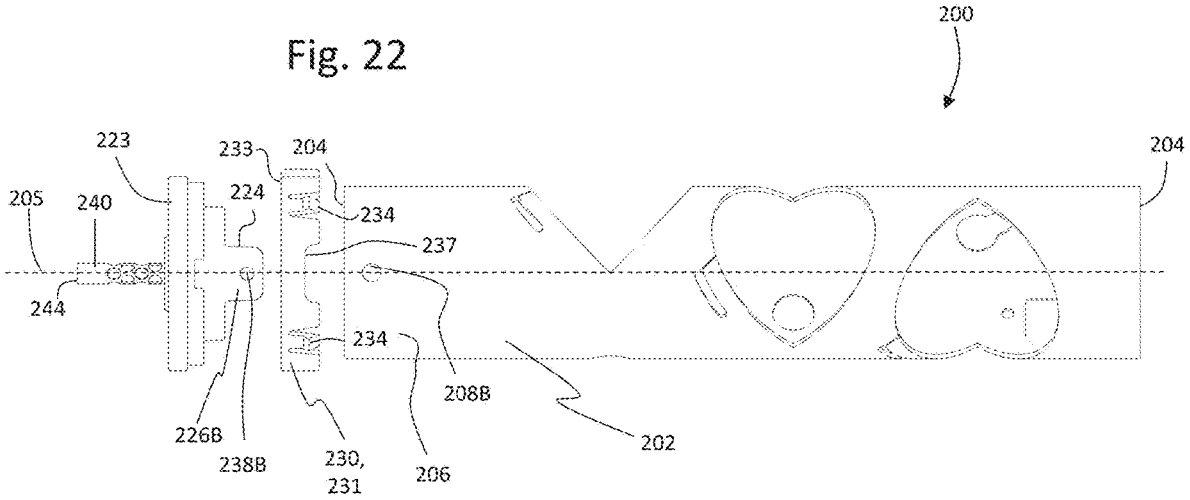
FIG. 22 is an elevation exploded view highlighting how Endplate A is riveted to the charge carrier and the two undertake a relative rotational alignment where the molded arrow in endplate A aligns with the top of the first shaped charge but where endplate B is free to rotate until endplate screws are used to fix endplate A to endplate B.

Locked member 222 connects the first endplate 220 to a selected end 204 of carrier chassis 202 via coupling the member connector 226 of locked member 222 with the carrier connector 206 of carrier chassis 202. Particularly, with member connector 226 coupled to carrier connector 206 of carrier chassis 202, relative rotation between locked member 222 and carrier chassis 202 along with shaped charges 125 when they are installed in carrier chassis 202. In this exemplary embodiment, connectors 206 and 226 comprise mating apertures that each receive a separate corresponding fastener 227 (e.g., a rivet, a threaded fastener as shown in FIGS. 20 and 23) to couple the locked member 222 to the end 204 of carrier chassis 202. However, the configuration of connectors 206 and 226 may vary in other embodiments. For example, in other embodiments, connectors 206 and 226 may comprise corresponding snap connectors and the like.

In this exemplary embodiment, locked member 222 additionally includes an opening or receptacle 228 that at least partially receives the electroballistic connector 240. Electroballistic connector 240 may couple to the first endplate 220 at the receptacle 228 of locked member 222. Additionally, in some embodiments, receptacle 228 facilitates passage of detonator cord 126 from the interior 203 of carrier chassis 202 to an exterior thereof such that it may ballistically couple with a component (e.g., a detonator, an initiator) located exterior of the charge carrier 200.

In this exemplary embodiment, the rotatable member 230 of first endplate 220 is ring-shaped and thus may also be referred to herein as lock ring 230. Particularly, rotatable member 230 includes a radially outer surface 231 along which a key 232 and one or more circumferentially spaced endplate connectors 234 are positioned. Key 232 is receivable in a corresponding axially extending slot or keyway 284 (shown in FIG. 42) formed along an inner surface of a corresponding gun housing (e.g., gun housings 280 and 290 shown in FIGS. 24 and 25) to restrict relative rotation about central axis 205 between the rotatable member 230 and the gun housing (e.g., via physical interference between key 232 and opposing shoulders of the arcuate groove of the gun housing) when charge carrier 200 is received in the gun housing irrespective of whether locking elements 225 are in the locked or unlocked state.

In this exemplary embodiment, first endplate 220 is transitionable from the unlocked state to the locked state by inserting locking elements 225 through apertures 229 formed in the rotatable member 222 (restricting relative rotation about central axis 205 between rotatable member 222 and locking elements 225) and coupling the locking elements 225 to an outer axial endface 223 of rotatable member 222 to restrict relative rotation about central axis 205 between locking elements 225 and rotatable member 230. For example, members 222 and 230 comprise an electrically insulating material in some embodiments that is relatively soft whereby locking elements 225 which may comprise threaded fasteners may simply be threaded into outer axial endface 233 of rotatable member 230 to bite into the rotatable member 230 secure locking elements 225 (and thereby rotatable member 222 through the locking elements 225) to the rotatable member 230.

Particularly, in this exemplary embodiment, locking elements 225 are threaded into rotatable member 230 such as into an annular lock receptacle 239 formed centrally in the outer axial end 233 of rotatable member 230 to restrict relative rotation between locked member 222 and rotatable member 230. The annular shape of lock receptacle 239 permits locking elements 225 to be threaded into lock receptacle 239 to couple locked member 222 with rotatable member 230 irrespective of the relative angular orientations of locked member 222 and locking member 230. In other embodiments, locked member 222 may instead comprise lock receptacle 239 which receive one or more locking elements 225 (e.g., extending through corresponding openings or receptacles formed in the rotatable member 230) to restrict relative rotation between locked member 222 and rotatable member 230.

The configuration of locking elements 225 and/or lock receptacle 239 may vary in other embodiments. For example, in other embodiments, locking element 225 may comprise a key receivable in corresponding receptacles of members 222 and 230 to restrict relative rotation about central axis 205 therebetween. Additionally, while in this exemplary embodiment the first endplate 220 comprises a pair of locking elements 225, in other embodiments, first endplate 220 may include only a single locking element 225 or more than two locking elements 225. Further, while in this exemplary embodiment locking elements 225 are separate from members 220 and 230 (with elements 225 forming an assembly with members 220 and 230 when in the locked state), in other embodiments, locking elements 225 may be integrally or monolithically formed with at least one of the rotatable member 222 and the rotatable member 230.

Figure 26:
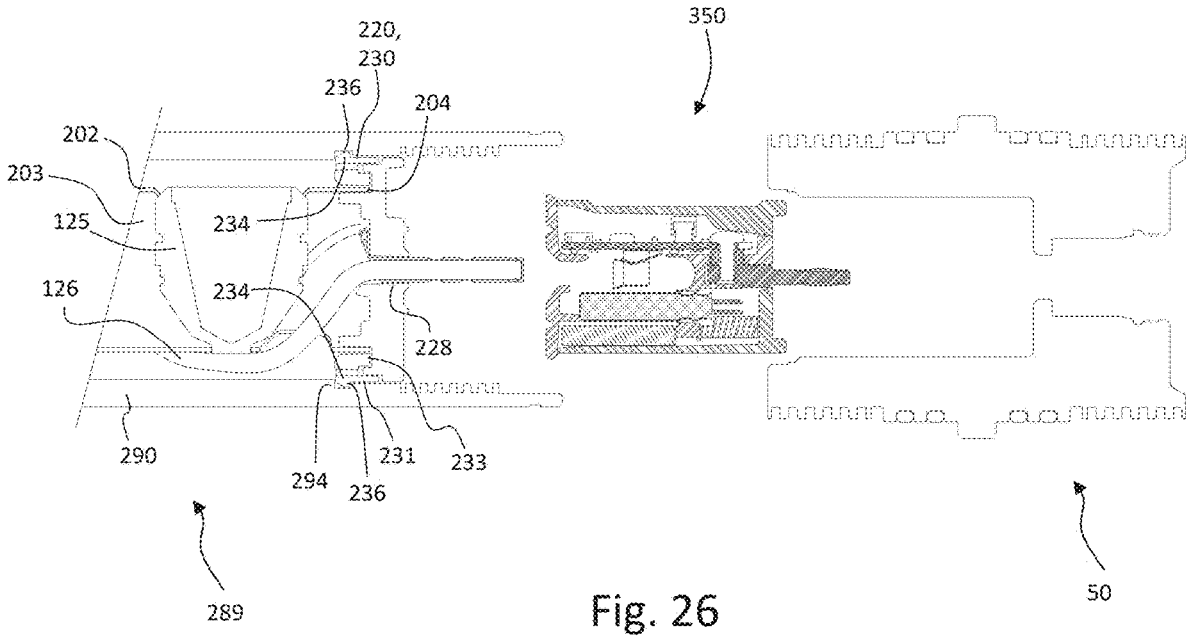
FIG. 26 shows a first arrangement of the detonator cord housing having open slots for the blast energy from the detonator to pass into and detonate the detonator cord.

The endplate connectors 234 of the rotatable member 230 of first endplate 220 are configured to couple to a corresponding gun housing when charge carrier 200 is received therein to restrict relative axial movement (e.g., relative movement along central axis 205) between charge carrier 200 and the gun housing 200. In this exemplary embodiment, and referring now to FIG. 26, a radially outer shoulder 236 of each endplate connector 234 of rotatable member 230 is receivable in a corresponding annular groove 294 formed within a central bore or passage of gun housing 290 to couple charge carrier 200 to gun housing 290 and thereby restrict axial movement therebetween.

Particularly, the outer shoulder 236 of each endplate connector 234 is biased radially outwards such that the outer shoulder 236 flexes or springs automatically into (e.g., the endplate connector 234 may comprise a biasing element coupled to the shoulder 236) the groove 294 to secure charge carrier 200 to the gun housing 290. Endplate connectors 234 thus eliminate the need of a separate fastener such as a C-ring and the like to axially lock the charge carrier 200 to the gun housing 290, streamlining the process for assembling the perforating gun 289 leading to fewer assembly mistakes that may result in issues during downhole operation of the perforating gun 289. Particularly, instead of first installing a charge carrier followed by a separate fastener such as a C-ring, charge carrier 200 may be loaded (e.g., slid axially) into the interior of gun housing 290 until endplate connectors 234 snap automatically into the corresponding grooves 294 of gun housing 290. Additionally, in some embodiments, each endplate 220 and 250 of charge carrier 200 includes one or more endplate connectors 234 (e.g., as shown in FIG. 20); however, in other embodiments, only first endplate 220 or second endplate 250 may include endplate connectors 234.

Figure 27:
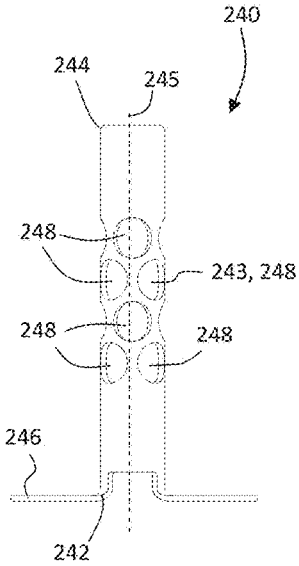
FIG. 27 is a second arrangement of the detonator cord housing having hexagonal shaped openings for the blast energy from the detonator to pass into and detonate the detonator cord.

Referring again to FIGS. 20-23 and 27, an additional view of the electroballistic connector 240 of first endplate 220 is provided in FIG. 27. Electroballistic connector 240 provides both an electrical and a ballistic connection between the charge carrier and an external component (e.g., a component external a perforating gun comprising the charge carrier 200). For example, electroballistic connector 240 may provide both a ballistic connection (facilitating the transfer of ballistic signals) and an electrical connection (facilitating the transfer of electrical signals and power) with an external signal pod (e.g., signal pod 150 shown in FIG. 11) whereby the shaped charges 125 of charge carrier 200 may be selectably detonated from the surface via transmitting a firing signal (e.g., along a wireline extending between the surface and a toolstring containing charge carrier 200) to the signal pod such as a firing signal addressed uniquely to the signal pod. In this exemplary embodiment, the electrical and ballistic connection facilitated by electroballistic connector 240 are centerline connection extending along central axis 205 of charge carrier 200 whereby charge carrier 200 may be rotated about central axis 205 relative to an external component (e.g., a signal pod) electrically and ballistically coupled to the charge carrier 200 through the electroballistic connector 240 without damaging or otherwise interfering with the electrical and ballistic connections facilitated by connector 240; however, in other embodiments, one or both of these connections may be made at a location that is radially spaced from central axis 205.

In this exemplary embodiment, electroballistic connector 240 has a longitudinal or central axis 245 (coaxial with central axis 205 in this exemplary embodiment) and is generally cylindrical, formed from electrically conductive material(s), and includes a longitudinal first or fixed end 242, a longitudinally opposed second or free end 244. Fixed end 242 is coupled the locked member 222 of first endplate 220 while free end 244 is axially spaced from the outer axial endface 223 of locked member 222 such that the free end 244 of electroballistic connector 240 projects axially from the first endplate 220 whereby the free end 244 of electroballistic connector 240 may be received in a corresponding connector (e.g., a corresponding electroballistic connector) of an external component such as a signal pod. The base end 242 of electroballistic connector 240 comprises an electrical contact or terminal 246 that flares radially outwardly and is thus radially offset from central axis 245. Electrical contact 246 may be positioned within the interior 203 of carrier 200 once assembled and electrically connected with a signal conductor of charge carrier 200, such as a signal conductor electrically connected to an electrical connector of the second endplate 250 of carrier 200.

In this exemplary embodiment, fixed end 242 of electroballistic connector 240 is open allowing the insertion of detonator cord 126 into an interior 243 of connector 240 while free end 244 is enclosed such as by an end cap formed by the free end 244. Thus, free end 244 may also be referred to herein as end cap 244. In some embodiments, end cap 244 is formed separately from electroballistic connector 240 to facilitate assembly of charge carrier 200 (e.g., to permit insertion of detonator cord 126 through free end 242). In other embodiments, end cap 244 may be formed integrally or monolithically with connector 240. The enclosure of the interior 243 of electroballistic connector 240 focuses and directs ballistic energy generated by the activation of an external ballistic component (e.g., a detonator positioned parallel and alongside the electroballistic connector 240) through one or more radial openings 248 formed along a radially outer periphery of connector 240 and against another ballistic component (e.g., an end of detonator cord 126) received in the interior 243 of electroballistic connector 240 to thereby facilitate a ballistic connection between the pair of ballistic components. Particularly, radial openings 248 may be circumferentially spaced about and/or along central axis 245 of electroballistic connector 240. In this configuration, ballistic energy which would have otherwise escaped through free end 244 is instead redirected by end cap 244 against the ballistic component received in the interior 243 of electroballistic connector 240.

Figure 28:
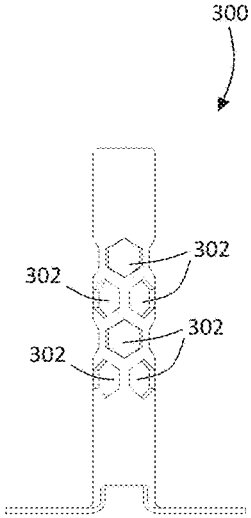
FIG. 28 is a third second arrangement of the detonator cord housing having circular shaped openings for the blast energy from the detonator to pass into and detonate the detonator cord.
Figure 29:
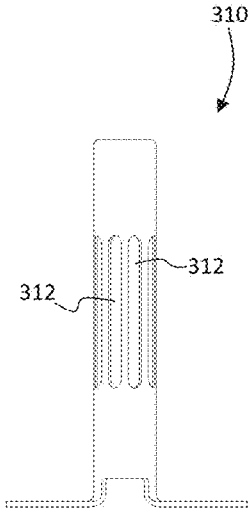
FIG. 29 is an elevation cross section view of a signal pod from the embodiment shown in FIG. 20.
Figure 30:
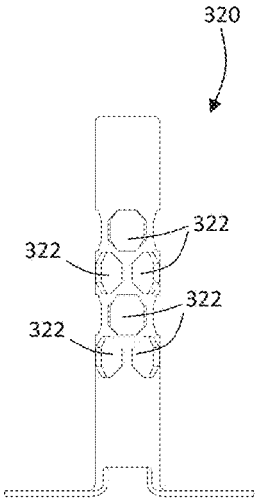
FIG. 30 is an exploded perspective view of the detonator cord protruding from the detonator cord housing and the end cap oriented to slide onto the detonator cord and bite into the same so as to hold the end of the detonator cord within the detonator cord housing during further assembly of the perf gun and subsequent handling of the perf gun until the detonator is used to detonate the detonator cord.

The number, arrangement, location, size, shape and other characteristics of radial openings 248 may vary in other embodiments. For example, referring briefly to FIGS. 28-30, other embodiments of electroballistic connectors 300, 310, and 320 are shown, respectively, which may be used in first endplate 220 in lieu of the electroballistic connector 240 shown in FIG. 27. For instance: the electroballistic connector 300 shown in FIG. 28 includes a plurality of axially and circumferentially spaced hexagonal radial openings 302; the electroballistic connector 310 shown in FIG. 29 includes a plurality of circumferentially spaced elongate slots 312; and the electroballistic connector 320 shown in FIG. 30 includes a plurality of axially and circumferentially spaced oval-shaped radial openings 322. Radial openings 248, 302, 312, and 322 provide only a few examples of the potential configuration of the one or more radial openings of embodiments of electroballistic connectors described herein.

Figure 31:
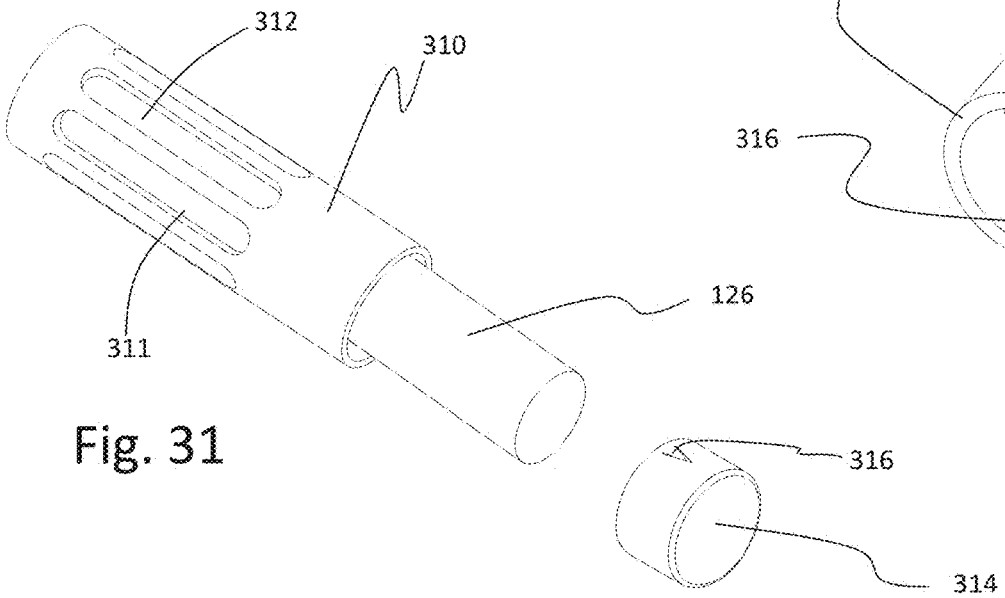
FIG. 31 is a perspective view into the open end of the end cap.
Figure 32:
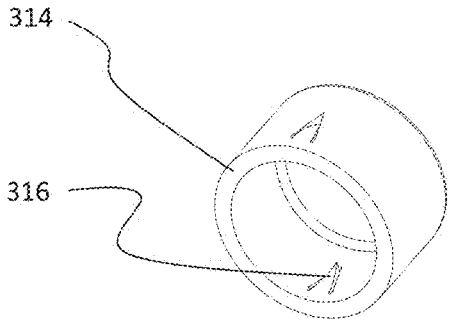
FIG. 32 is an end view of the detonator cord housing showing wall thickness which is important to provide support for the detonator cord, to provide electrical communication and power into the signal pod but also not hinder the ballistic transfer from an exploding detonator that the detonator cord where a thick wall detonator cord housing may impede the transfer and not detonate the shaped charges.
Figure 33:
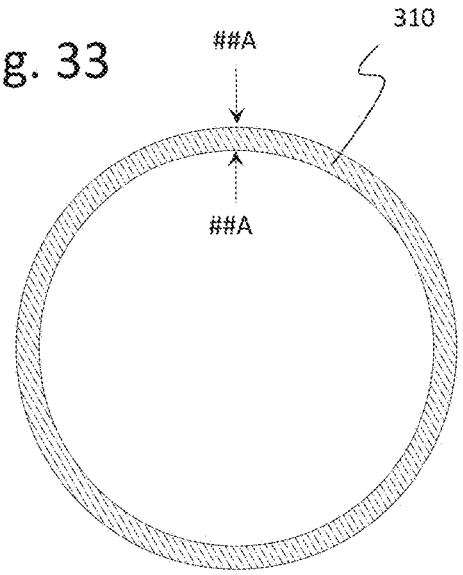
FIG. 33 is an end view similar to FIG. 31 but showing the detonator cord substantially filling the open bore of the detonator cord housing.
Figure 34:
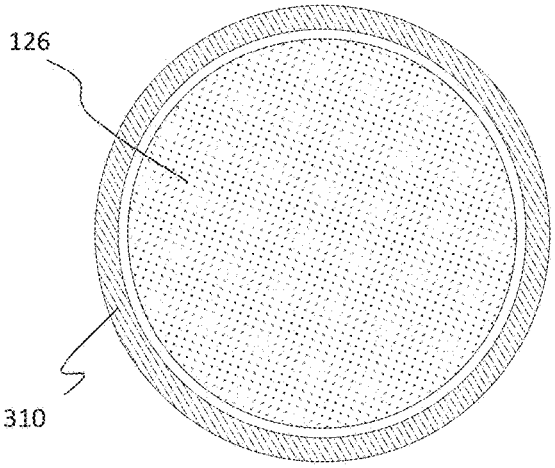
FIG. 34 is an elevation cross section view of a signal pod from the embodiment shown in FIG. 20 with a detonator tab knocked out and an outline of a longer detonator shown fitting into the same signal pod.

Referring briefly to FIGS. 31 and 32, electroballistic connector 310 is partially shown having a free end that forms a separate end cap 314. In this exemplary embodiment, end cap 314 is provided with one or more circumferentially spaced teeth 316 which project radially inwards into an interior 311 of end cap 314. Teeth 316 serve to bite into the terminal end of the detonator cord 126 thereby coupling the end cap 314 to the terminal end of the detonator cord 126 without needing to separately couple the end cap 314 to the electroballistic connector 310. Instead, detonator cord 126 may be inserted through the interior 311 of electroballistic connector 310 and then coupled to end cap 314 via teeth 316 to secure the detonator cord 126 to the electroballistic connector 310.

Figure 35:
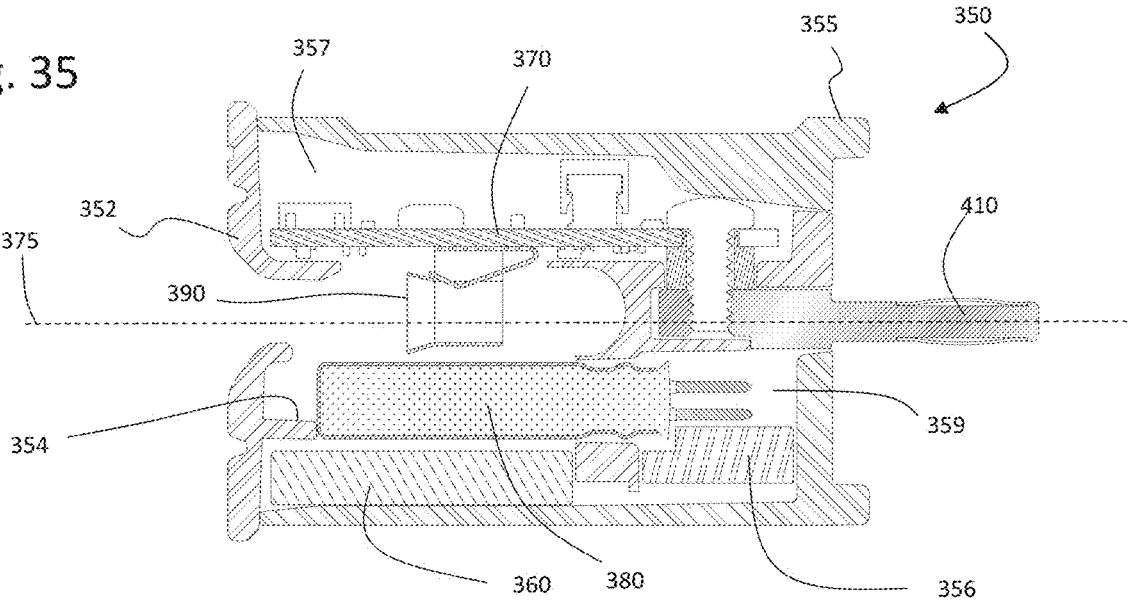
FIG. 35 is an end view of a reflector used for focusing the energy of the blast from a detonator shown in dotted lines toward the detonator cord held in place by the detonator cord housing.

Referring to FIG. 35, another embodiment of a signal pod 350 is shown. Signal pod 350, similar to signal pod 150 shown in FIG. 11, is configured to selectably activate or detonate a perforating gun comprising charge carrier 200 (e.g., perforating guns 279 and 289 shown in FIGS. 24 and 25) in response to receiving a firing signal directed (e.g., addressed such as uniquely addressed) to the signal pod 350 such as a firing signal directed from the surface and communicated to the signal pod 350 (located in a wellbore) via a wireline or other signal conductor.

In this exemplary embodiment, signal pod 350 generally includes a pod chassis 352, and a switch 370 and a detonator 380 both received within an interior of the chassis 352. Chassis 352 extends between a first or axially inner end 351 (to the right in FIG. 35) and a longitudinally opposed second or axially outer end 353 (at the left end of signal pod 350). In some embodiments, the axially inner end 351 is formed by or defines an endcap or endplate that may be coupled to the remaining portion of the chassis 352 extending from axially outer end 353 (e.g., in the shape of a pocket) after the switch 370 and detonator 380 have both been installed in the interior of the chassis 352. However, the configuration of chassis 352 may vary in other embodiments. For example, in some embodiments, chassis 352 may comprises a single integral or monolithic member that is overmolded to the remaining components of the signal pod 350.

Chassis 352 includes a removable alignment tab 354 which permits chassis 352 to accept detonators 380 of different longitudinal lengths. For example, the detonator 380 shown in FIG. 35 has a first longitudinal length while detonator 380' shown in FIG. 36 has a second longitudinal length that is greater than the first longitudinal length. Particularly, alignment tab 354 is frangibly connected to the chassis 352 such that alignment tab 354 may be removed or broken off (e.g., during the assembly of signal pod 350) to accept the detonator 380'. In addition, signal pod 350 includes a detonator retainer or block 356 which presses axially against detonator 380 to prevent relative axial movement (e.g., vibration or chatter) between detonator 380 and chassis 352.

Figure 37:
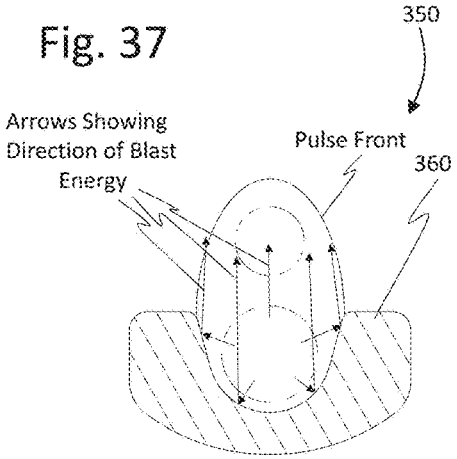
FIG. 37 is a fourth arrangement of the detonator cord housing having octagonal shaped openings for the blast energy from the detonator to pass into and detonate the detonator cord.
Figure 38:
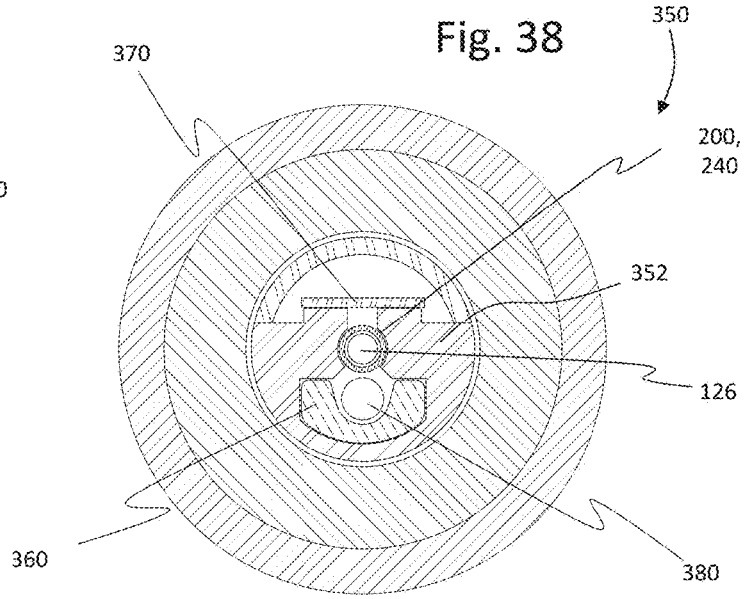
FIG. 38 is a perspective view of the electric terminal attached to the printed circuit board for electrically connecting the detonator cord housing to the switch inside the signal pod where the electric terminal includes a funnel shape to guide the end cap into and through the terminal and support the detonator cord housing against the leaf spring portion of the terminal.

In this exemplary embodiment, signal pod 350 has a longitudinal or central axis 375 and generally includes a chassis 352, a switch 370, a detonator 380, a first or internal electrical connector 390, and a second or external electrical connector 410. Chassis 352 defines an internal volume or interior including a switch receptacle 357 and a detonator receptacle 359. Signal pod 350 includes an energy reflector 360 positioned in the detonator receptacle 359 and which is configured to reflect or redirect ballistic energy (shown particularly in FIG. 37) via a concave reflection surface 362 of the reflector 360 and which may at least partially define the receptacle detonator receptacle 359 in which the detonator 380 is positioned.

Figure 40:
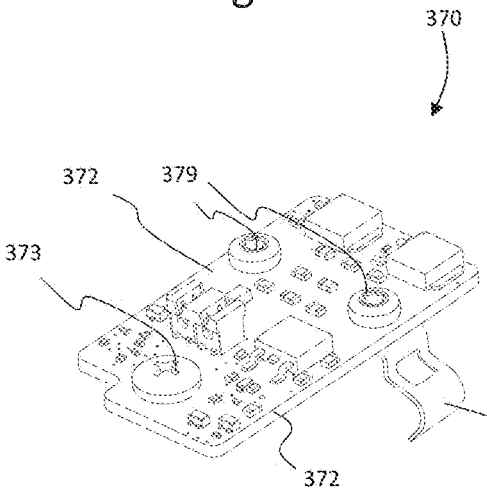
FIG. 40 is a similar perspective view like FIG. 39 but of the signal pod in accordance with the embodiment shown in FIG. 20 with the one visible bow spring ground terminals peeking out a small window on each side of the pod to contact the inside of the tandem sub and also showing the standoff legs for spacing the lower end of the signal pod off the bottom of the chamber within the tandem sub in the event that a small amount of water may seep into the perforating gun.

As shown particularly in FIG. 40, switch 370 comprises a PCB 372 upon which one or more processors, one or more memory devices, etc., may be positioned, and one or more electrical ground terminals or contacts 374 positioned along edges of the PCB 372 and extending from the PCB 372. PCB 372 may be coupled to the chassis 352 via one or more first fasteners 373 electrically connected to a signal pathway of the switch 370 and one or more second fasteners 379 connected to a ground pathway of switch 370. Ground contacts 374 project radially outwards through openings 357 (shown in FIG. 41) formed in chassis 352 whereby ground contacts 374 may electrically connect to an inner surface of a surrounding housing (e.g., tandem sub 50). Additionally, in this exemplary embodiment, chassis 352 includes a flexible lip 358 configured to snap into a corresponding groove of the outer housing to lock the signal pod 350 to the outer housing.

Figure 39:
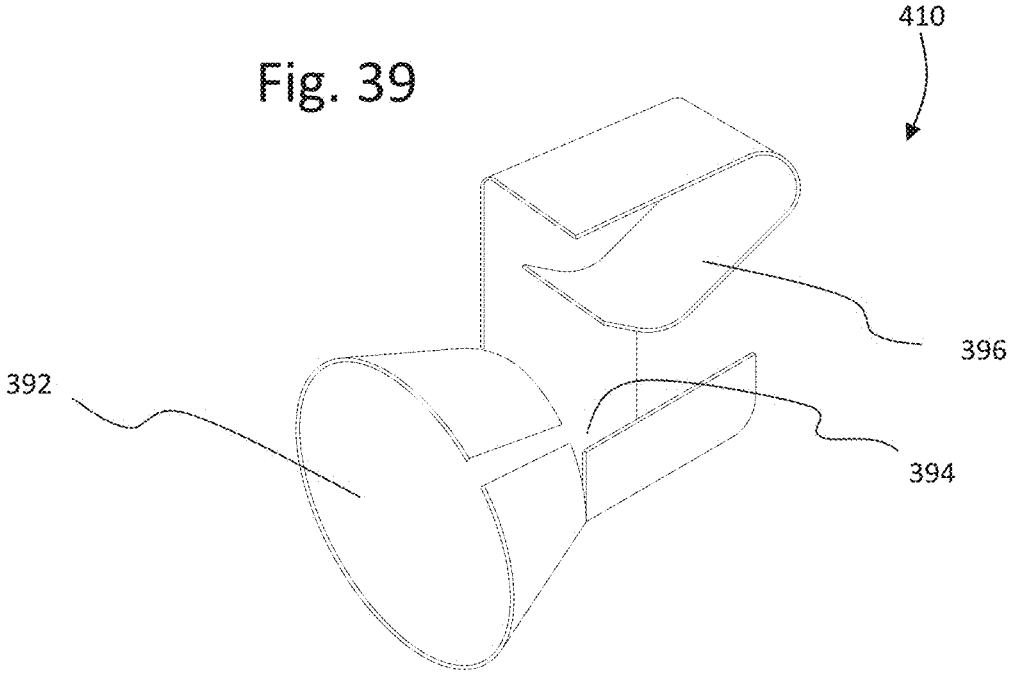
FIG. 39 is a perspective view of a printed circuit board of the embodiment shown in FIG. 20 with bow spring ground terminal attached to the underside of the printed circuit board where two such ground terminals will extend from opposite sides into contact with the inside of the tandem sub.

As shown particularly in FIG. 39, in this exemplary embodiment, internal electrical connector 390 of signal pod 350 generally includes a frustoconical or funneled guide 392, a connector support 394, and a biasing element 396 (e.g., a bow spring). Guide 392 guides the end cap of the electroballistic connector into a desired position relative to signal pod 350. Additionally, biasing element 396 forms an electrical contact that slidably contacts the electroballistic connector 240 of charge carrier 200 to establish an electrical connection therebetween.

Figure 36:
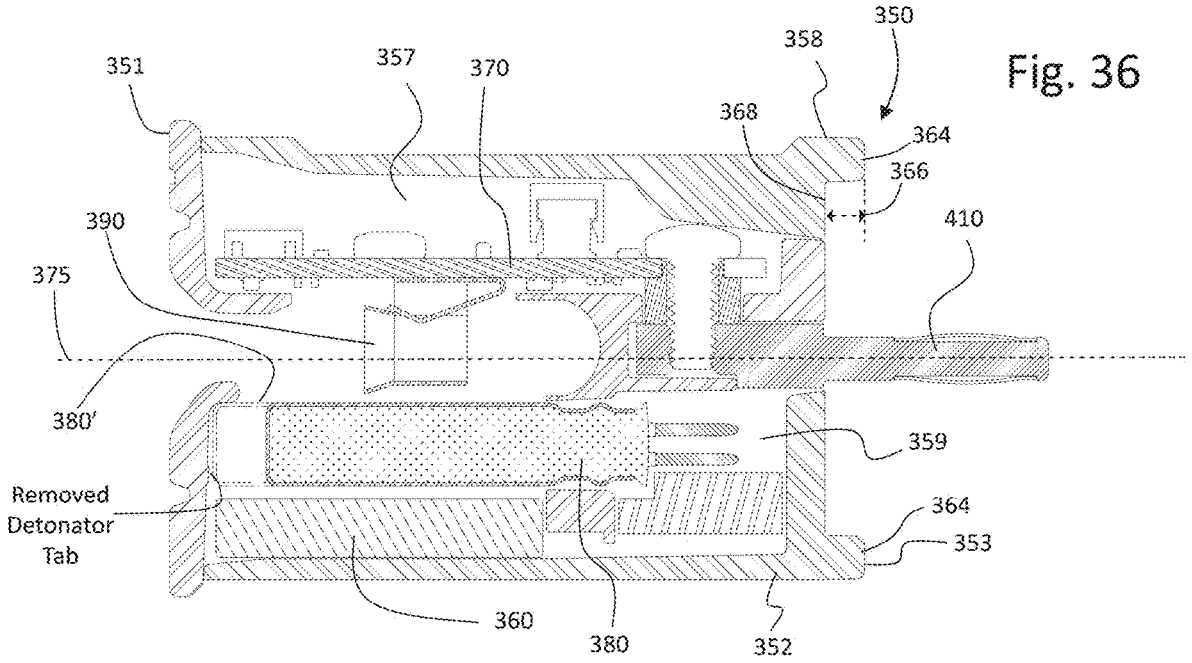
FIG. 36 is a cross section end view of a signal pod from the embodiment shown in FIG. 20 with the reflector in the signal pod and the signal pod in the tandem sub that is screwed inside the gun carrier.
Figure 41:
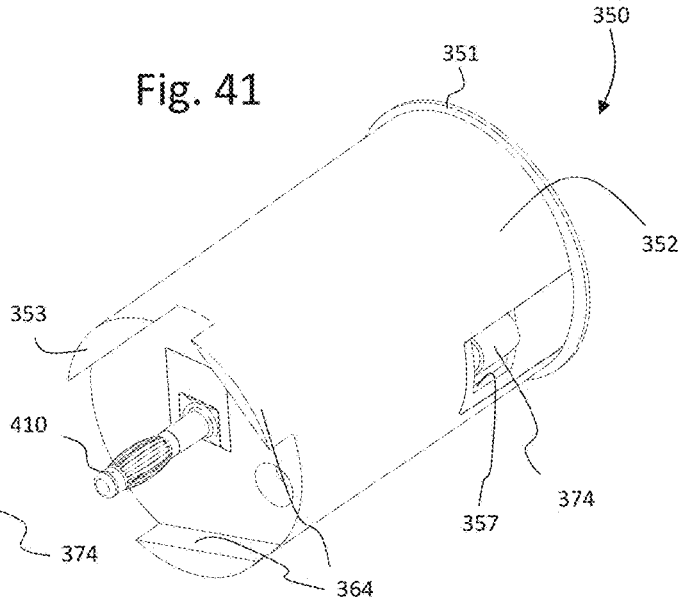
FIG. 41 shows a further embodiment of the present disclosure where a signal provide is designed to control a perf gun at the left of the dual use signal pod but first operate to an igniter for a setting on the right side. These two actuation events occur at different times and it is preferred that the switch inside the signal pod include sensors for confirming that the igniter has been fully lit before the signal pod is used to fire the perf gun.

As shown particularly in FIGS. 36 and 41, in this exemplary embodiment, chassis 352 comprises one or more axially extending standoff legs 364 circumferentially spaced around central axis 355 and located at the axially outer end 353 of chassis 352. In this configuration, standoff legs 364 are located at and project from a longitudinal end (e.g., the downhole longitudinal end) of chassis 352 to contact or otherwise engage an inner surface of a tandem sub (e.g., an internal shoulder of pod cavity 62 of tandem sub 50) when installed therein. An axially extending gap 366 is thereby formed extending between a terminal end of standoff legs 364 and an external recessed surface 368 of chassis 352 located directly adjacent the interior of chassis 352. When loaded into an outer housing such as a tandem sub, standoff legs 364 of the chassis 352 of signal pod 350 engage an inner surface, such as an internal shoulder, of the tandem sub to assist in restricting relative axial movement between the signal pod 350 and the tandem sub. In addition, standoff legs 364 necessarily axially space the interior of chassis 352 from the internal shoulder of the tandem sub against which standoff legs 364 are engaged such that the interior of chassis 352 is axially separated from the internal shoulder by at least the axial gap 366. In some embodiments, axial gap 366 is less than 15 millimeters (mm). In certain embodiments, axial gap 366 is about 4 mm to 8 mm; however, the size of axial gap 366 may vary in other embodiments.

The presence of axial gap 366 extending between the interior of chassis 352 and the internal shoulder (or other inner surface) of the tandem sub prevents at least a limited quantity of liquid (e.g., wellbore fluids) or other dust or debris which may collect on the internal shoulder of the tandem sub from entering the interior of the chassis 352 where the liquid may interfere with the operation of switch 370 and/or detonator 380 such as by, for example, electrically shorting out various electrical signal pathways thereof. For example, as a tandem sub comprising signal pod 350 is lowered vertically through a wellbore, wellbore fluid may slowly leak across one or more seal assemblies of the toolstring comprising the tandem sub, resulting in at least some external liquid collecting within an interior of the tandem sub. Particularly, external liquid may collect along internal surfaces of the tandem sub which project vertically when the tandem sub is in a vertical orientation, such as radially extending shoulders like the internal shoulder against which the standoff legs 364 of chassis 352 engage. Thus, standoff legs 364 serve to lift the interior of chassis 352 vertically above any liquid that may collect within the space occupied by axial gap 366 as the tandem sub comprising signal pod 350 is lowered vertically through the wellbore to a desired location therein. In this manner, standoff legs 364 may assist in maintaining uninterrupted electrical signal connectivity across the signal pod 350 during the deployment thereof downhole.

In this exemplary embodiment, the switch 370 of signal pod 350 is configured to transfer a ballistic signal to a targeted perforating gun coupled to the signal pod 350 to detonate one or more shaped charges of the targeted perforating gun in response to receiving a firing signal associated with the signal pod 350, such as a firing signal addressed to (e.g., uniquely or specifically addressed to) the switch 370 of signal pod 350. In other embodiments, the switch of a given signal pod (e.g., switch 370 of signal pod 350) may perform actions downhole in addition to or other than transferring ballistic signals to the targeted perforating gun. For example, the switch of the signal pod may instead transmit one or more electrical and/or ballistic signals to one or more other pieces of equipment coupled therewith in response to receiving an appropriate command signal. For instance, the switch may instead activate a setting tool of a toolstring incorporating the signal pod 350.

Figure 42:
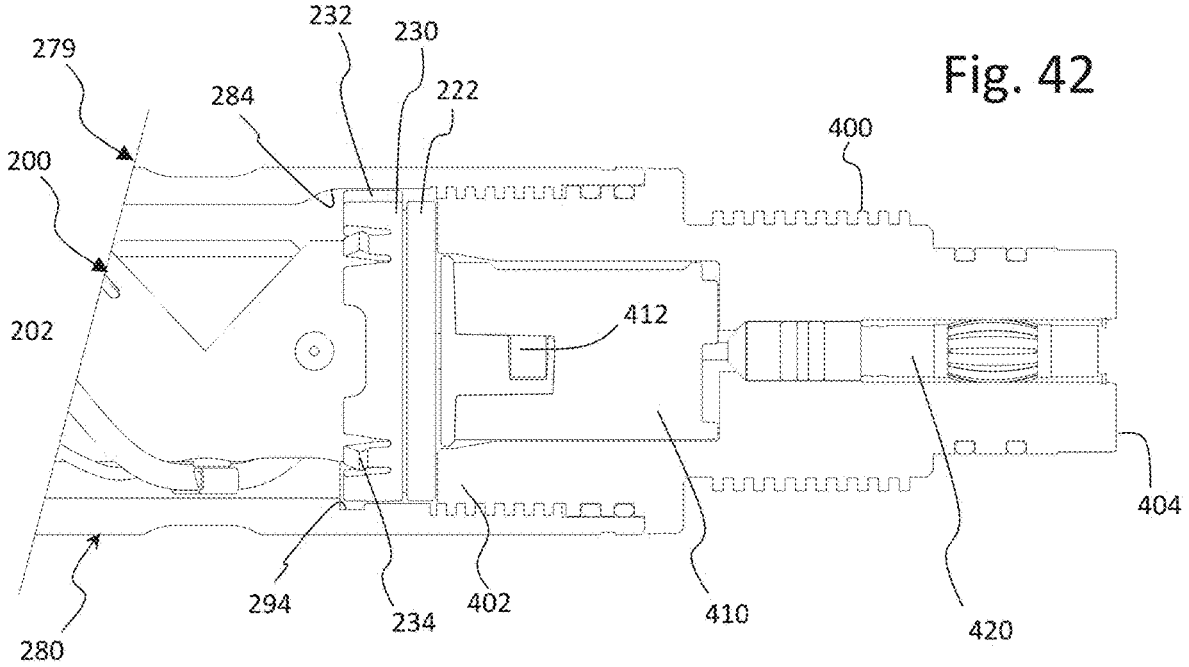
FIG. 42 is a side cross-sectional view of another embodiment of a signal pod.

Referring briefly now to FIG. 42, another embodiment of a tandem sub 400 is shown including a signal pod 410. In this exemplary embodiment, signal pod 410 comprises a switch that may be similar in configuration, at least in some respects, to the switch 380 described above. However, in addition to being configured to detonate a perforating gun (e.g., perforating gun 279 shown in FIG. 42) connected to a longitudinal, uphole end 402 of tandem sub 400. Particularly, the switch 412 of signal pod 410 may also be used to set or activate a setting tool (not shown in FIG. 42) connected to an opposing downhole end 404 of tandem sub 400. Particularly, switch 412 is configured to energize or ignite a setting tool igniter 420 of tandem sub 400 received within a central bore or passage thereof. Setting tool igniter 420 is configured, upon ignition, to activate a setting tool coupled to the downhole end 404 of tandem sub 400 such as by, for example, igniting an energetic element or power charge of the setting tool to pressurize a combustion or expansion chamber of the setting tool. This pressurization of the combustion chamber of the setting tool may drive a piston or sleeve of the setting tool to set a downhole plug connected to the setting tool whereby the plug may anchor and seal against a casing string or other tubular member present in the wellbore.

In some embodiments, switch 412 of signal pod 410 may activate the setting tool (e.g., via igniting setting tool igniter 420) in response to receiving (e.g., from a surface assembly) a first or setting signal, and may detonate the perforating gun 279 coupled to the uphole end 402 of tandem sub 400 in response to receiving (e.g., from the surface assembly) a second or firing signal that is different from the setting signal. In certain embodiments, while the firing signal may be different from the setting signal (e.g., including different instructions or substantive content), both the firing signal and the setting signal may be addressed (e.g., specifically or uniquely addressed) to the same signal pod 410. For example, the firing and setting signals may be addressed to the same switch 412 where, in certain embodiments, switch 412 may comprise a plurality of separate electrical or electronics witches contained in the same signal pod 410 such as being positioned on the same PCB. Therefore, in some embodiments, the setting signal may be addressed to a first switch of signal pod 410 while the firing signal is addressed to a second switch of signal pod 410. Thus, in this manner, switch 412 of signal pod 410 provides for a dual functionality of activating both a setting tool and a perforating gun of a toolstring comprising the signal pod 410 by transmitting both setting and firing signals (e.g., at different points in time) to the same switch 412. Thus, in this manner, switch 412 of signal pod 410 provides for a dual functionality of activating both a setting tool and a perforating gun of a toolstring comprising the signal pod 410 by transmitting both setting and firing signals (e.g., at different points in time) to the same switch 412.

Along with a signal pod such as signal pod 350 shown in FIG. 41, embodiments of tandem subs disclosed herein may include signal pod 350 along with an internal pressure bulkhead such as the pressure bulkhead 160 shown in FIGS. 15, 16 and 17 for electrically connecting the signal pod 350 (or other embodiments of signal pods disclosed herein) to electrical equipment on the opposing axial side (e.g., downhole of) the tandem sub while at the same time providing pressure isolation axially across the pressure bulkhead. As an example, pressure bulkhead 160 may, while restricting the communication of pressure thereacross, electrically connect the electroballistic connector 240 of the charge carrier 200 of a first perforating gun and an electrical connector (e.g., an electrical connector of second endplate 250) of a charge carrier 200 of an adjoining second perforating gun coupled to an opposing longitudinal end of the tandem sub.

Figure 43:
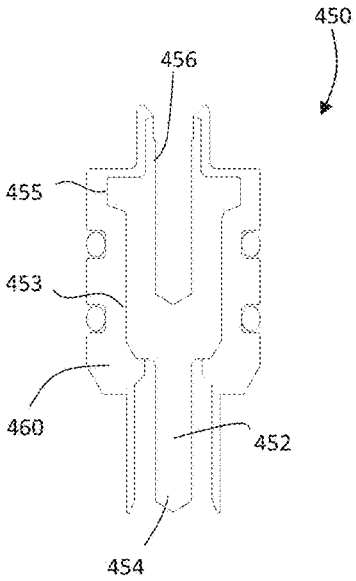
FIGS. 43-45 are front cross sectional views of different embodiments of pressure bulkheads.
Figure 44:
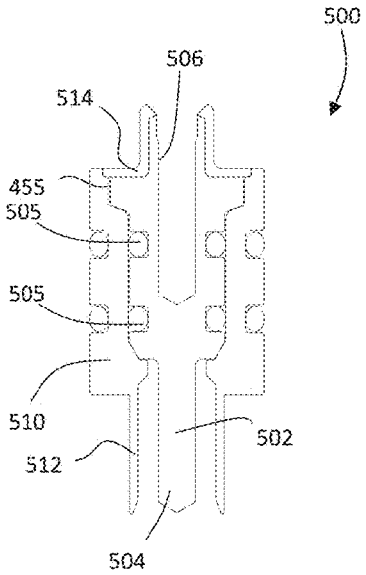
Figure 45:
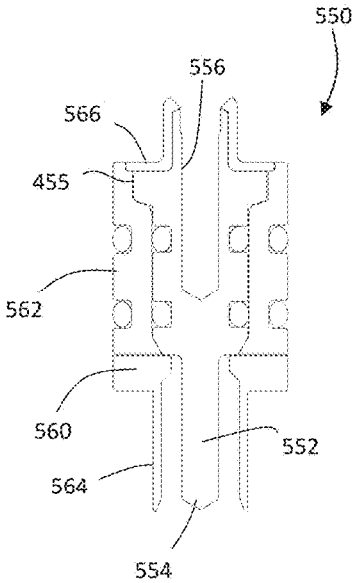

Referring now to FIGS. 43-45, different embodiments of pressure bulkheads 450, 500, and 550, respectively, are shown. Bulkheads 450, 500, and 550 may share features in common with the bulkhead 160 shown in FIGS. 16 and 17. For instance, as with pressure bulkhead 160, pressure bulkheads 450, 500, and 550 may be incorporated into a tandem sub (e.g., tandem sub 50) for restricting the communication of fluid pressure thereacross while at the same time providing electrical connectivity thereacross.

The pressure bulkhead 450 shown in FIG. 43 includes an electrically conductive bulkhead conductor 452, and a surrounding electrically insulating bulkhead insulator 460 sealed against the bulkhead conductor 452. Bulkhead conductor 452 comprises a male or pin connector 454 at a first longitudinal end thereof and a female or box connector 456 at a longitudinally opposed, second longitudinal end thereof.

Bulkhead insulator 460 is overmolded to a radially outer surface 453 of the bulkhead conductor 452 to seal the generally annular interface formed therebetween. Particularly, in this exemplary embodiment, a radially outwards projecting shoulder 455 is formed along the outer surface 453 to resist decoupling (e.g., in response to the application of intense axially directed forces to the pressure bulkhead 450 during operation) or detachment of the bulkhead insulator 460 from the bulkhead conductor 452. In some embodiments, the outer shoulder 455 of bulkhead conductor 452 defines a maximum OD of the bulkhead conductor 452 that is greater than the OD of the bulkhead conductor 452 extending axially from shoulder 455 to the pin connector 454 of conductor 452. In this configuration, interference between outer shoulder 455 of bulkhead conductor 452 and a radially inner surface or ID of bulkhead insulator 470 increases the strength (e.g., resilience to axially directed loads) of the coupling formed between bulkhead conductor 452 and bulkhead insulator 460.

In some applications, it may be preferable to rely on a rigid insulator for the pressure bulkhead rather than an overmolded insulator in order to even minimize the potential for physical separation of the insulator and conductor of the pressure bulkhead. The pressure bulkhead 500 shown in FIG. 44 includes an electrically conductive bulkhead conductor 502, and a surrounding electrically insulating bulkhead insulator 510 sealed against the bulkhead conductor 502. Bulkhead conductor 502 comprises a male or pin connector 504 at a first longitudinal end thereof and a female or box connector 506 at a longitudinally opposed, second longitudinal end thereof. In this exemplary embodiment, bulkhead insulator 510 comprises a rigid polymeric material such as a plastic material (e.g., an injection molded hard plastic) that fits over (e.g., manually slid over) the bulkhead conductor 502 (e.g., with a snug or sliding fit formed therebetween) rather than being overmolded to the bulkhead conductor 502. One or more annular seals (e.g., O-rings) 505 are positioned along the interface formed between bulkhead conductor 502 and bulkhead insulator 510 to seal said interface, preventing the communication of fluid flow or pressure across pressure bulkhead 500.

Specifically, in this exemplary embodiment, bulkhead insulator 510 is formed from two separate insulator members—an outer insulator body 512 and an insulator endcap 514 longitudinally opposite insulator body 512. Insulator body 512 at least partially encloses and electrically insulates the pin connector 504 and the intermediate portion of bulkhead connector 502 extending from pin connector 504 towards box connector while the insulator endcap 514 at least partially encloses and electrically insulates the opposing longitudinal end of bulkhead conductor 502 that forms box connector 506. In some embodiments, insulator endcap 514 may not be directly attached or secured to the insulator body 512, and instead, endcap 514 may be free to travel or slide axially relative to body 512. Instead, relative axial movement between insulator members 512 and 514, and bulkhead conductor 502 may be restricted via engagement between these members and components external pressure bulkhead 500 such as the surrounding tandem sub and/or other components such that members 502, 512, and 514 remain axially locked together.

The pressure bulkhead 550 shown in FIG. 45 includes an electrically conductive bulkhead conductor 552, and a surrounding electrically insulating bulkhead insulator 560 scaled against the bulkhead conductor 552. Bulkhead conductor 552 comprises a male or pin connector 554 at a first longitudinal end thereof and a female or box connector 556 at a longitudinally opposed, second longitudinal end thereof. In this exemplary embodiment, bulkhead insulator 560 comprises a rigid polymeric material such as an injection molded plastic material that fits or slides over the bulkhead conductor 552. In this exemplary embodiment, bulkhead insulator 560 comprises an intermediate insulator member or sleeve 562, a first insulator endcap 564, and a second insulator endcap 566 longitudinally opposite the first insulator endcap 564 with insulator sleeve 562 positioned axially therebetween. First insulator endcap 564 at least partially encloses and electrically insulates the pin connector 554 and the intermediate portion of bulkhead connector 552 extending from pin connector 554 towards box connector while the insulator endcap 564 at least partially encloses and electrically insulates the opposing longitudinal end of bulkhead conductor 552 that forms box connector 556.

Thus, the insulator body 512 of pressure bulkhead 500 has been effectively split, in this exemplary embodiment, into the separate insulator sleeve 562 and first insulator endcap 564. In this manner, any cracks or other damage that forms in the first insulator endcap 564 (e.g., as a result of axially directed impact forces during operation) cannot propagate across the interface formed between the insulator sleeve 562 and first insulator endcap 564. Instead, cracks formed in first insulator endcap 564 must terminate at the inner longitudinal end (e.g., the end adjacent insulator sleeve 562), thereby preserving the structural integrity of insulator sleeve 562 to maintain the operability of pressure bulkhead 550 in spite of the occurrence of damage (e.g., cracking) in the first insulator endcap 564.

Figure 46:
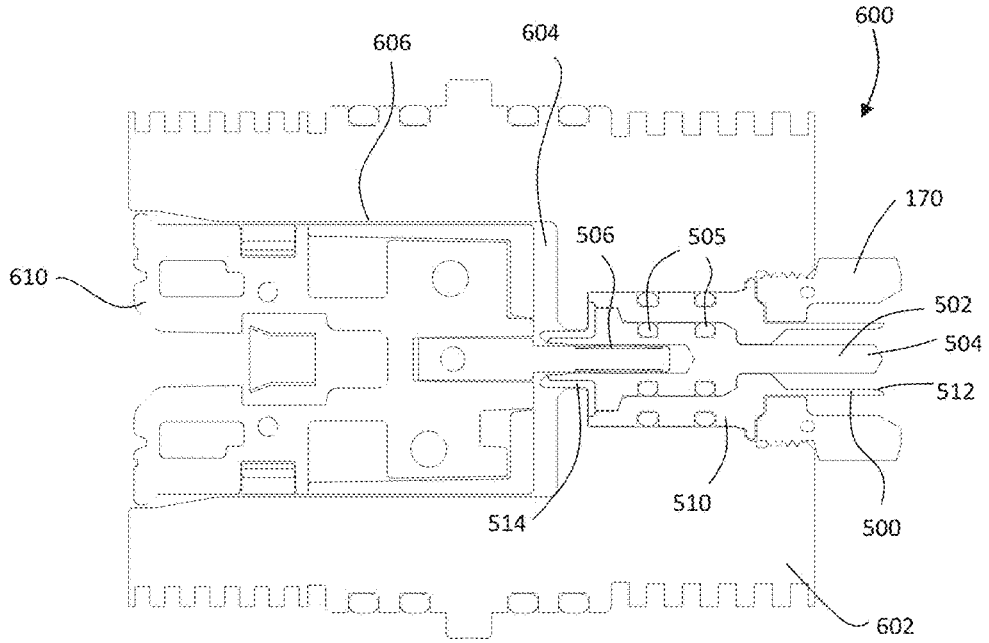
FIG. 46 is a side cross-sectional view of another embodiment of a tandem sub.

Referring to FIG. 46, another embodiment of a tandem sub 600 is shown. Tandem sub 600 may comprise a component of a perforating gun system such as perforating gun systems 37A and 37B shown in FIG. 4). Tandem sub 600 includes an outer sub housing 602, a signal pod 610, and the pressure bulkhead 500. In this exemplary embodiment, signal pod 610 (e.g., similar in configuration to embodiments of signal pods disclosed herein) and pressure bulkhead 500 are each received in an internal (e.g., central) bore or passage 604 defined by an inner surface 606 of sub housing 602. Pressure bulkhead 500 is electrically connected to signal pod 610 and prevents or restricts the communication of fluid flow or pressure across the pressure bulkhead 500. As described above, the bulkhead insulator 510 is not overmolded to the bulkhead conductor 502. Instead, as shown particularly in FIG. 46, the components of pressure bulkhead 500 may be axially trapped by external components such as retainer nut 170 and signal pod 610, in this exemplary embodiment. Particularly, the insulator endcap 514 of bulkhead insulator 510 may be axially trapped between an inner surface 606 of tandem sub 600 defining central passage 602, and the outer shoulder 455 of bulkhead conductor 502. In addition, the insulator body 512 of bulkhead insulator 510 is axially trapped between the inner surface 606 of tandem sub 600 and retainer nut 170 coupled to the tandem sub 600.

Figure 47:
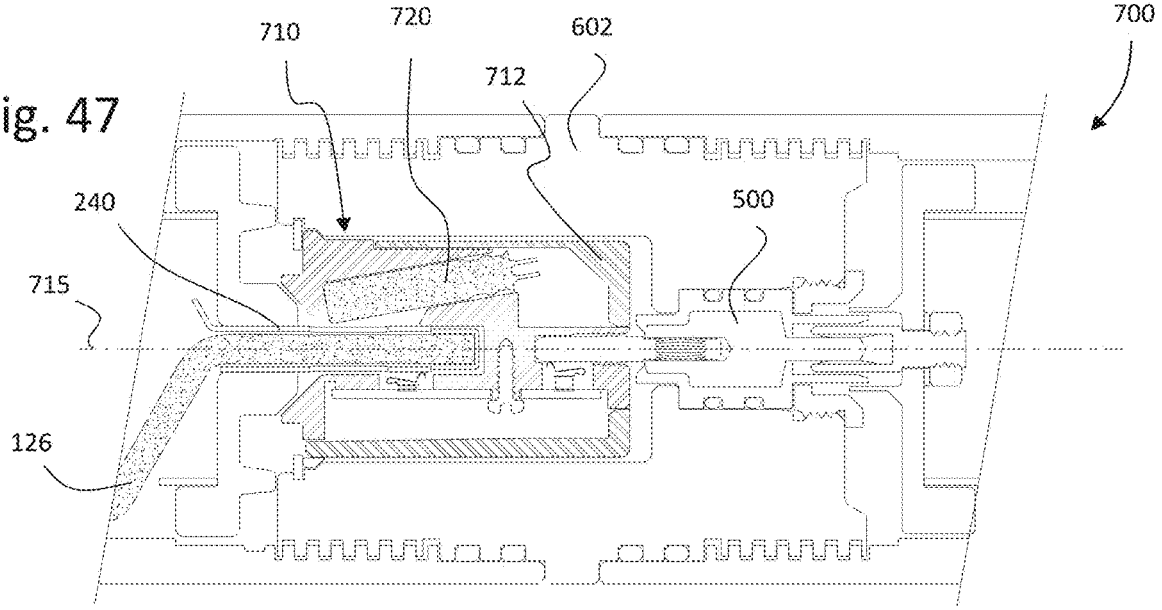
FIG. 47 is a cross sectional elevation view of a signal pod within the tandem sub where the detonator has been oriented at an angle relative to the axis of the tandem sub and, most relevantly, the detonator has been arranged with its base end turned partially toward the detonator cord to thereby direct more of the explosive power from the detonator onto or into the detonator cord thereby taking advantage of the greater ballistic energy emanating from the base end of the detonator.
Figure 48:
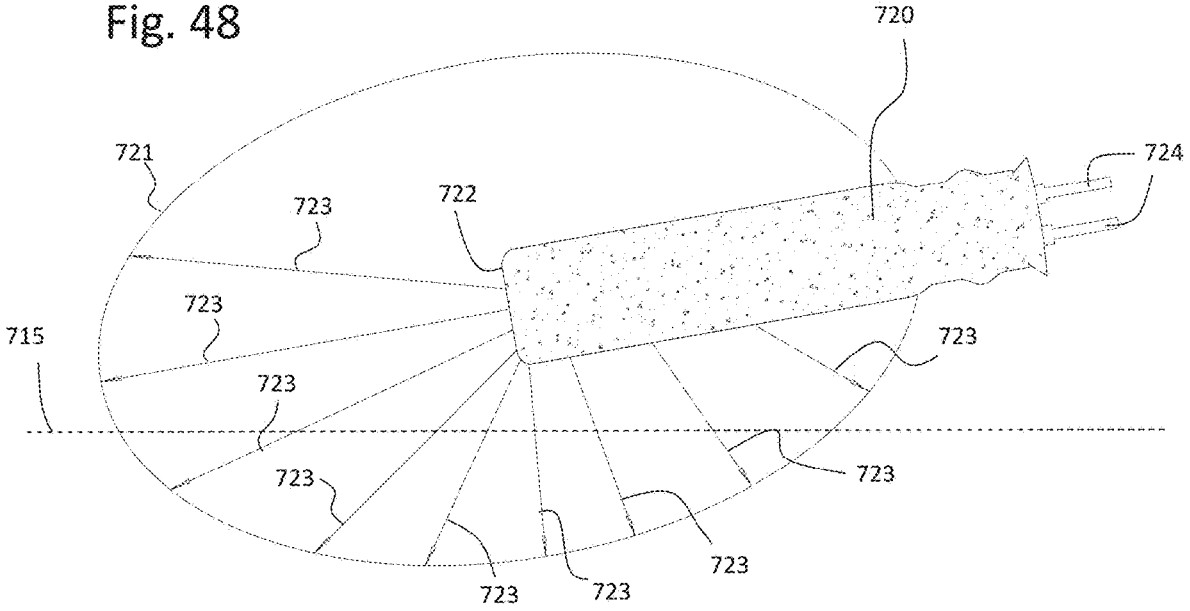
FIG. 48 is a cross sectional elevation view of a detonator with lines indicating what is believed to be the explosive power pressing out from the detonator through an explosive event where the greater explosive power appears to emanate from the base end.

Turning to FIGS. 47 and 48, another embodiment of a tandem sub 700 is shown. Tandem sub 700 may comprise a component of a perforating gun system such as perforating gun systems 37A and 37B shown in FIG. 4). Tandem sub 700 includes sub housing 602, a signal pod 710, and pressure bulkhead 500. Signal pod 710 has a central or longitudinal axis 715 and comprises an pod chassis 712 and a detonator 720 coupled to (e.g., received in) the pod chassis 712. Additionally, detonator cord housing 240 surrounding detonator cord 126 is receivable in the signal pod 710.

In this exemplary embodiment, the exterior chassis 712 of signal pod 710 orients detonator 720 at a non-zero inclination angle (e.g., an acute angle) to longitudinal axis 715 in order to focus the peak ballistic energy generated by detonator 720 in the direction of the detonator cord housing 240 which is laterally spaced (relative longitudinal axis 715) from detonator 720. Ballistic energy produced by detonator 720 may not be uniform but rather biased or focused at a distal end 722 of detonator 720 opposite a pair of electrical contacts 724 of detonator 720 as shown in FIG. 48. Particularly, and not intending to be bound by any particular theory, the ballistic energy produced by detonator 720 may be approximated by the pattern defined by a wave front 721 and a plurality of ballistic energy vectors 723 extending from detonator 720 to the wave front 721. In FIG. 48, the lengths of energy vectors 723 corresponds to the magnitude of the ballistic energy released by detonator 720 in the given direction of the energy vector 723. While there may be slight benefits in some applications to small angles (less than a degree or two) to longitudinal axis 715, the angle formed between detonator 720 and longitudinal axis is about 10 degrees in this exemplary embodiment. In some embodiments, the angle formed between detonator 720 and longitudinal axis 715 is at least five degrees to provide an effective enhancement in focusing the ballistic energy of detonator 720, where additional inclination of detonator 720 may provide further enhancement so long as detonator 720 is able fit at an angle with the space available with the signal pod 710 which is itself constrained by the space within the cavity of the tandem sub 700.

Figure 49:
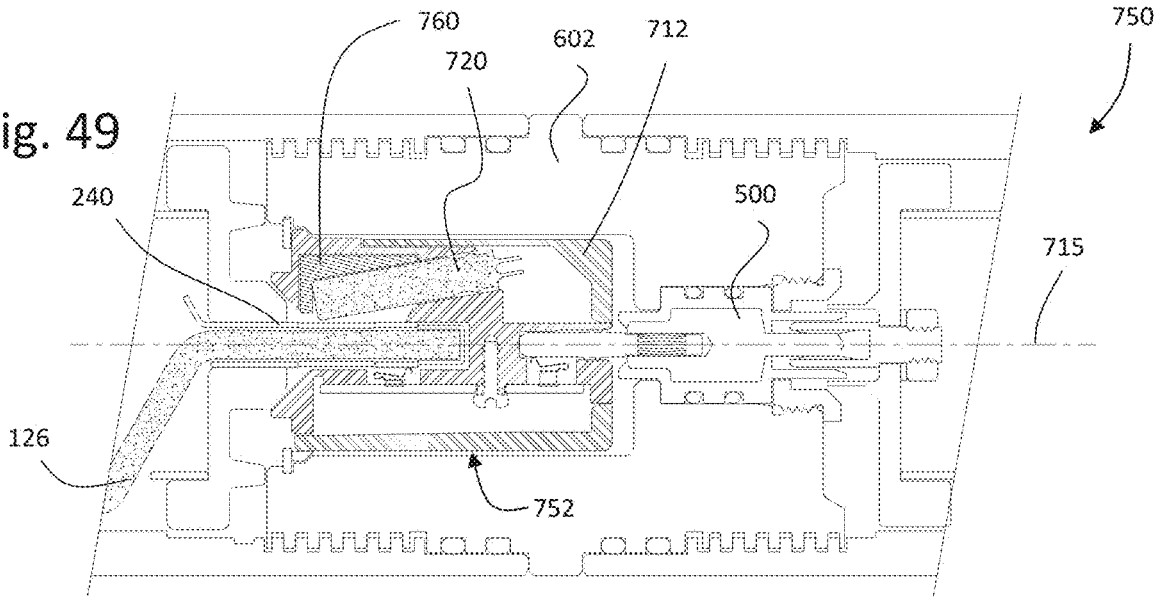
FIG. 49 is a cross sectional elevation view similar to FIG. 48 with the inclusion of a reflector to redirect ballistic energy from the detonator that would otherwise expand away from the axis of the tandem sub and thereby concentrate an even greater portion of the ballistic energy from the detonator onto and into the detonator cord.
Figure 50:
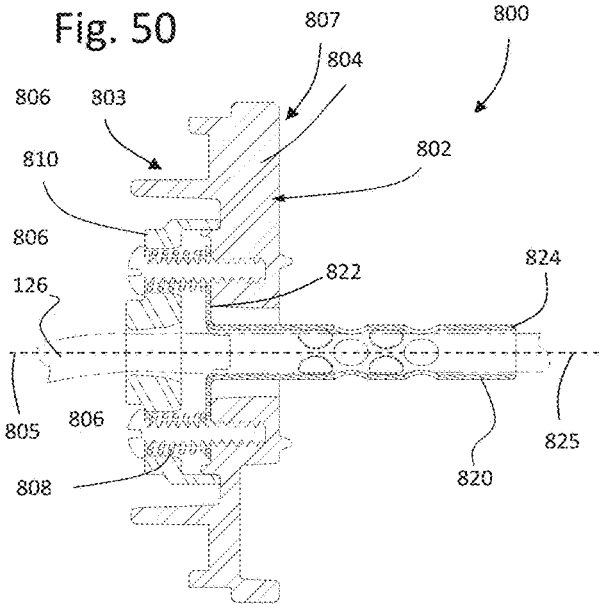
FIG. 50 is a cross sectional elevation view of an end plate oriented such that the charge carrier (not shown) would be on the left and the detonator cord housing is shown to extend to the right for connecting into a signal pod where the connection of the detonator cord housing to the end plate includes captured springs to provide bending and shifting flexibility.
Figure 51:
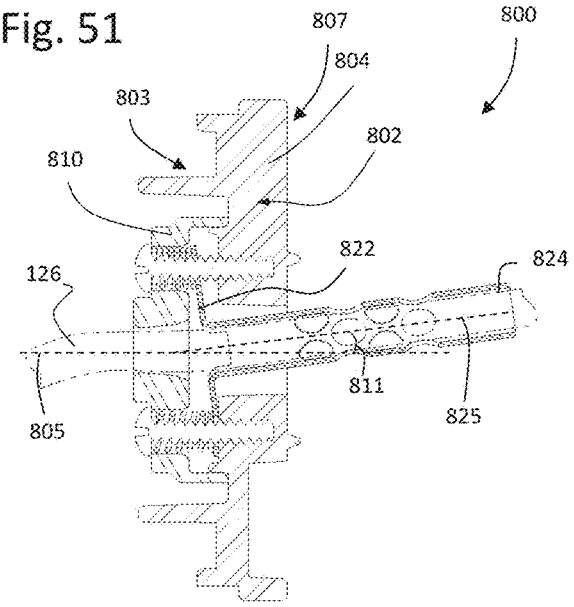
FIG. 51 is a similar cross sectional elevation view of the end plate and detonator cord housing where the distal end of the detonator cord housing has been displace upwardly and the upper spring has been compressed absorbing and accommodating the force applied to the distal end of the detonator cord housing.
Figure 52:
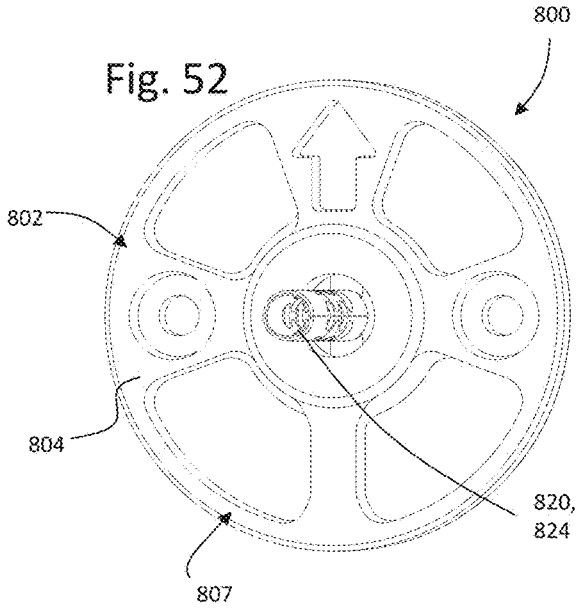
FIG. 52 is a slight perspective view of the detonator cord housing projecting from the end plate where the opening through which the detonator cord housing is positioned is large enough to accommodate movement of the detonator cord housing while still being fully connected to the end plate and being fully functional and operative in a perforating guns.
Figure 53:
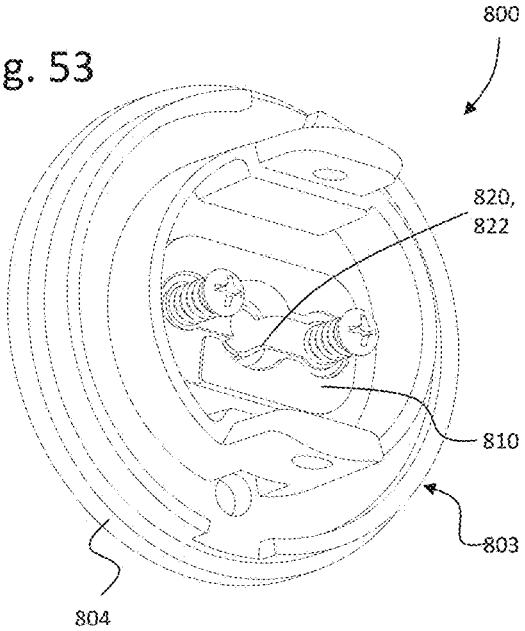
FIG. 53 is another perspective view of the back face of the end plate with parts removed to show the springs captured around the screws.

Turning to FIG. 49, another embodiment of a tandem sub 750 is shown. Tandem sub 750 may comprise a component of a perforating gun system such as perforating gun systems 37A and 37B shown in FIG. 4). Additionally, tandem sub 750 includes features in common with tandem sub 700 shown in FIGS. 47 and 48, and shared features are labeled similarly. Particularly, tandem sub 750 is similar to tandem sub 700 except that a signal pod 752 of tandem sub 750 is provided with a blast reflector 760 received in the pod chassis 712 of signal pod 752. In this exemplary embodiment, the ballistic energy generated by detonator 720 is further enhanced by reflecting stray (e.g., oriented or extending away from detonator cord 126) ballistic energy by blast reflector 760 which redirects the stray ballistic energy towards the detonator cord 126 to maximize the portion of the ballistic energy released by detonator 720 that is oriented or extends towards detonator cord 126.

Turning now to FIGS. 50-60, in at least some instances, significant bending forces may be applied to perforating gun systems of a toolstring when lifting the toolstring as part of deploying the toolstring into a wellbore. Particularly, in some applications, these bending forces may be concentrated at the interface formed between the detonator cord housings and the corresponding signal pods of the perforating gun systems. These bending forces may interfere with the operation of the perforating gun systems of the toolstring by, for example, damaging the detonator cord housing or otherwise potentially interfering with the operation of the detonator cord housing. Accordingly, FIGS. 50-60 illustrate embodiments of charge carriers 800 (shown in FIGS. 50-53, 850 (shown in FIG. 54), 900 (shown in FIGS. 55 and 56), 920 (shown in FIG. 57), 950 (shown in FIG. 58), and 960 (shown in FIGS. 59 and 60). Charge carriers 800, 850, 900, 920, 950, and 960 are only partially shown in FIGS. 50-60 such that charge carriers 800, 850, 900, 920, 950, and 960 may include additional features not shown in FIGS. 50-60 such as a carrier chassis, one or more shaped charges, and a detonating cord. Particularly, charge carriers 800, 850, 900, 920, 950, and 960 are configured to provide additional flexibility for accommodating the bending forces described above.

Particularly, the charge carrier 800 shown in FIGS. 50-53 generally includes an endplate 802 and a detonator cord housing 820 pivotably coupled to the endplate 802 and configured to receive a terminal end of a detonator cord of charge carrier 800. Endplate 802 has a longitudinal axis 805, a first or proximal side 803, and an opposing second or distal side 807. Endplate 802 may couple to a carrier chassis at the proximal side 803 thereof with distal side 807 located external the carrier chassis. Additionally, in this exemplary embodiment, comprises a first member 804 and a second member 810 coupled to the first member 804 to form endplate 802. Detonator cord housing 820 has a longitudinal axis 825, a first or proximal end 822 coupled to endplate 802 and an opposing second or distal end 824 projecting outwardly from the distal side 807 of endplate 802.

In this exemplary embodiment, second member 810 comprises a spring cover that is coupled to the proximal side 803 of outer member 804 by one or more fasteners (e.g., threaded fasteners such as screw fasteners) 806 forming a compartment or cavity 809 longitudinally between the distal side 807 of second member 810 and the proximal side 803 of first member 804. The proximal end 822 of detonator cord housing is received in cavity 809, trapped between the distal side 807 of second member 810 and the proximal side 803 of first member 804. Additionally, in this exemplary embodiment, each fastener 806 each "spring loaded" or biased longitudinally outwards against the distal side 807 of second member 810 and the proximal side 803 of first member by one or more corresponding mechanical springs or biasing members 808 which are positioned or extend around their corresponding fasteners 806. In this exemplary embodiment, biasing members may comprise metallic springs such as coil springs, washers, and the like. However, the configuration of biasing members 808 may vary in other embodiments.

Biasing members 808 press the proximal end 822 of detonator cord housing 820 against the proximal side 803 of first member 810 to maintain electrical contact therebetween in spite of vibration and other environmental effects that could otherwise break the electrical connection formed between endplate 802 and detonator cord housing 820. Additionally, biasing members 808 permit second member 810 to move (e.g., by a predefined degree) relative to first member 804 whereby the longitudinal axis 825 of detonator cord housing 820 is permitted to angularly misalign with the longitudinal axis 805 of endplate 802 whereby a non-zero misalignment angle 811 (e.g., an acute angle) is formable between axes 805 and 825. For example, a bending moment applied to the distal end 824 of detonator cord housing 820 may result in rotation (e.g., about one or more lateral or radially extending axes relative longitudinal axis 805) of detonator cord housing 820 relative to endplate 802 thereby forming misalignment angle 811. In some embodiments, the misalignment angle 811 is approximately between. In addition to permitting the formation of misalignment angle 811, biasing members 808 also provide a restoring torque to detonator cord housing 820 in response to the formation of misalignment angle 811, the restoring torque urging detonator cord housing 820 back into alignment (with misalignment angle 811 being eliminated or reaching substantially zero) with the longitudinal axis 805 of endplate 802.

Figure 54:
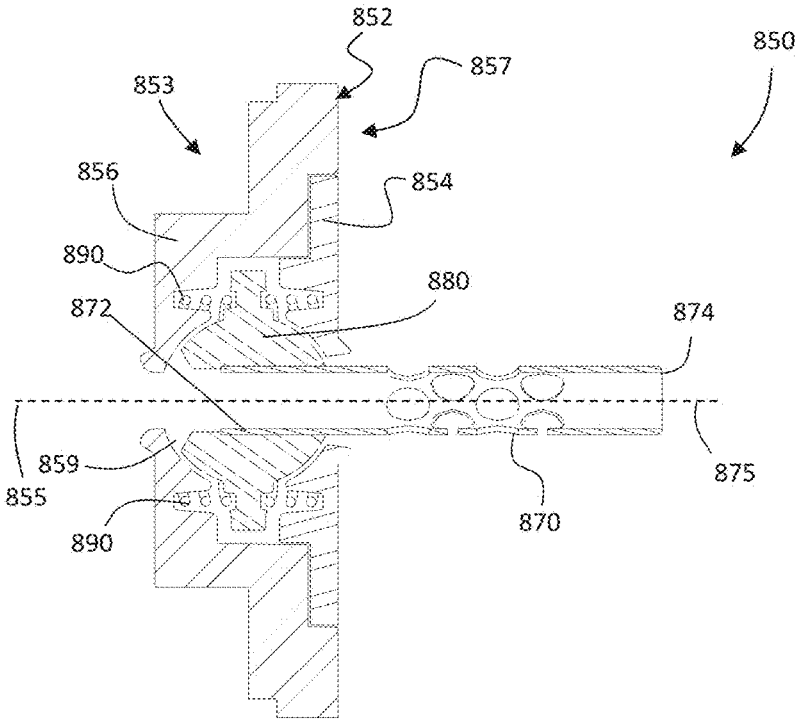
FIG. 54 is a cross sectional elevation view similar to FIG. 50 of an alternative embodiment with a generally spherical shaped base and springs for enabling flexibility of the detonator cord housing with the end plate.

The charge carrier 850 shown in FIG. 54 is similar in configuration to charge carrier 800 shown in FIGS. 50-53 and generally includes an endplate 852 (having opposing proximal and distal sides 853 and 857, respectively, and comprising a first member 854 and a second member 856 coupled together) and a detonator cord housing 870 (having opposing proximal and distal ends 872 and 874, respectively) that is pivotably coupled to the endplate 852 whereby detonator cord housing 870 is permitted to rotate about one or more separate axes relative to endplate 852.

Particularly, in this exemplary embodiment, charge carrier 850 additionally includes a generally spherical or "ball" connector 880 located in a generally spherical compartment 859 that is formed longitudinally between first member 854 and second member 856 of endplate 852. Ball connector 880 is coupled to the proximal end 872 of detonator cord housing 870 such that ball connector 880 and detonator cord housing 870 are pivotable in concert relative to endplate 852. Given that ball connector 880 is at least partially defined by a spherical outer surface while compartment 859 is at least partially defined by a corresponding spherical inner surface, ball connector 880 along with detonator cord housing 870 are permitted to rotate about an unlimited number of axes relative to members 854 and 856 of endplate 852. In other words, ball connector 880 and spherical compartment 859 form a ball joint between the endplate 852 and detonator cord housing 874.

Additionally, in this exemplary embodiment, charge carrier 850 comprises one or more biasing members 890 positioned in spherical compartment 859 extending circumferentially around (e.g., continuously as a single biasing member 890 or arcuately as a plurality of circumferentially spaced biasing members 890) ball connector 880 to provide a restoring torque to the detonator cord housing 870 urging a longitudinal axis 875 of housing 870 towards a longitudinal axis 855 of endplate 852 in response to pivoting of the detonator cord housing 870 relative to endplate 850. Additionally, given that biasing members 890 extend circumferentially around ball connector 880 (e.g., and is thus circumferentially symmetrical in some embodiments), biasing members 890 are configured to provide a substantially equal restoring force to the detonator cord housing 870 irrespective of the direction (e.g., the azimuth) of the misalignment formed between the longitudinal axes of endplate 852 and detonator cord housing 870. In this exemplary embodiment, biasing members 890 may comprise metallic springs such as coil springs, washers, and the like. However, the configuration of biasing members 890 may vary in other embodiments.

In some embodiments, ball connector 880 is configured to move or pivot freely within the spherical compartment 859 of endplate 852 while also having a somewhat loose fit therein to additionally accommodate radial movement of the proximal end 872 within spherical compartment 859 whereby a non-zero radial or lateral offset is formable (e.g., in response to the application of a laterally directed force against the detonator cord housing 870) between the longitudinal axis 855 of endplate 852 and the longitudinal axis 875 of detonator cord housing 870. Thus, in some embodiments, both a misalignment angle and/or a radial offset may form between axes 855 and 875 in response to the application of external forces to detonator cord housing 870 where this additional degree of flexibility minimizes the potential for the application of excessive stress to the detonator cord housing 870 which could damage or otherwise interfere with the desired operation of housing 870.

Figure 55:
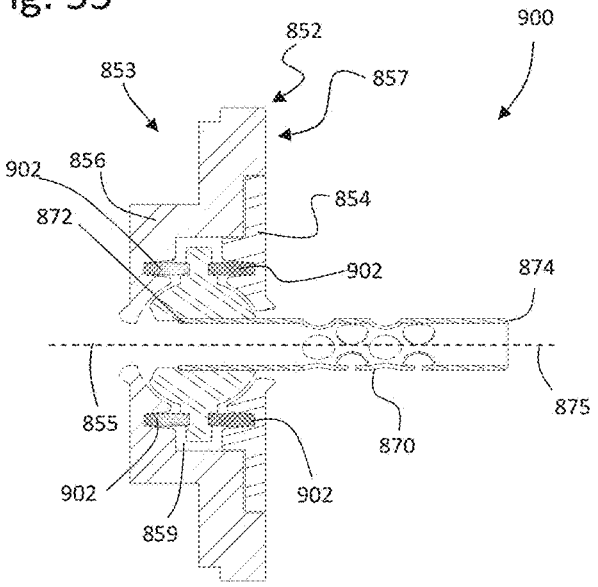
FIG. 55 is a further cross sectional elevation view of a further embodiment similar to FIG. 54 that includes a spherical shaped base but with rubber or elastic components rather than springs to bias the detonator cord housing back toward axial alignment with the end plate.
Figure 56:
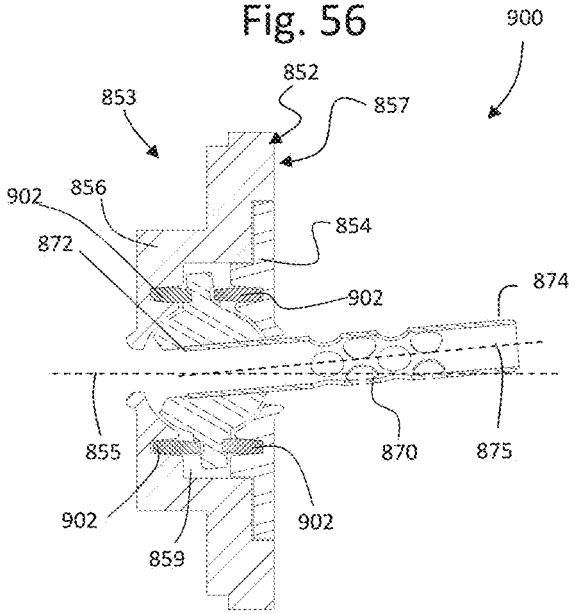
FIG. 56 is a cross sectional view of the embodiment shown in FIG. 55 with the detonator cord housing deflected upward at the distal end and the rubber or elastic components in either a slack or compressed condition.

The charge carrier 900 shown in FIGS. 55 and 56 is similar in configuration to the charge carrier 850 shown in FIG. 54 and includes endplate 852, detonator cord housing 870, and ball connector 880. However, in this exemplary embodiment, rather than including biasing members 890, charge carrier 900 includes a plurality of elastomeric biasing members 902 each positioned in spherical compartment 859 of endplate 852 to apply a restoring biasing force to the detonator cord housing 870 through the ball connector 880 (e.g., via flanged or other engagement surfaces of ball connector 880 as shown in FIGS. 55 and 56). In some embodiments, elastomeric biasing members 902 comprise a polymer, rubber, or other elastic material to provide the biasing or restoring force (e.g., in response to elastic deformation of the biasing member 902 as a result of pivoting of the ball connector 880 relative to endplate 852) to urge the longitudinal axis 875 of detonator cord housing 870 back into alignment (e.g., radial and/or angular) with the longitudinal axis 855 of endplate 852.

Figure 57:
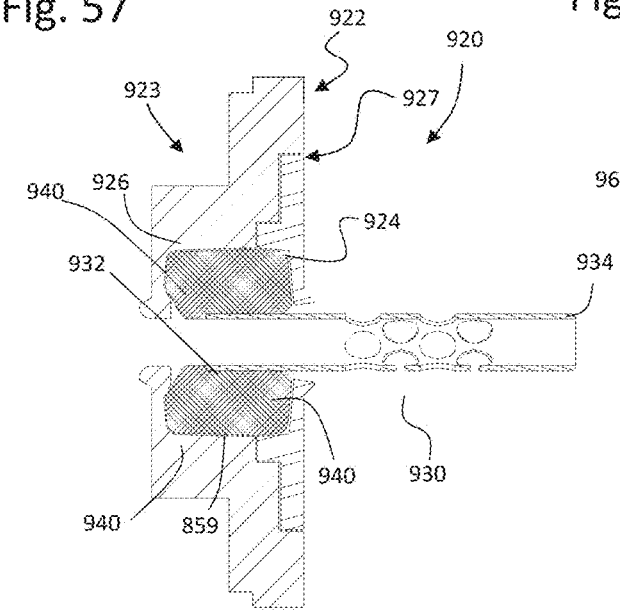
FIG. 57 is a cross sectional elevation view of further additional embodiment intended to address an issue when forces may act upon the signal pod to move or bend the detonator cord housing where the detonator cord housing is squeezed into a donut shaped rubber or elastic body which biases the detonator cord housing toward the axis of the end plate (and thereby the perforating gun to which they are attached) while accommodating bending and radially imposed shifting forces.

The charge carrier 920 shown in FIG. 57 generally includes an endplate 922 (having opposing proximal and distal sides 923 and 927, respectively, and comprising a first member 924 and a second member 926 coupled together) and a detonator cord housing 930 (having opposing proximal and distal ends 932 and 934, respectively) that is pivotably coupled to the endplate 922 whereby detonator cord housing 930 is permitted to rotate about one or more separate axes relative to endplate 922. Additionally, in this exemplary embodiment, charge carrier 920 comprises one or more biasing members 940 positioned in a compartment 928 formed longitudinally between the members 924 and 926 of endplate 922. Particularly, in this exemplary embodiment, biasing member 940 comprises an annular or donut shaped elastomeric body having a snug fit in compartment 859. The donut shaped body provides flexibility in almost all directions with most limitations being from right to left in the Figure.

Figure 58:
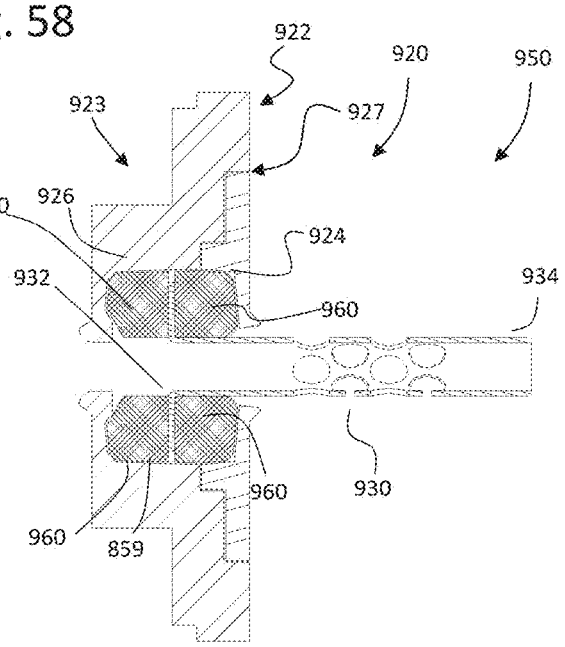
FIG. 58 is a cross sectional elevation view of a further additional embodiment similar to FIG. 57 where the detonator cord housing is provided with radially oriented wings and two donut shaped rubber or elastic bodies are positioned on opposite sides of the wings to create a slightly differently oriented biasing force back to the axis of the end plate.
Figure 59:
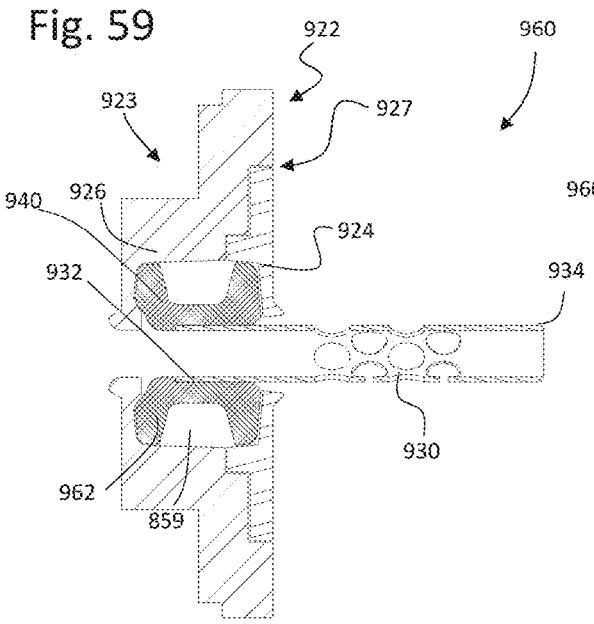
FIG. 59 is a cross sectional elevation view of a still further embodiment of the end plate and detonator cord housing where the detonator cord housing is squeezed into a through hole of a spool shaped elastic or rubber body where the end flanges of the spool shaped body are sized to provide an optimal righting force taking into consideration the elastic modulus or other properties.
Figure 60:
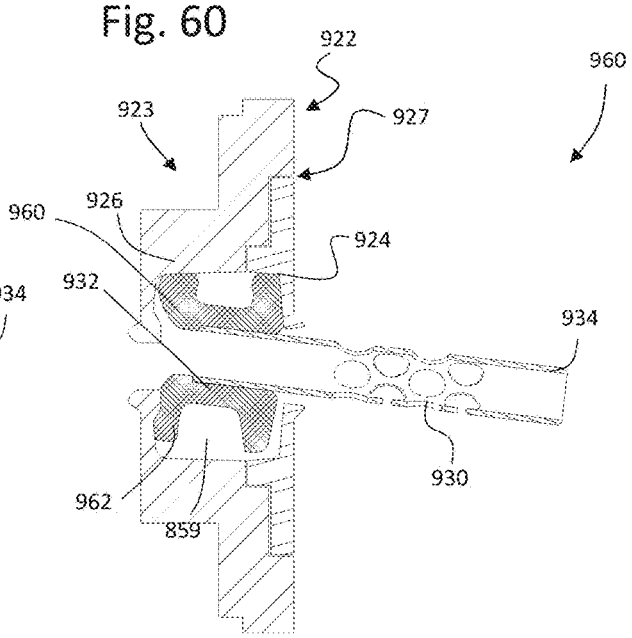
FIG. 60 is a cross sectional elevation view of the embodiment shown in FIG. 59 where the distal end of the detonator cord housing has been deflected downwardly while the opposite end is deflected upwardly within the void space of the end plate while the elastic deformation of the spool shaped body resists such forces and movement but accommodates the same without plastic deformation.

The charge carrier 950 shown in FIG. 58 is similar to charge carrier 920 except that it includes a pair of relatively thinner elastomeric biasing members 960. Biasing members 960 are positioned on either side of tabs extending radially outwardly at the proximal end 932 of detonator cord housing 930 in this exemplary embodiment. The flat faces of the donut shaped bodies impose resistant forces on the tabs. The charge carrier 960 shown in FIGS. 59 and 60 includes an annular elastomeric biasing member 962 having a spool-shaped elastomeric body.

One particularly important aspect of the embodiments of perforating gun systems disclosed herein is that they do not require any angular clocking or adjustment of rotational orientation to assemble. As such, embodiments of perforating gun systems described herein are amenable to automated or at least partially-automated assembly to streamline the process of assembling the perforating gun systems in the field.

Figure 61:
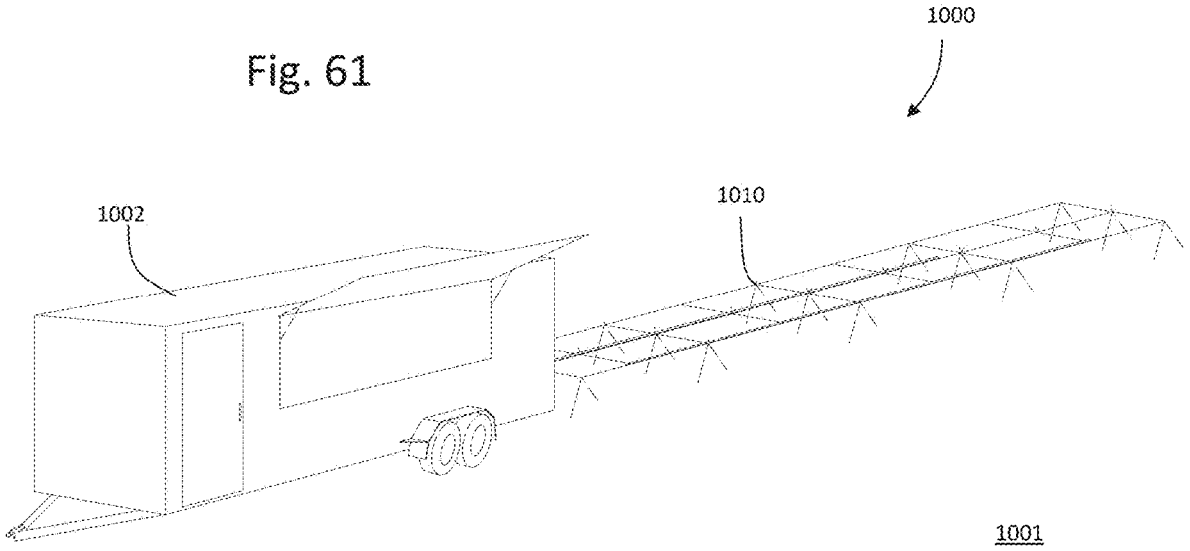
FIG. 61 is perspective view of an automated assembly system for assembling perforating guns together to form a gun string or toolstring in the well completion operations of a hydrocarbon well.
Figure 62:
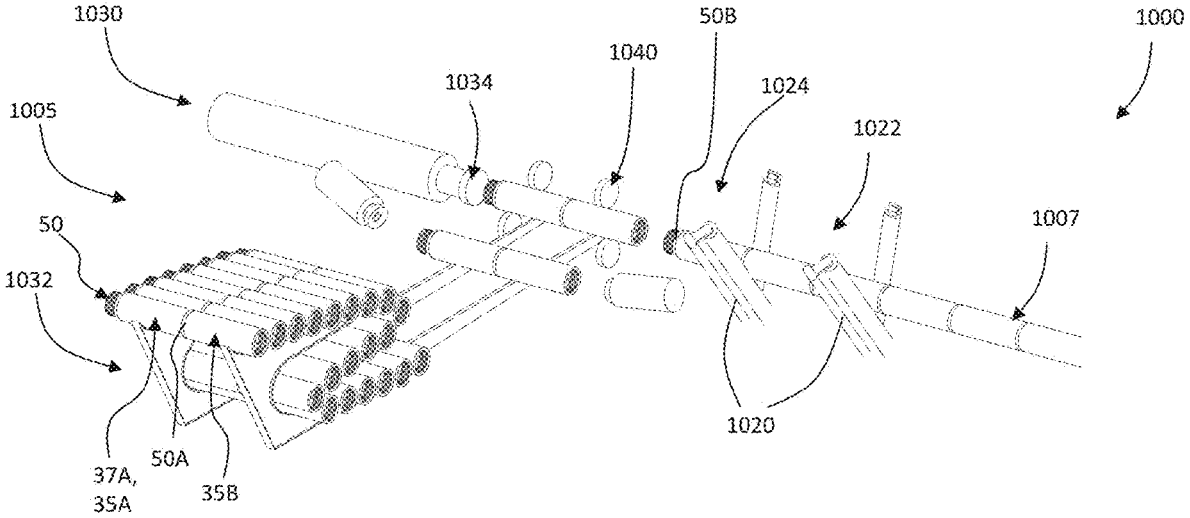
FIG. 62 is a perspective view of the principle elements or components of an automated assembling system which is made practical by the signal pod and detonator cord housing system of connecting perforating guns without rotational limitations.
Figure 63:
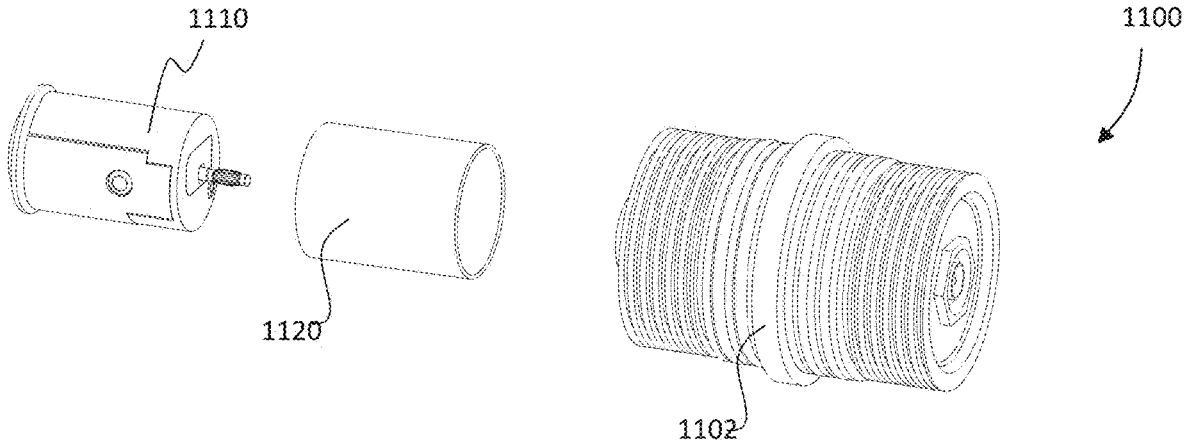
FIG. 63 is an exploded view of another embodiment of a tandem sub.
Figure 64:
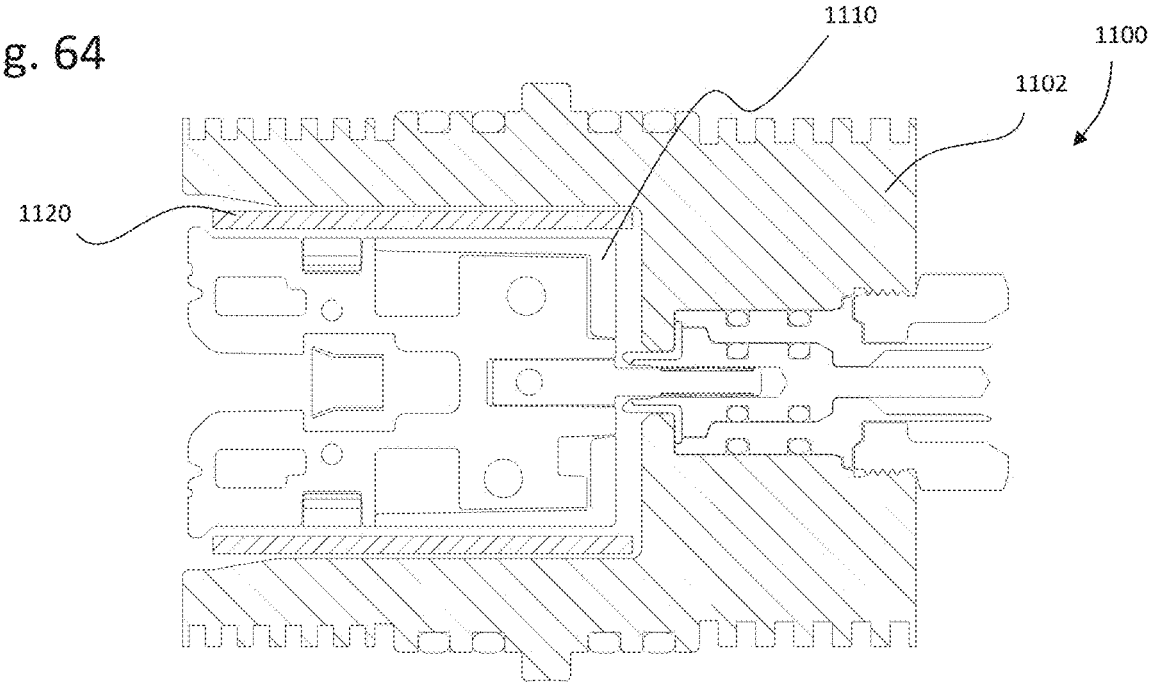
FIG. 64 is a side cross-sectional view of the tandem sub of FIG. 63.

Referring now to FIGS. 61 and 62, an at least partially automated system 1000 for assembling perforating gun systems such as, for example, perforating gun systems 37. In some embodiments, system may also facilitate the assembly of toolstrings formed from the assembled perforating gun systems 37 and ancillary components. While system 1000 is described herein in conjunction with perforating gun systems 37, in other embodiments, system 1000 may be used to assemble perforating gun systems which vary in configuration from perforating gun systems 37. For example, system 1000 may be used to assemble perforating gun systems not including a separate tandem sub but instead incorporate the signal pod of the perforating gun system with the corresponding perforating gun thereof in other ways such as by incorporating the signal pod directly into or with the perforating gun.

In this exemplary embodiment, system 1000 generally includes a transportable (e.g., road transportable) vehicle or trailer 1002, a support platform 1010, a toolstring equipment conveyor 1020, and an at least partially automated tool assembler or loader 1030. Trailer 1002 may provide sufficient space for transporting toolstring equipment while also providing shelter to operators of the toolstring when out in the field where ambient conditions can be extreme (e.g., extreme temperatures, weather events). For example, trailer 1002 may be enclosable from the surrounding environment and may include heating, ventilation, and air-conditioning (HVAC) equipment for regulating the internal environment of the trailer 1002.

In this exemplary embodiment, equipment of a toolstring (e.g., toolstring 30 shown in FIG. 3) may be transported to a wellsite 1001 corresponding to the location of a wellbore (e.g., wellbore 10 shown in FIG. 3) extending through a subterranean earthen formation (e.g., formation 3 shown in FIG. 3). The toolstring equipment transported in trailer 10002 includes a plurality of perforating gun systems 37. In some embodiments, the plurality of perforating gun systems 37 are transported from a remote location to the wellsite 1001 in or using the trailer 1002 with the plurality of perforating gun systems 37 in a transport state or configuration in which one or more shaped charges 125 are "pre-wired" or otherwise ballistically coupled with the corresponding detonator cord 126 of the perforating gun system 37. For example, the often manually intensive task of ballistically connecting a flexible detonator cord 126 with a plurality of shaped charges 125 may be labor intensive and thus best (e.g., most rapidly with the least amount of errors or other issues) performed at a remote location in a controlled environment like, for example, a workshop. In some embodiments, the detonator 158 of the perforating gun system 37 may similarly be pre-wired or otherwise electrically connected with the corresponding electrical switch 155 of the system 37 with the perforating gun system 37 remaining in the transport state whereby the detonator 158 is placed in signal communication with the electrical switch 155.

While allowing for the convenient pre-wiring of the shaped charges 125 and detonating cord 126 of the perforating gun system 37 prior to transport to the wellsite 1001, the transport state of each perforating gun system 37 also ensures the given perforating gun system 37 is safe for transport (e.g., to ensure the shaped charges 125 of the perforating gun systems 37 are not inadvertently detonated) to the wellsite 1001 and, in some applications, to comply with applicable transportation regulations governing transportation routes (e.g., public roadways and the like) used when transporting the perforating gun systems 37 to the wellsite 1001. Particularly, in this exemplary embodiment, in the transport state of each perforating gun system 37 the detonator cord 126 and the shaped charges 125 thereof are each ballistically decoupled (e.g., not in ballistic communication) from the detonator 158 of the perforating gun system 37 such that the detonator 158 may not inadvertently detonate or otherwise activate either the detonating cord 126 or the shaped charges 125 of the perforating gun system 37.

The associated equipment of system 1000 including, for example, support platform 1010, toolstring equipment conveyor 1020, and tool assembler 1030 facilitate the transformation of perforating gun systems 37 (transported or shipped from a remote location in trailer 1002 while in the transport state) from the transport state to a deployment state or configuration following the arrival of the perforating gun systems 37 to the wellsite 1001. In this exemplary embodiment, when in the deployment state, the detonator of the perforating gun system 37 enters into ballistic communication (e.g., becomes ballistically coupled) with the corresponding detonating cord 126 and shaped charges 125 of the system 37. In some embodiments, when in the deployment state, the shaped charges 125 may be detonated automatically in response to the electrical switch 155 of the perforating gun receiving an appropriate firing signal.

In some embodiments, support platform 1010, toolstring equipment conveyor 1020, and tool assembler 1030 may also facilitate the assembly of the toolstring comprising the plurality of perforating gun systems 37 transported to the wellsite 1001 in trailer 1002, where the assembled toolstring may be lifted and deployed into a wellbore using a corresponding deployment system such as a wireline system (e.g., wireline system 5 shown in FIG. 1).

In this exemplary embodiment, support platform 1010 comprises a platform upon which toolstring equipment, including the plurality of perforating guns transported to the wellsite 1001 in the transport state, may be laid out prior to assembly or for other sundry uses. Additionally, in this exemplary embodiment, toolstring equipment conveyor 1020 provides an elongate path or track 1022 along which toolstring equipment may be transported as it is assembled by the tool assembler 1030. In this exemplary embodiment, toolstring equipment conveyor 1020 simply comprises a plurality of angled supports for directing the assembled toolstring equipment along the assembly track 1022. Alternatively, toolstring equipment conveyor 1020 may comprise a powered conveyor (e.g., a conveyor belt and the like) for transporting the assembled toolstring equipment in the direction of the wellbore of the wellsite 1001.

In this exemplary embodiment, tool loader 1030 generally includes a loading track 1032, a linear actuator 1034, and a rotary actuator 1040. In some embodiments, the equipment of tool loader 1030 such as, for example, actuators 1034 and 1040 are operated by a computer system or controller, such as one located in trailer 1002 or even remote of the wellsite 1001. Toolstring equipment such as perforating gun systems 37 may be initially loaded onto the loading track 1032 as a staging location for the perforating gun systems 37 prior to being loaded onto toolstring equipment conveyor 1020. Particularly, in this exemplary embodiment, each of the perforating gun systems 37 may be initially assembled (e.g., at the support platform 1010) into perforating gun kits 1005 each comprising an uphole tandem sub 50A, a downhole perforating gun 35B, and a perforating gun system 37 sandwiched or coupled (e.g., rotatably or threadably coupled) between the uphole tandem sub 50A and the downhole perforating gun 35B. In some embodiments, the resulting toolstring may comprise a plurality of the assembled perforating gun kits 1005 positioned therealong.

In some embodiments, forming perforating gun kits 1005 may include transitioning at least some of the perforating gun systems 37 from the transport state to the deployment state. Referring briefly to FIG. 5, an exemplary perforating gun kit is shown that includes uphole perforating gun system 37A in an exemplary deployment state and the perforating gun 35B of a corresponding downhole perforating gun system 37B remains in the transport state. In some embodiments, uphole perforating gun system 37A is transported to the wellsite 1001 in a transport state in which the uphole perforating gun 35A is mechanically connected with the uphole tandem sub 50A (corresponding to a separate perforating gun system 37 from uphole perforating gun system 37A) as shown in FIG. 5 but mechanically disconnected from the tandem sub 50A shown in FIG. 5. In some embodiments, each perforating gun system 37 may be shipped in a transport state in which a perforating gun 35 of a first perforating gun system 37 is mechanically (e.g., threadably) connected (e.g., at an uphole end of the perforating gun 35) and in electrical signal communication with a tandem sub 50 of a second perforating gun system 37. However, in this exemplary embodiment, when in the transport state, the perforating gun 35 of the first perforating gun system 37 is not similarly mechanically connected with its corresponding tandem sub 50 at the downhole end thereof. Instead, for example, tandem sub 50A corresponding to perforating gun system 37B may be mechanically connected with the downhole end of its corresponding perforating gun system 37A.

In this exemplary embodiment, the perforating gun system 37A is transitioned at the wellsite 1001 from the transport state to the deployment state automatically by mechanically coupling the pre-assembled perforating gun kit comprising tandem sub 50A/perforating gun 35B to the downhole end of perforating gun 35A whereby the shaped charges 125 of perforating gun 35A automatically enter into ballistic communication with the corresponding detonator 158 of the signal pod 150 of tandem sub 50A. For example, torque may be applied (via a tool or manually) to the exterior of the pre-assembled perforating gun kit to rotatably and threadably connect the perforating gun kit with the downhole end of perforating gun 35A. However, the means by which the perforating gun kit comprising tandem sub 50A is coupled with perforating gun 35A to transition perforating gun system 37A from the transport state to the deployment state may vary in other embodiments.

Returning to FIGS. 61 and 62, perforating gun kits 1005 may be individually loaded onto the rotary actuator 1040 positioned at an upstream end or start of the track 1022. In this position, a longitudinal force may be applied to the uphole end of the loaded perforating gun kit 1005 by linear actuator 1034 in concert with the application of rotational torque to the kit 1005 by rotary actuator 1040 whereby the kit 1005 may be coupled (e.g., rotatably or threadably coupled) to an uphole end of a partially assembled toolstring 1007. This coupling of the perforating gun kit 1005 with the uphole end of the partially assembled toolstring 1007 automatically transitions the perforating gun system 37B from the transport state to the deployment state given that the uphole end of the partially assembled toolstring 1007 is defined, in this exemplary embodiment, by the corresponding tandem sub 50B of perforating gun system 37B.

Although the transportation of perforating gun systems from a remote site to wellsite 1001 in a transport state and subsequently transitioning the perforating gun systems 37 following their arrival at the wellsite 1001 to the deployment state in the context of system 1000, in other embodiments, different systems may be employed for transporting perforating gun systems 37 to the wellsite 1001 and/or for loading and assembling the transported perforating gun systems 37 into a toolstring. For example, in some embodiments, the different perforating gun systems 37 may be manually loaded and assembled at the wellsite 1001 rather than utilizing an at least partially automated system such as system 1000.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A tandem sub system for perforating guns comprising:
- a tandem sub including a signal pod cavity, a throughbore and a cavity for a pressure bulkhead;
- a signal pod comprising
  - a chassis having a longitudinal axis;
  - a printed circuit board attached to the chassis;
  - a receptacle at a longitudinal first end of the chassis;
  - a first electrical connector positioned within the receptacle and electrically connected to the printed circuit board;
  - a second electrical connector positioned at a longitudinal second end of the signal pod opposite the first end and wherein the second electrical connector is electrically connected to the printed circuit board;
  - a ground electrical contact extending from the printed circuit board and electrically connected thereto; and
  - a detonator electrically connected to the printed circuit board and positioned between a longitudinal midline of the chassis and the first end of the chassis; and
- a pressure bulkhead connected to the second electrical connector where the pressure bulkhead includes conductive core and an insulating body where the conductive core is connectable to a next tool in the system.

2. The tandem sub system according to claim 1 wherein the second electrical connector is arranged to connect to the pressure bulkhead such that at least one of the second electrical connector and the pressure bulkhead includes a spring contact portion that move into and away from the longitudinal axis as engagement of the second electrical connector is made with the pressure bulkhead.

3. The tandem sub system according to claim 2 wherein the second electrical connector engages with the pressure bulkhead within the throughbore between the signal pod cavity and the cavity for the bulkhead.

4. The tandem sub system according to claim 1 wherein the pressure bulkhead includes a conductive axial post for connecting to a further perforating gun wherein the contact portion of the axial post is on the outer periphery such that engagement with the further perforating gun is radially oriented relative to the longitudinal axis.

5. The tandem sub system according to claim 4 wherein the pressure bulkhead includes an insulating skirt spaced from but overlying the conductive axial post to restrict conductive particles inside the gun from gathering near the axial post to reduce the potential of the formation of a short-circuit from the axial post to an electrical ground such as the tandem sub.

6. The tandem sub system according to claim 1, wherein each of the first electrical connector, second electrical connector, and the ground electrical contact comprise electrical spring contacts oriented to flex transverse to the longitudinal axis of the chassis.

7. The tandem sub system of claim 1, wherein the chassis defines an external opening and the signal pod further comprises a cover connectable to the chassis to enclose the external opening while permitting fluid communication across an interface formed between the cover and the external opening.

8. The tandem sub system according to claim 1, wherein the first electrical connector comprises an electrical spring contact oriented to flex radially into and away from a longitudinal axis of the receptacle.

9. The tandem sub system according to claim 1, wherein the second electrical connector comprises an electrical spring contact oriented to flex radially into and away from the through axis in a generally radial direction relative to the through axis.

10. The tandem sub system according to claim 1, wherein the receptacle has a receptacle axis and the signal in electrical connector includes a spring contact oriented to flex into and away from the receptacle axis in a generally radial direction relative to the receptacle axis and the through electrical connector has a through axis and the through electrical connector includes a spring contact oriented to flex into and away from the through axis in a generally radial direction relative to the through axis and the ground electrical connector includes a spring contact oriented to flex into and away from the longitudinal axis of the chassis.

11. The tandem sub system according to claim 10, wherein the receptacle axis and the through axis are generally aligned with the longitudinal axis of the chassis.

12. The tandem sub system according to claim 1, wherein the detonator is arranged parallel to the axis of the chassis.

13. The tandem sub system according to claim 1, wherein the signal pod includes a reflector over the detonator to reflect explosive energy back toward the longitudinal axis.

14. A perforating gun system deployable in a wellbore extending through a subterranean earthen formation, the perforating gun system having a longitudinal axis and comprising:

a first perforating gun comprising a charge carrier configured to receive one or more shaped charges, the charge carrier comprising a detonator cord housing configured to receive a terminal end of a detonator cord and support the detonator cord along the longitudinal axis;

a tandem sub comprising a sub housing and a signal pod cavity, a throughbore and a cavity for a pressure bulkhead;

a signal pod comprising:

a chassis having a longitudinal axis;

a printed circuit board attached to the chassis;

a receptacle at a longitudinal first end of the chassis;

a first electrical connector positioned within the receptacle and electrically connected to the printed circuit board;

a second electrical connector positioned at a longitudinal second end of the signal pod opposite the first end and wherein the second electrical connector is electrically connected to the printed circuit board;

a ground electrical contact extending from the printed circuit board and electrically connected thereto; and a detonator electrically connected to the printed circuit board and positioned between a longitudinal midline of the chassis and the first end of the chassis;

a pressure bulkhead connected to the second electrical connector where the pressure bulkhead includes conductive core and an insulating body where the conductive core with a conductive axial post; and a second perforating gun also configured to receive one or more shaped charges, and including a top plate connector oriented toward the conductive axial post of the pressure bulkhead to enable electric signals received by the signal pod to pass along to the second perforating gun.

* * * * *